US005489250A

United States Patent [19]

Densmore et al.

[11] Patent Number: 5,489,250

[45] Date of Patent: Feb. 6, 1996

[54] TREADMILL DECELERATION SYSTEM AND METHOD

[75] Inventors: Bruce D. Densmore, Seattle; Lester A. Hass, Duvall; John T. Rotunda, Renton; Gregory W. Fissel, Seattle, all of Wash.

[73] Assignee: Quinton Instrument Company, Bothell, Wash.

[21] Appl. No.: 201,870

[22] Filed: Feb. 25, 1994

Related U.S. Application Data

[62] Division of Ser. No. 790,750, Nov. 8, 1991, Pat. No. 5,290,205.

[51] Int. Cl.[6] ..... A63B 22/02; A63B 24/00

[52] U.S. Cl. ..... 482/54; 482/7; 482/901

[58] Field of Search ..... 482/1, 4, 7, 9, 482/54, 901; 198/577, 794

[56] References Cited

U.S. PATENT DOCUMENTS

| | | |
|---|---|---|
| 1,607,002 | 11/1926 | Keller . |
| 3,689,066 | 9/1972 | Hagen . |
| 3,737,163 | 6/1973 | Sumrall . |
| 3,919,891 | 11/1975 | Stuhlmuller . |
| 3,954,018 | 5/1976 | O'Berto . |
| 3,984,744 | 10/1976 | Moody . |
| 4,019,106 | 4/1977 | Van Doren . |
| 4,364,556 | 12/1982 | Otte . |
| 4,525,658 | 6/1985 | Yanagida . |
| 4,628,910 | 12/1986 | Krukowski . |
| 4,635,927 | 1/1987 | Shu . |
| 4,749,181 | 6/1988 | Pittaway et al. . |
| 4,792,134 | 12/1988 | Chen . |
| 4,842,266 | 6/1989 | Sweeney, Sr. et al. . |
| 4,928,958 | 5/1990 | Chen . |
| 4,944,713 | 7/1990 | Salerno . |
| 4,964,841 | 10/1990 | Takayama et al. . |
| 5,062,626 | 11/1991 | Dalebout et al. . |

*Primary Examiner*—Richard J. Apley
*Assistant Examiner*—John P. Leubecker
*Attorney, Agent, or Firm*—Andrew J. Beck; Montgomery W. Smith; Richard D. Allison

[57] ABSTRACT

A high speed deceleration device and method is disclosed that operates on a D.C. speed-change motor used to change the transmission configurations on the transmission of a treadmill powered by a constant speed drive motor. In ordinary use, normal transmission acceleration and deceleration rates are used to speed up or slow down the treadmill belt. A deceleration control signal causes a high voltage to be provided to the D.C. speed-change motor. The high voltage causes the D.C. speed-change motor to rapidly change the transmission configurations on the treadmill which causes a rapid deceleration of the treadmill belt. The deceleration control signal is produced in response to a user direction or in response to the condition of the treadmill. Once the belt has been slowed below a threshold speed, the machine shuts itself off. During the deceleration process, the drive motor of the treadmill continues to provide power to the treadmill belt through the transmission so that the transmission continues to move during the deceleration process.

40 Claims, 38 Drawing Sheets

SPEED–CHANGE CHARACTERISTIC FOR QUINTON 1–10 MPH TREADMILL t=time, in seconds
y(t)=speed, in MPH FIG. 6
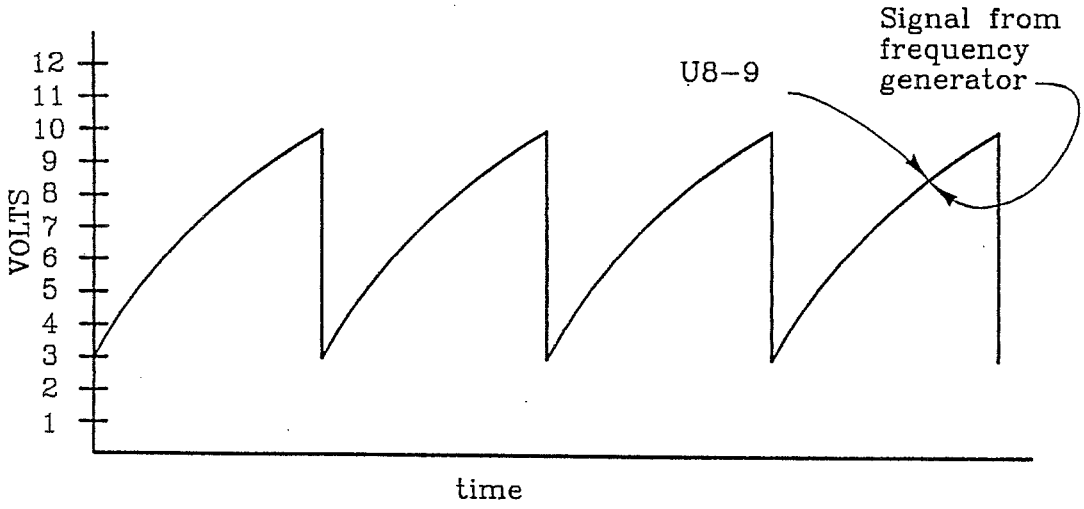
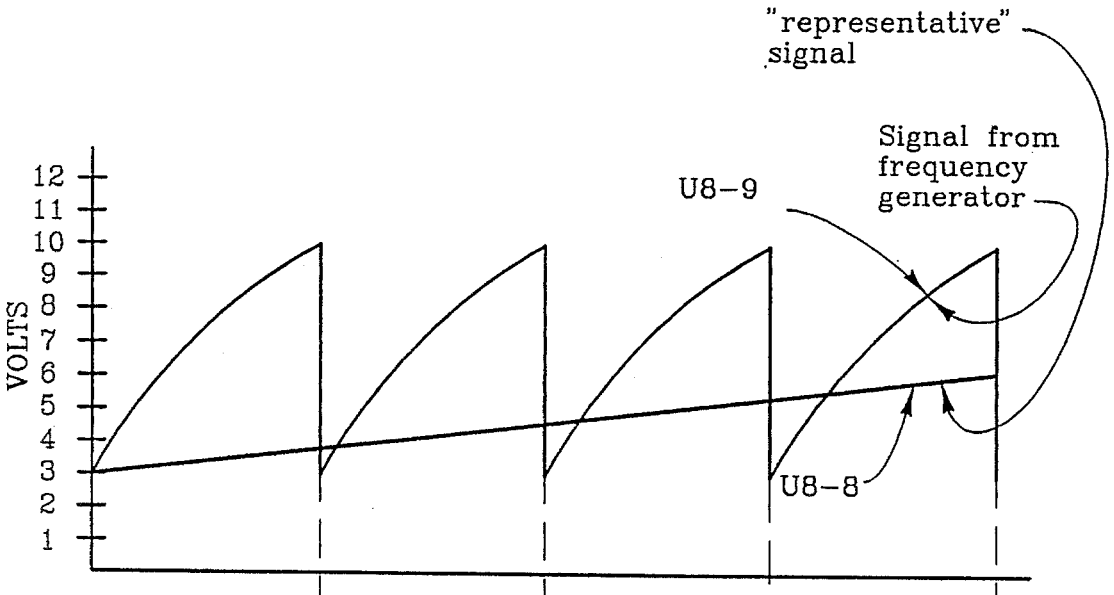
FIG. 7A
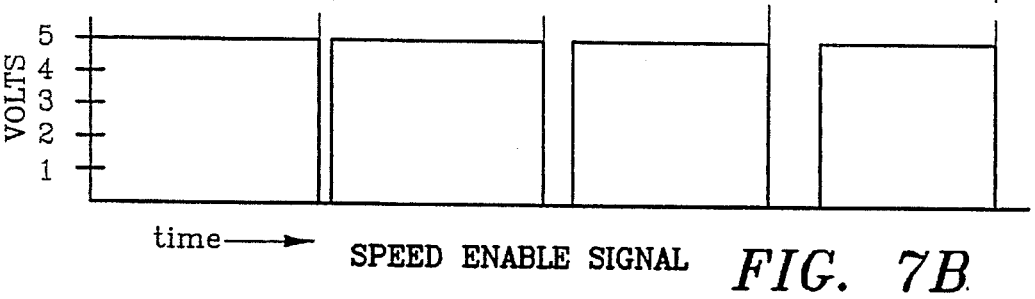
SPEED ENABLE SIGNAL
FIG. 7B

| | | |
|---|---|---|
| 11A | 11B | 11C |
| 11D | 11E | 11F |
| 11G | 11H | 11I |

POWER SUPPLY TABLE

| REF. DES. | CAP. REF. | +5VDC | +12VDC | +26VDC | GND ⏚ |
|---|---|---|---|---|---|
| U7 | C38 | 14 | | | 7 |
| U10 | | | 8 | | 4 |
| U9 | C41 | 14 | | | 7 |
| U8 | C40 | 14 | | | 7 |
| U5 | | | | 9 | 8 |
| U11 | | | 8 | | 4 |

FIG. 14
| INTERRUPT TYPE | USAGE | LEVEL | PRIORITY |
|---|---|---|---|
| INT1 | 4 ms TIMER | LEV_1 | ABS_1 |
| TIMER_2 | TACH COMPARE | LEV_1 | ABS_2 |
| INT2 | DIST. CALC. | LEV_2 | ABS_3 |
| SCI Rx | Rx FULL | LEV_2 | ABS_4 |
| SCI Tx | Tx EMPTY | LEV_2 | ABS_5 |
| A/D CONVERTER | GRADE TASK | LEV_2 | ABS_6 |
FIG. 15
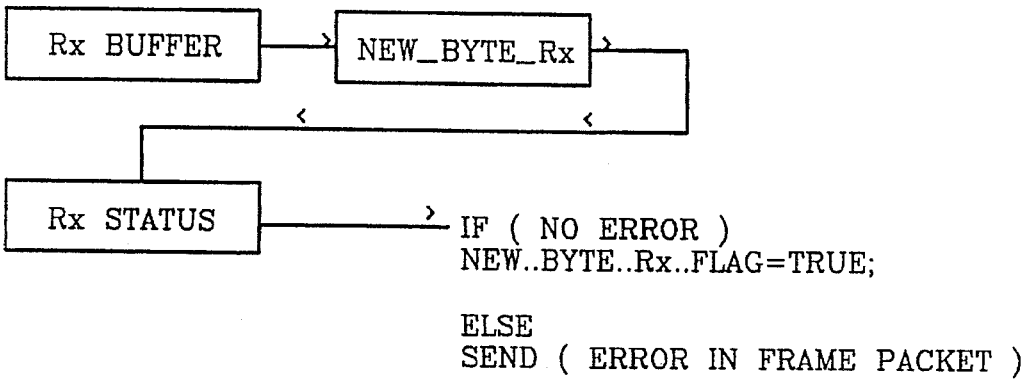
FIG. 16
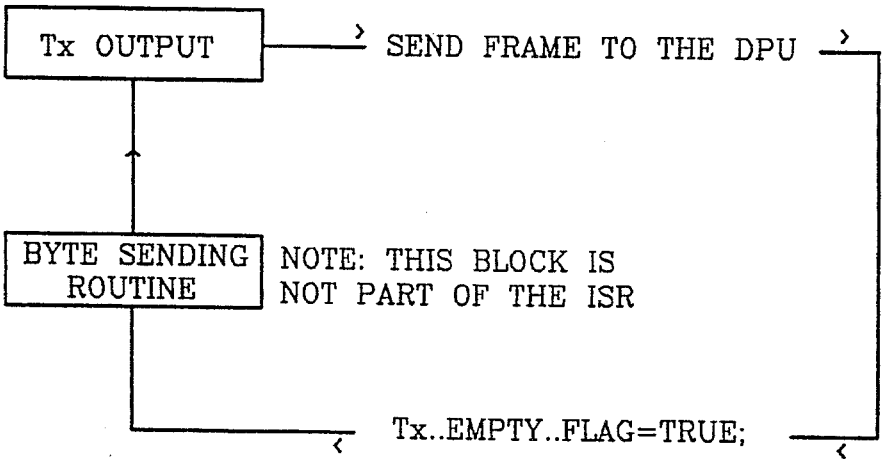

TREADMILL DECELERATION SYSTEM AND METHOD

This application is a division of application Ser. No. 790,750, filed Nov. 8, 1991, now U.S. Pat. No. 5,290,205, issued Mar. 1, 1994.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The invention relates to a method and system for rapidly decelerating a treadmill belt and more specifically relates to a method and system for rapidly decelerating a treadmill belt on a treadmill having a D.C. motor that changes the internal configurations of a transmission on a treadmill powered by a constant speed drive motor, which transmission connects the constant speed drive motor to the belt of the treadmill.

2. Description of Related Art

Treadmills require a drive motor to provide power to the treadmill's belt. Most often, these drive motors are AC motors which turn at only one speed which speed depends on the frequency of the AC power supply. In order to provide various speeds for the treadmill belt, these AC drive motors are connected to the treadmill belt through a mechanical transmission which changes its internal configuration to provide the various speeds for the treadmill belt. The internal configurations of the mechanical transmission is typically set by a relatively small speed-change motor. As the speed-change motor turns, the transmission's internal configuration changes so that the treadmill belt speed either increases or decreases depending on the direction that the speed-change motor is turning.

Referring to FIG. 1, a typical treadmill transmission, generally labelled 1, is shown. Typically, these transmissions have a pair of adjustable pulleys 4,7 connected by a transmission belt 6. A first pulley 4 is connected to a drive motor 2 through an input shaft 3 so that rotation of the drive motor 2 rotates this first pulley 4. This first pulley 4 has two opposing conical plates 5*a,b* which form a V-shape for frictionally receiving a correspondingly shaped transmission belt 6.

The transmission 1 also has a second pulley 7. The second pulley 7 has a set of opposed conical plates attached to an output shaft 9. The conical plates 8*a,b* of the second pulley 7 also form a V-shaped recess for frictionally receiving the transmission belt 6 therebetween. The output shaft 9 is in turn attached to a drive roller 11 through a drive belt 10. Rotation of the drive roller 11 causes the treadmill belt (not shown) to move.

Typically in such a transmission 1, a speed-change motor 12 moves the two plates 5*a,b* of the first pulley 4 either closer together or further apart. Because of the conical shape of the opposed plates 5*a,b*, as the plates are moved further apart and tension is placed on the transmission belt 6, the transmission belt 6 situated around the first pulley 4 will move closer to the center of the input shaft 3. As the two plates 5*a,b* are moved closer together by the speed-change motor 12, the transmission belt 6 is moved more towards the outer edge of the first pulley 4.

The plates 8*a,b* of the second pulley 7 are biased in a position toward each other by a tension spring 13. However, sufficient pressure by the transmission belt 6 on the conical plates 8*a,b* of the second pulley 7 will overcome the inherent bias of the plates to be together and force them apart thereby allowing the transmission belt 6, which is under tension, to move from a position more towards the outer edge of the plates 8*a,b* to a position closer towards the output shaft 9. In this way the mechanical advantage imparted to the drive roller 11, and subsequently to the treadmill belt from the drive motor 2, changes depending on the position of the transmission belt 6 on the first and second pulleys 4,7.

The rate of change of the speed of the treadmill belt is dependent on both the current speed of the treadmill belt, that is, on the current position of the transmission belt 6 on pulleys 4,7, and on how fast the speed-change motor 12 is turning.

Previous transmissions have used AC speed-change motors. However, under normal operating conditions, AC motors turn at only one speed regardless of the current or voltage applied to the motor. Consequently, the speed at which the opposing conical plates 5*a,b* are moved together or apart as driven by the AC speed change motor is a constant. In a transmission using an AC speed-change motor, the entire change in the speed of the treadmill belt results from the change in position of the transmission belt 6 on pulleys 4,7 and not from any change in the rate that the conical plates 5*a,b* are moved together or apart. A constant rate of moving the conical plates 5*a,b* together or apart as a result of the constant speed of the AC speed change motor 12 results in a non-constant rate of change for the speed of the treadmill belt as illustrated in FIG. 2.

This non-constant rate of speed change has two primary sources. First, the belt connecting the pulleys has a constant length. As shown in FIG. 1, as the plates 5*a,b* of the first pulley 4 move together or apart in response to the rotation of the speed-change motor 12, the location of the transmission belt 6 on plates 5*a,b* changes. As the conical plates 5*a,b* move apart, the transmission belt 6 will have less tension on it. As a result of the reduction of tension on the transmission belt 6, the tension spring 13 will push plates 8*a,b* together thereby moving transmission belt 6 farther away from the output shaft 9. As transmission belt 6 moves away from output shaft 9, tension is placed on transmission belt 6 by tension spring 13 pulling it into snug frictional contact with conical plates 5*a,b* at a position closer to input shaft 3 than it had been prior to conical plates 5 *a,b* moving apart in response to the rotation of speed change motor 12. Transmission belt 6 will move out from output shaft 9 until the tension in transmission belt 6 equals the tension applied by tension spring 13. This causes the mechanical ratio of pulley 4 and pulley 7 to change. This relationship is illustrated in FIG. 3.

The exact equation for the transmission belt circumference is found by the sum of the straight portions (l+l) and the two partial circumferences ($c_1+c_2$). This leads to the following equation:

$$\text{Circumference}=2d\cdot\sin\theta+2\theta\cdot r_1+2(\pi-\theta\cdot r_2) \qquad 1)$$

where:

$\theta=\cos^{-1}((r_2-r_1)/d)$, and $\theta$ is in radians;

$r_1$=the radius of the transmission belt 6 around first pulley 4;

$r_2$=the radius of the transmission-belt 6 around second pulley 7;

d=the distance between first pulley 4 and second pulley 7; and, $l=d\cdot\sin\theta=((d^2-(r_2-r_1)^2)^{1/2}$.

This equation is extremely difficult to solve for $r_2$ in terms of $r_1$. Equation 1 can be simplified by making the following approximations:

$$c_1=\pi r_1$$

$$c_2=\pi r_2, \text{ and}$$

$$l=((d^2-(r_2-r_1)^2)^{1/2}+\pi(r_2+r_1)$$

so that:

$$\text{Circumference}=2((d^2-(r_2-r_1)^2)^{1/2}+\pi(r_2-r_1) \quad 2)$$

The error created in this approximation is very small and creates an equation which is more easily solved. Since Circumference is the circumference of transmission belt 6 which is a constant "C", and "d", the distance between pulleys 4 and 7, is a constant, the following quadratic equation is derived:

$$(\pi-4)r_2^2+((2\pi^2+8)r_1-2\pi C)r_2+((\pi^2-4)r_1^2-2\pi Cr_1+C^2-4d^2)=0. \quad 3)$$

Solving for $r_2$ gives:

$$r_2=(\pi C-(\pi^2+4)r_1\pm 2(4\pi^2r_1^2-4\pi Cr_1+C^2+d^2(\pi^2-4))^{1/2})/(\pi^2-4) \quad 4)$$

Realistic values show the "±" factor is subtracted, only, in this application.

Although this equation is somewhat cumbersome, it describes the relationship between the position of transmission belt 6 on pulleys 4,7 very well. The treadmill belt speed is a function of the position of transmission belt 6 on pulleys 4,7 and a constant which represents such factors as the gear reduction from the drive motor 2 to the input shaft 3 of first pulley 4. The AC drive motor 2 turns the first pulley 4 with transmission belt 6 positioned on pulley 4 at a radius $r_1$ at a given RPM after a "constant" gear reduction. The RPM at $r_1$ translates into an RPM at $r_2$ as described by equation 4. Rotation of $r_2$ drives the drive roller 11 and thus the treadmill belt at another gear ratio which provides another constant. Thus, the treadmill belt speed can be described as:

$$\text{Speed}=K(r_1/r_2) \quad 5)$$

where "K" is a constant which includes all the individual constants described above. The following constant values were used to generate the graph in FIG. 3. All values are relatively close to those actually used in treadmills.

$$1.12''\leqq r_1\leqq 3.60''$$

d=8"

C=31.6"

K=3.19

As can be seen, the speed change on the output pulley 7 per radial change of position of the belt along the input pulley is non-linear; the speed change when $r_1$ is large occurring at a faster rate than when $r_1$ is smaller. Consequently, no easy means exists to compensate for the fact that the rate of change of speed of the treadmill belt depends on the current setting of the transmission. The effect of this is that the treadmill belt changes speeds much more slowly when the transmission is set at slow speeds than it does when the transmission is set at high speeds. For example, using the transmission settings described above which produced the graph of FIG. 2, it takes about 12 seconds to change speed by one mile per hour from one mile per hour to two miles per hour. But, on the same transmission, it takes about 1¼ seconds to make a one mile per hour change from nine miles per hour to ten miles an hour.

Therefore, it is highly desirable to provide a system for changing the speed of the treadmill which changes speed at approximately the same rate regardless of the current setting of the transmission.

Another common problem with treadmills is that if they are shut off with their transmission set at high speed, when they are restarted, they will restart at this same high speed. An unsuspecting user of the treadmill, unaware that the treadmill has been shut off at a high speed, may attempt to restart the treadmill while standing on the belt. When the treadmill starts in this condition, it starts at a high speed. This has been known to cause unsuspecting users to fall as the treadmill belt moves their feet out from under their bodies. This has resulted in injury to the users as a result of the fall. Therefore it is highly desirable to provide a treadmill which is always starts at slow speed regardless of the speed of the treadmill when it is shut off.

In the typical treadmill, the normal deceleration rate from full speed to stop may be as long as 40 seconds. This has been found to be too long a time for the user to wait for the belt to stop. Consequently, typical treadmills are stopped at whatever speed their transmission configuration is set at and then allowed to restart at that same speed. In order to protect users from these high speed starts, a warning label is placed on the treadmill stating that the treadmill should not be started while standing on the belt because of the danger that the treadmill could start at a high speed. This type of warning has proved to be ineffective and consequently unacceptable because users either ignore the label or the label is either damaged or removed from the device.

SUMMARY OF THE INVENTION

A D.C. speed-change motor used to change the transmission configurations on the transmission of a treadmill powered by a constant speed drive motor is used to rapidly decelerate a treadmill belt. A deceleration control signal causes a high voltage to be provided to the D.C. speed-change motor. The high voltage causes the D.C. speed-change motor to rapidly change the transmission configurations of the treadmill. The deceleration control signal is produced in response to a user direction where in response to the condition of the treadmill. D.C. motors, unlike AC motors, turn at speeds proportional to the voltage provided to them.

The D.C. speed-change motor is controlled by a motor control system which senses both the current speed of the treadmill belt and the electrical current drawn by the speed-change motor. The control system uses this information to modulate the duty cycle of voltage pulses sent to the D.C. speed-change motor to power the motor. The speed change motor effectively "filters" the voltage pulses sent to it by the controller to provide an "average" D.C. voltage to the speed change motor. In this way, the "average" voltage sent to the D.C. speed-change motor can be manipulated by varying the duty cycle of the voltage pulses sent to the speed change motor to produce a constant rate of speed change in the treadmill belt as a result of a non-constant rate of change in configuration of the transmission caused by the manipulated rate of rotation of the speed-change motor.

In normal operation, the control system for the D.C. speed change motor includes a speed change motor driver. The speed change motor driver sends a series of voltage pulses to the D.C. speed change motor. The duty cycle of these voltage pulses is varied in response to whether the control system has determined that the speed change motor needs to rotate faster or slower to produce the constant rate of speed change for the treadmill belt. The D.C. speed change motor itself "averages" the voltage pulses to effectively create an "average" D.C. voltage presented to the speed change motor. The speed of the D.C. speed change motor is directly proportional to the "average" voltage supplied by the motor driver so that a higher "average" voltage from the motor driver produces a higher speed of rotation in the D.C. speed change motor than does a lower "average" voltage.

The polarity of the voltage pulses sent to the D.C. speed-change motor determines the direction of speed change, that is, whether the speed change is to increase or decrease the speed of the treadmill belt. In addition to providing voltage pulses to the D.C. speed change motor, the motor driver provides a current to the speed change motor which current is proportional to the load on the speed change motor.

The speed change motor driver sends voltage pulses to the speed change motor in response to a control signal sent to the motor driver by the control system. This control system is a series of voltage pulses. When these control voltage pulses have a logical "high", the motor driver is enabled to send a voltage to the speed change motor. Because the control signal voltage pulses are cyclical with a variable duty cycle, the motor driver is enabled to send a voltage to the speed change motor in a cyclical fashion. In this way, the voltage pulses sent to the speed change motor by the speed change motor driver are pulses of varying duty cycle which mirror the control signal voltage pulses with their varying duty cycle.

The duty cycle of the voltage pulses sent to the speed change motor by the motor driver is based on a determination by the control system that the speed change motor needs to rotate faster or slower to produce a constant rate of speed change for the treadmill belt. The control system senses both the electrical current drawn by the speed change motor, which indicates the load on the speed change motor, and also the current speed of the treadmill belt which is a result of the current position of the transmission belt on the first and second pulleys. The duty cycle of the voltage pulses sent from the control system to the motor driver, and subsequently to the speed change motor, depends on both the load on the speed change motor and the current speed of the treadmill belt.

The normal transmission acceleration and deceleration rates are used when the speed increase or decrease commands are activated by the user. However, when the STOP BELT command is given, either in response to the user's direction or in response to the condition of the treadmill, a high voltage is sent to the D.C. speed change motor to cause it to rapidly change the configuration of the transmission to decelerate the belt. Once the belt has been slowed below a threshold speed, the machine shuts itself off. During the deceleration process, the drive motor of the treadmill continues to provide power to the treadmill belt through the transmission so that the transmission continues to move during the deceleration process. This allows the speed change motor to smoothly move the transmission from its high speed configuration to its slow speed configuration without pinching the treadmill belt or causing slack in the transmission.

It is a primary object of the invention to provide D.C. speed-change motor control system which causes the D.C. speed-change motor to quickly change the configuration of the transmission to cause the treadmill to rapidly slow down in response to a user generated signal or a signal indicating an unusual or dangerous condition of the treadmill. It is therefore an object of the instant invention to provide a D.C. speed-change motor and control system which provides a relatively constant rate of speed change for the treadmill belt independent of the current configuration of the treadmill transmission and consequently the speed of the treadmill belt, or the load on the speed change motor.

It is a further object of the instant invention to provide a D.C. speed-change motor control system which quickly reacts to either a change in the current configuration of the transmission or a change in the load placed on the D.C. speed-change motor.

These and other objects of the instant invention will become clear with reference to the description contained herein and more particularly with reference to the detailed description of the invention set forth hereafter where like elements are referred to by like reference numerals.

BRIEF DESCRIPTION OF THE DRAWINGS

FIG. 6 is a graph showing the output of the frequency generator of the invention of FIG. 4.

FIG. 7A is a graph of the output signal from the frequency generator and the "representative" signal of the invention of FIG. 4.

FIG. 7B is a graph of the "Speed Enable" signal of the invention of FIG. 4.

FIG. 14 is a table showing the Interrupt Configuration of the embodiment of FIG. 2.

FIG. 15 is a table showing the Receiver Interrupt Task of the embodiment of FIG. 8.

FIG. 16 is a table showing the Transmit Interrupt Task of the embodiment of FIG. 2.

DETAILED DESCRIPTION OF THE INVENTION

Figure 1:
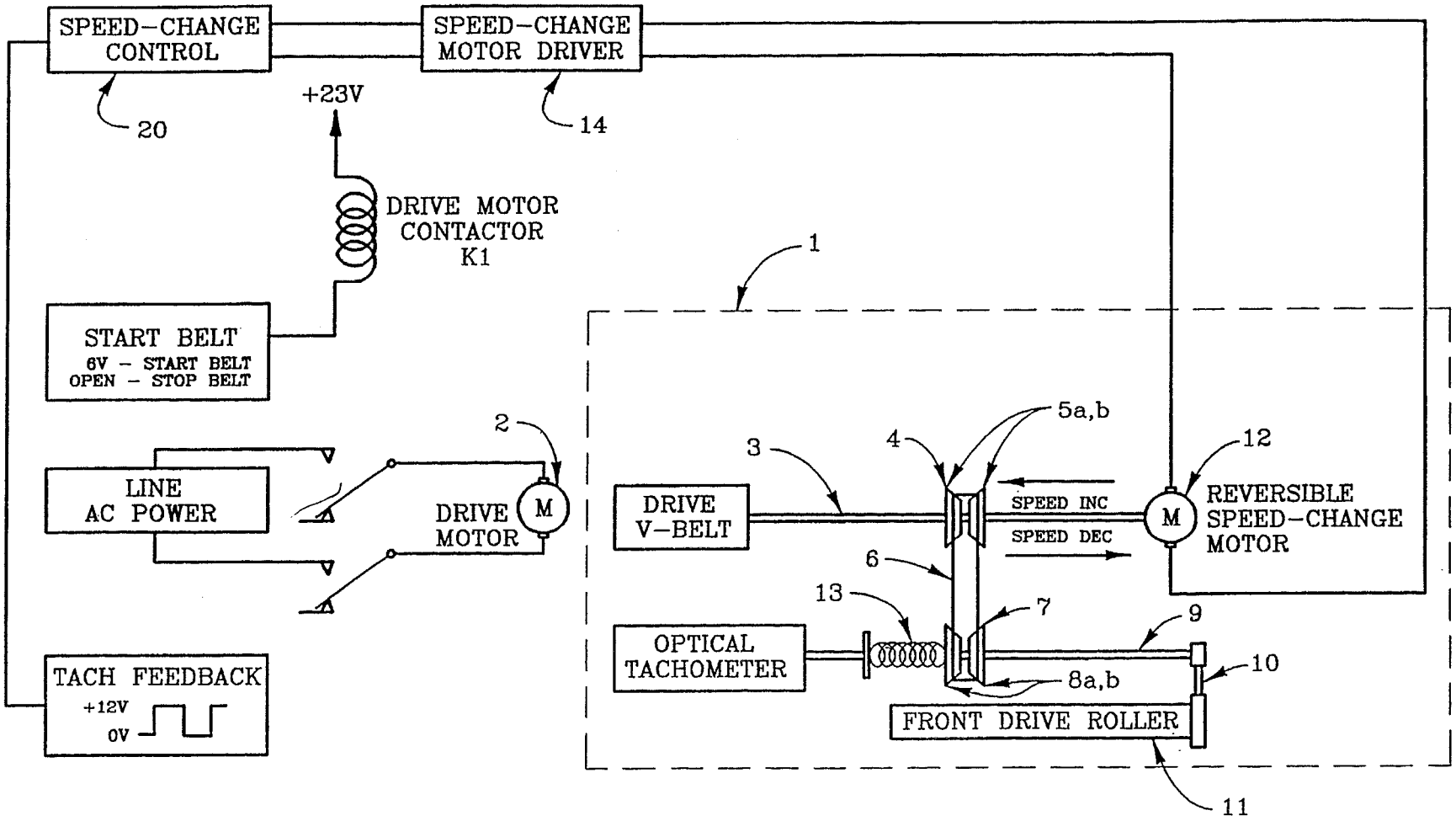
FIG. 1 is a block diagram of a treadmill including its transmission.
Figure 2:
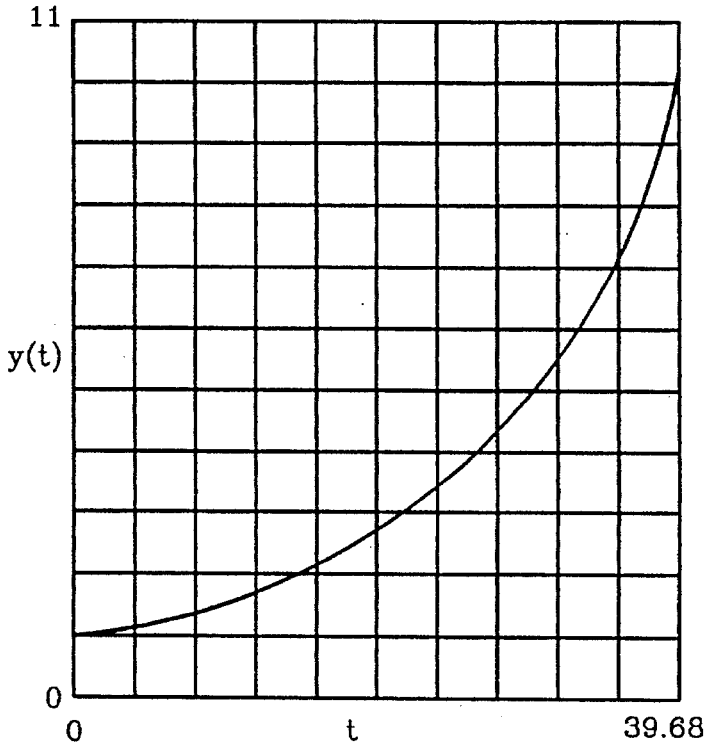
FIG. 2 is a graph of the speed of the treadmill belt versus time that the speed change motor is operating in the prior art transmission of FIG. 1.
Figure 3:
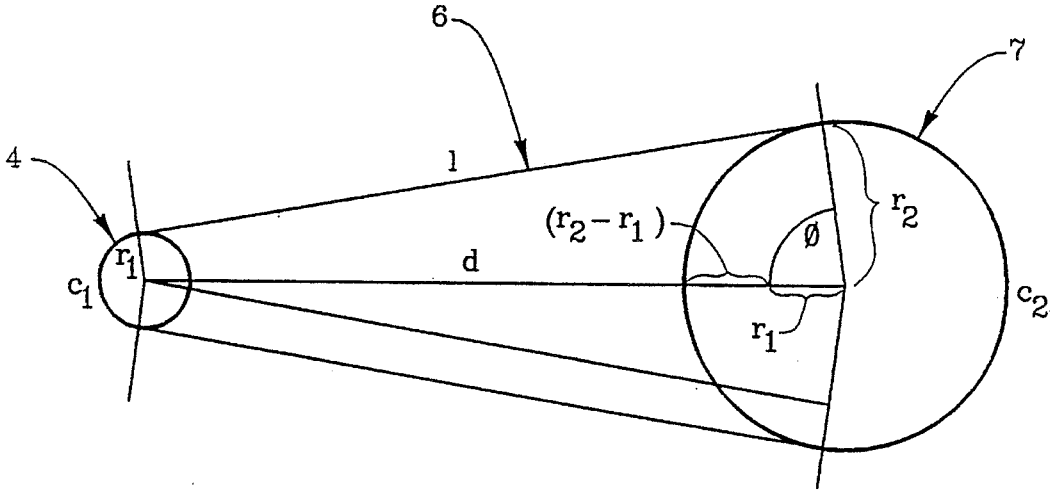
FIG. 3 shows a side schematic view of the transmission of FIG. 1.
Figure 4:
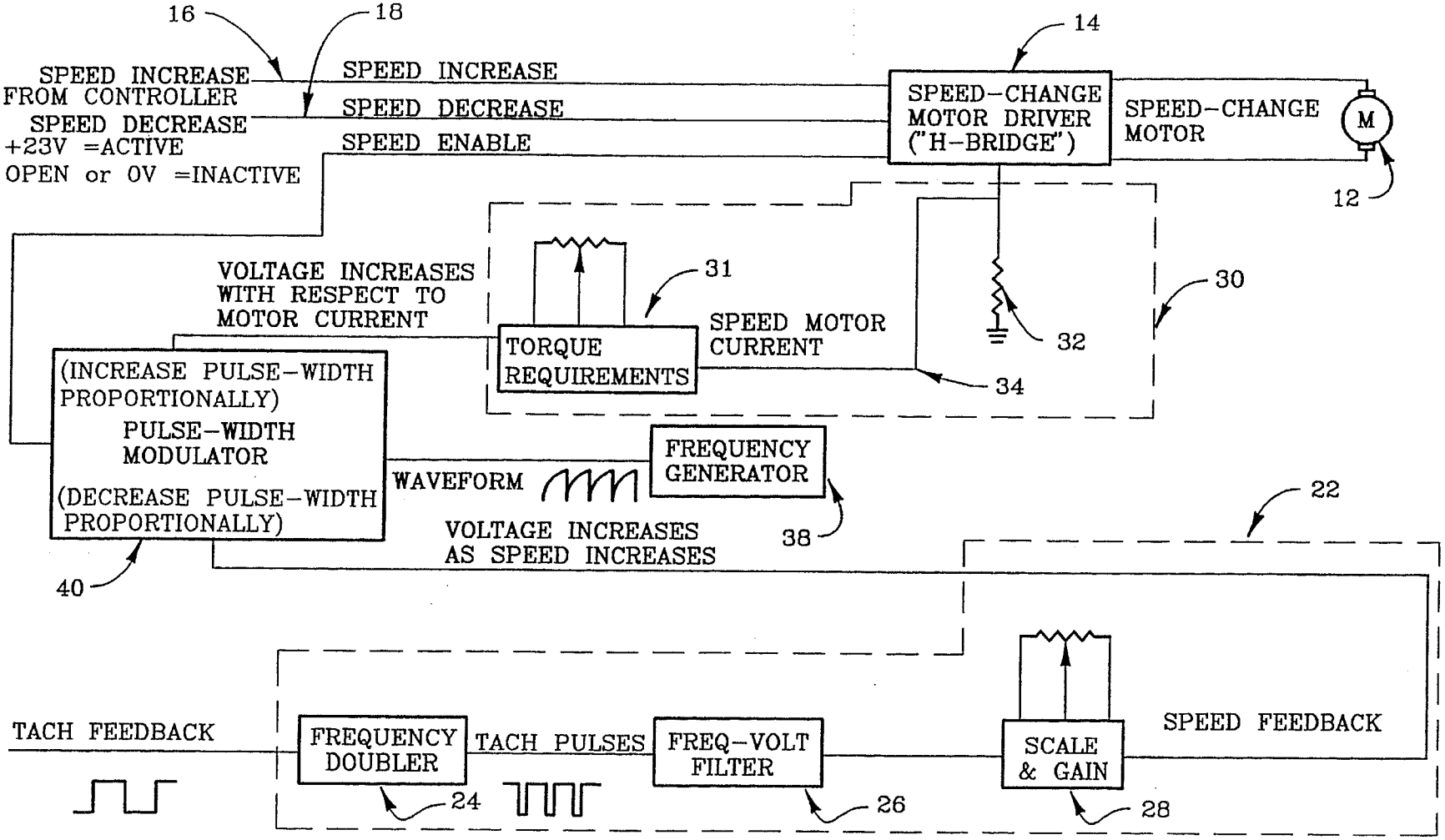
FIG. 4 is a block diagram of one embodiment of the invention.
Figure 5A:
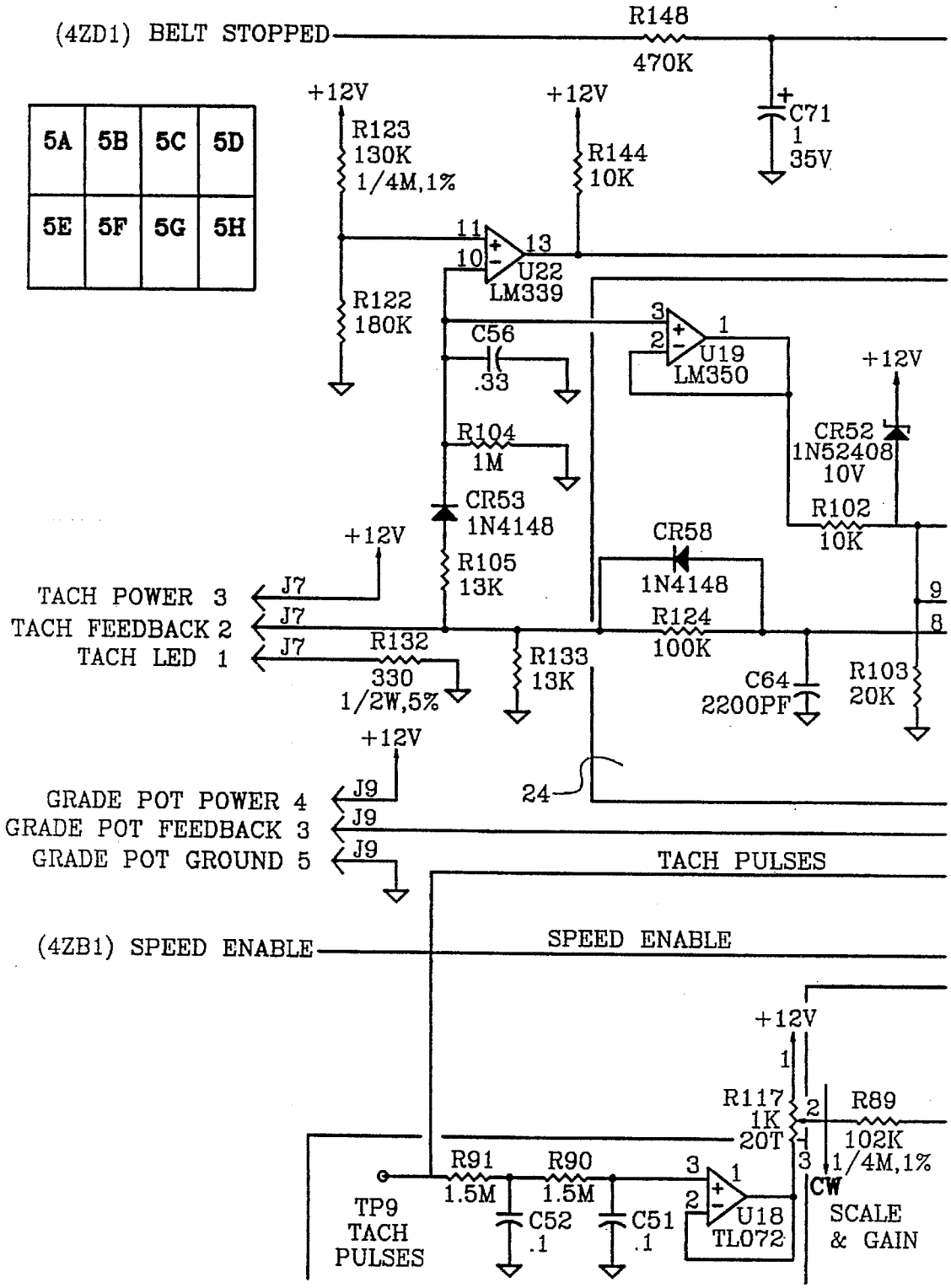
FIGS. 5A through 5J are schematic diagrams of parts of the invention of FIG. 4.
Figure 5B:
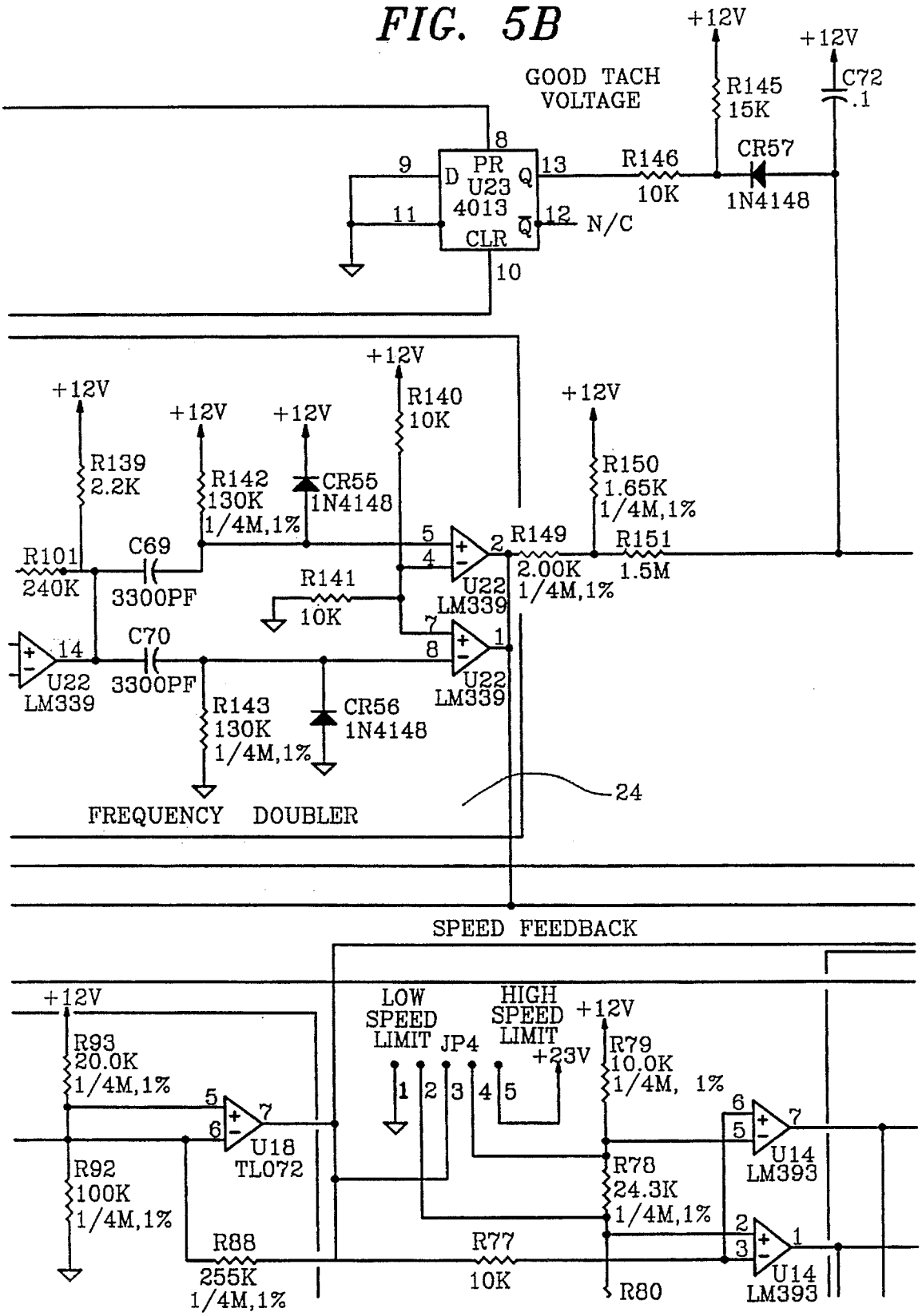
Figure 5C:
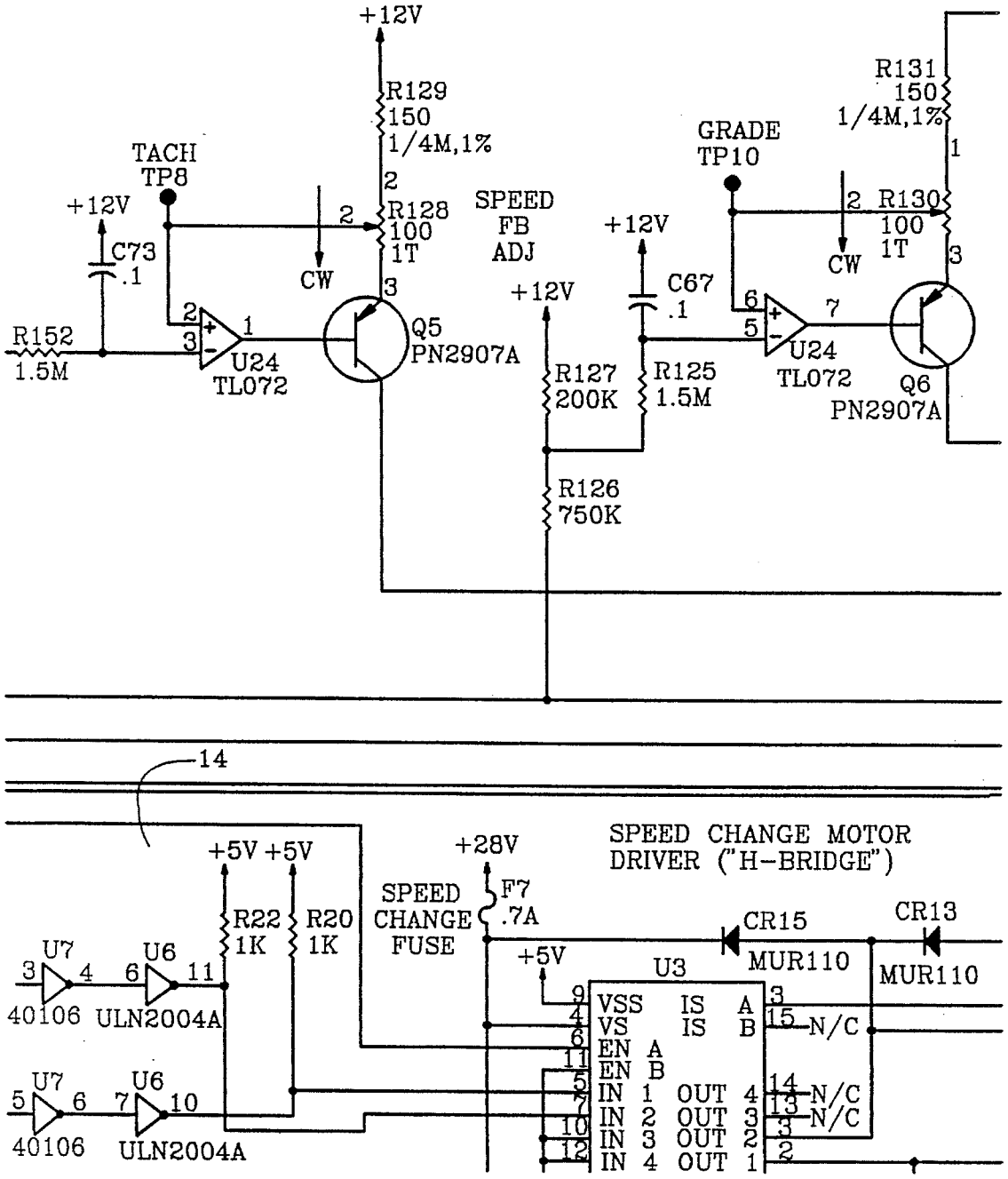
Figure 5D:
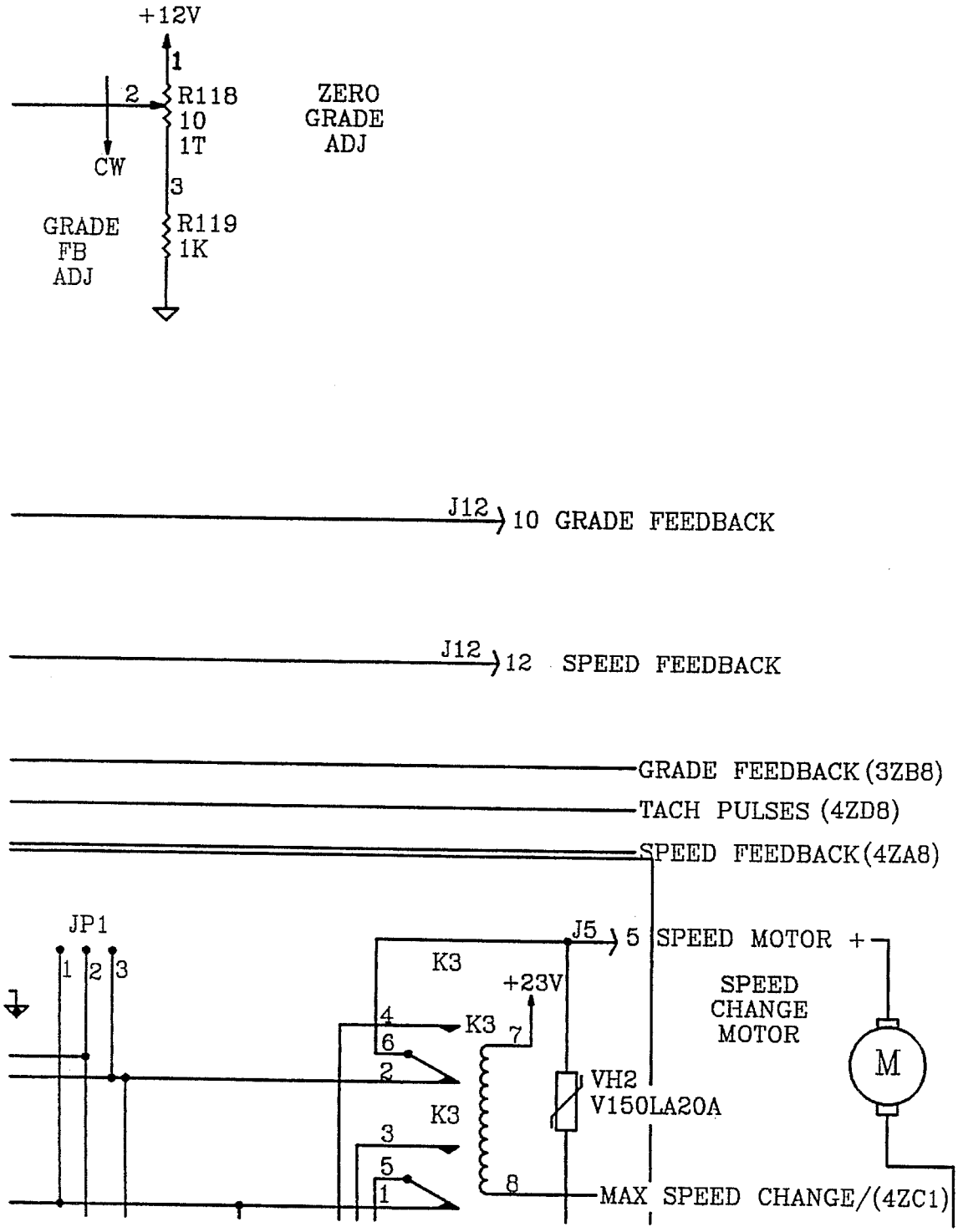
Figure 5E:
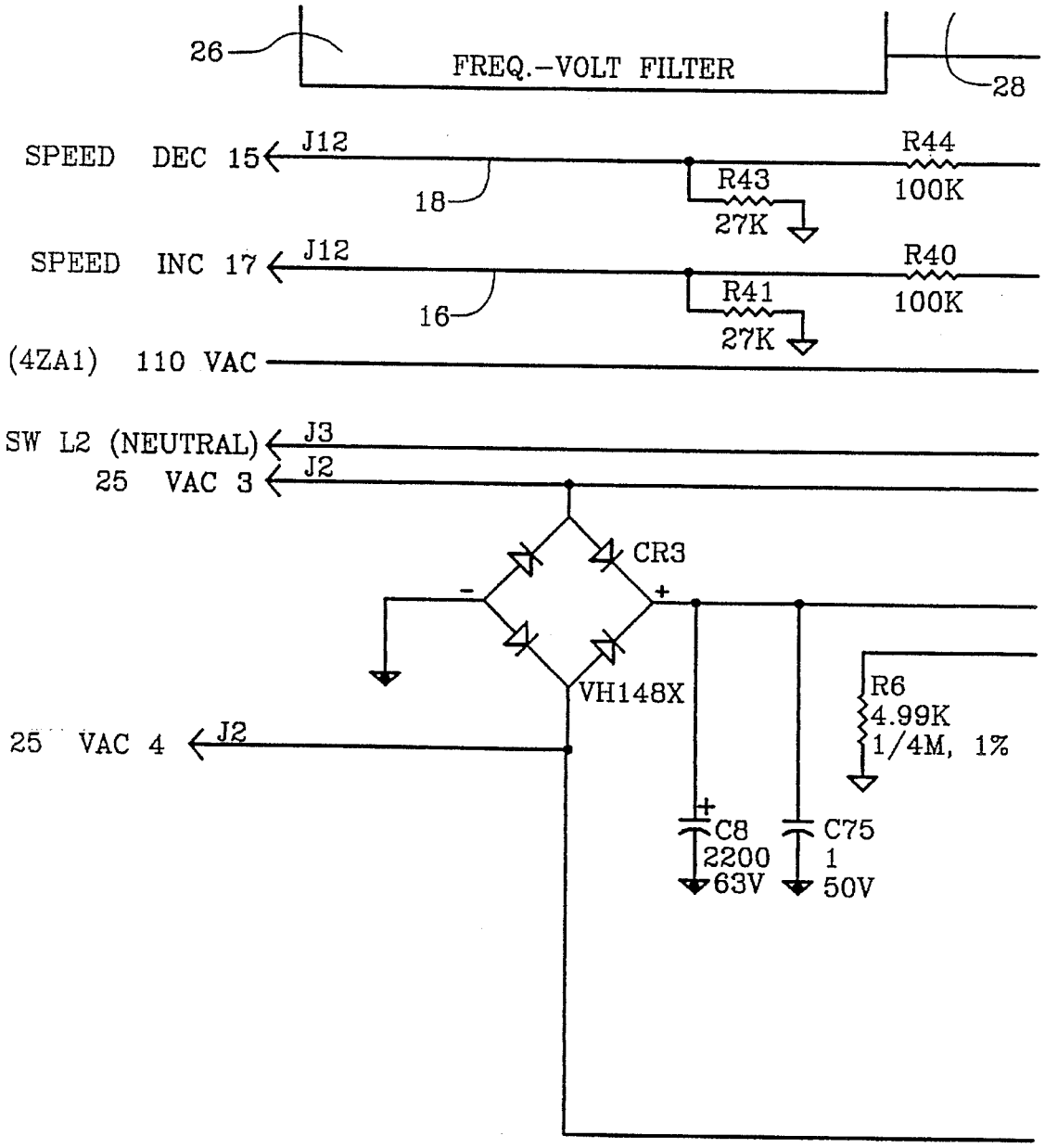
Figure 5F:
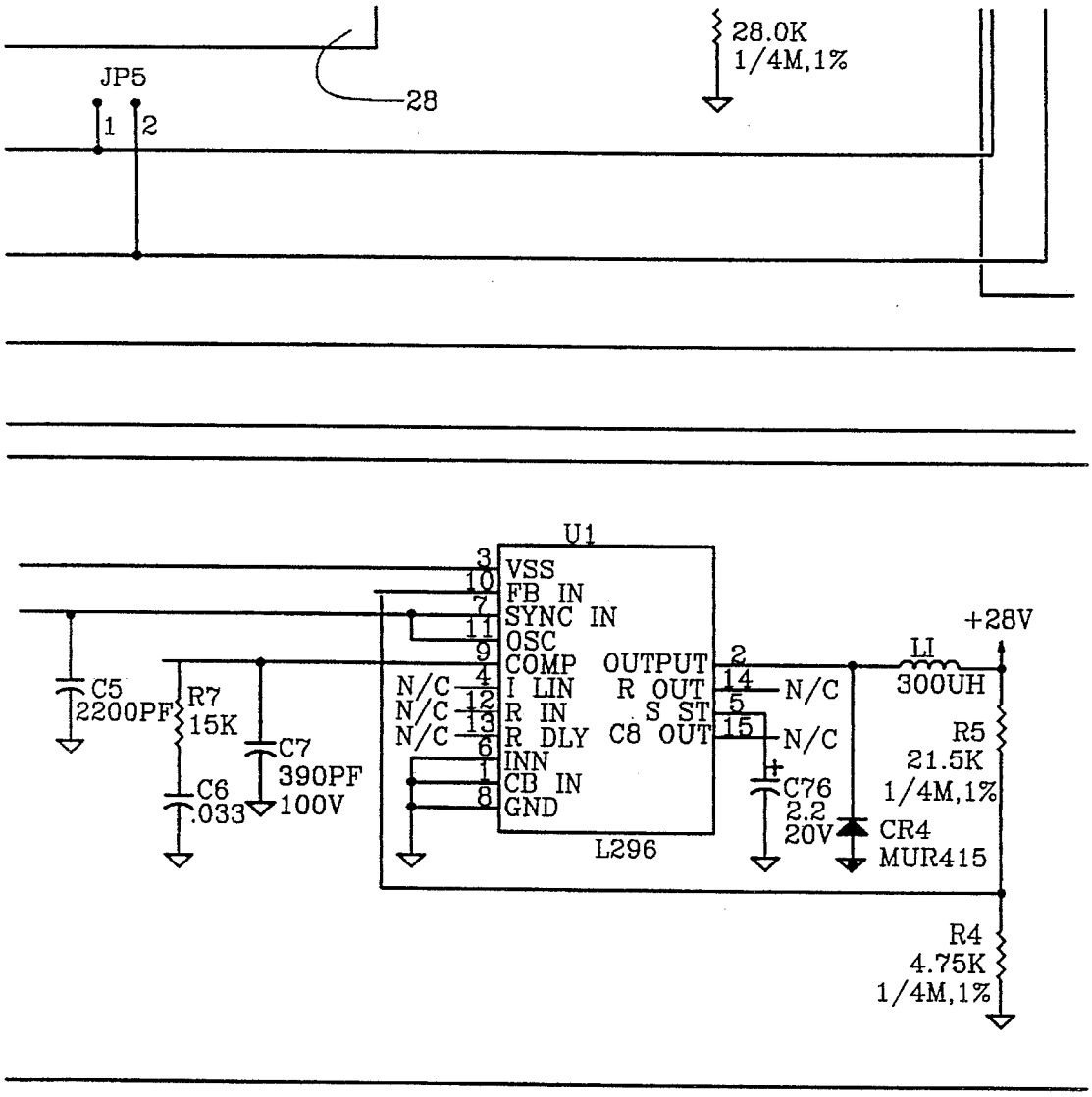
Figure 5G:
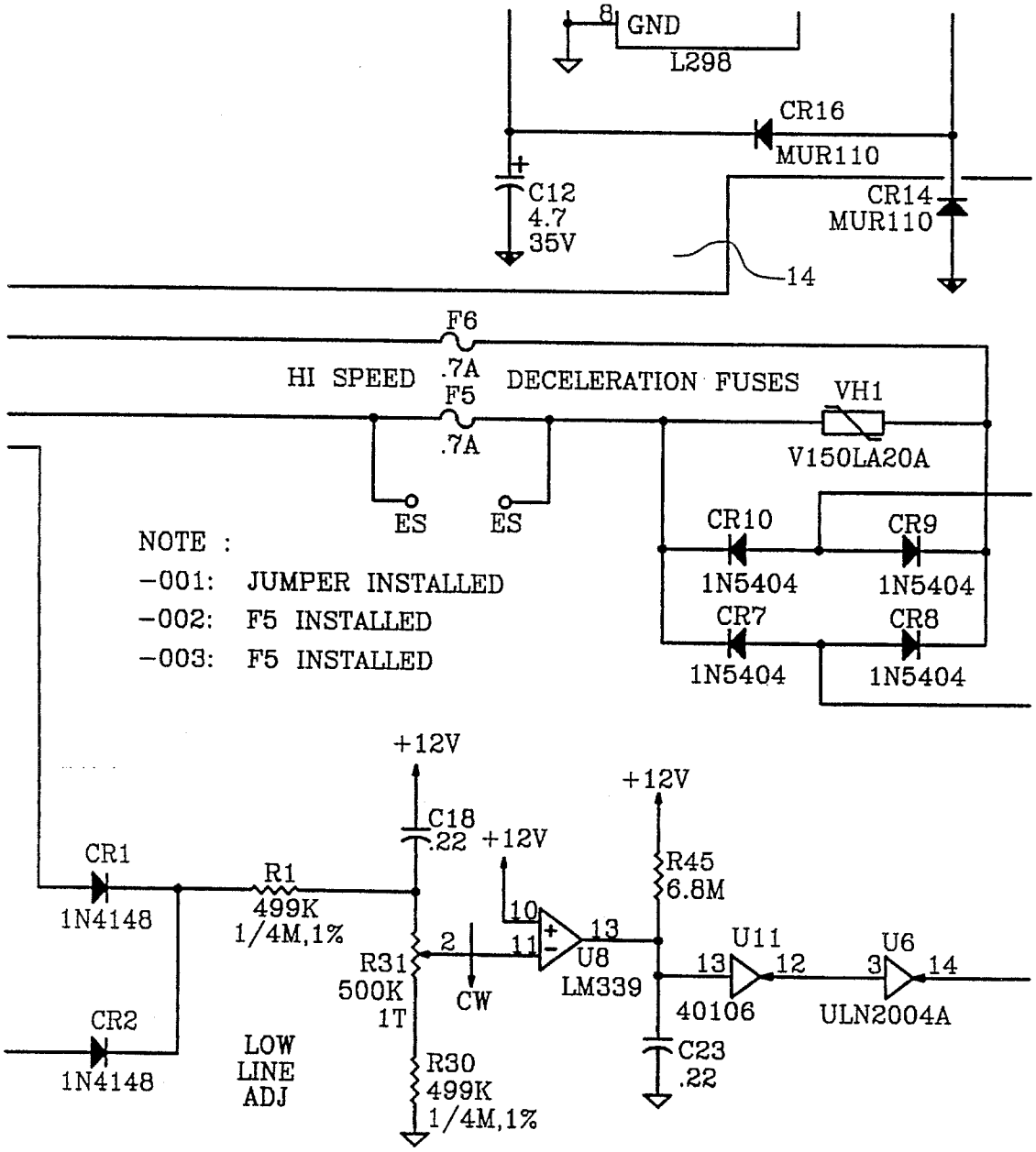
Figure 5H:
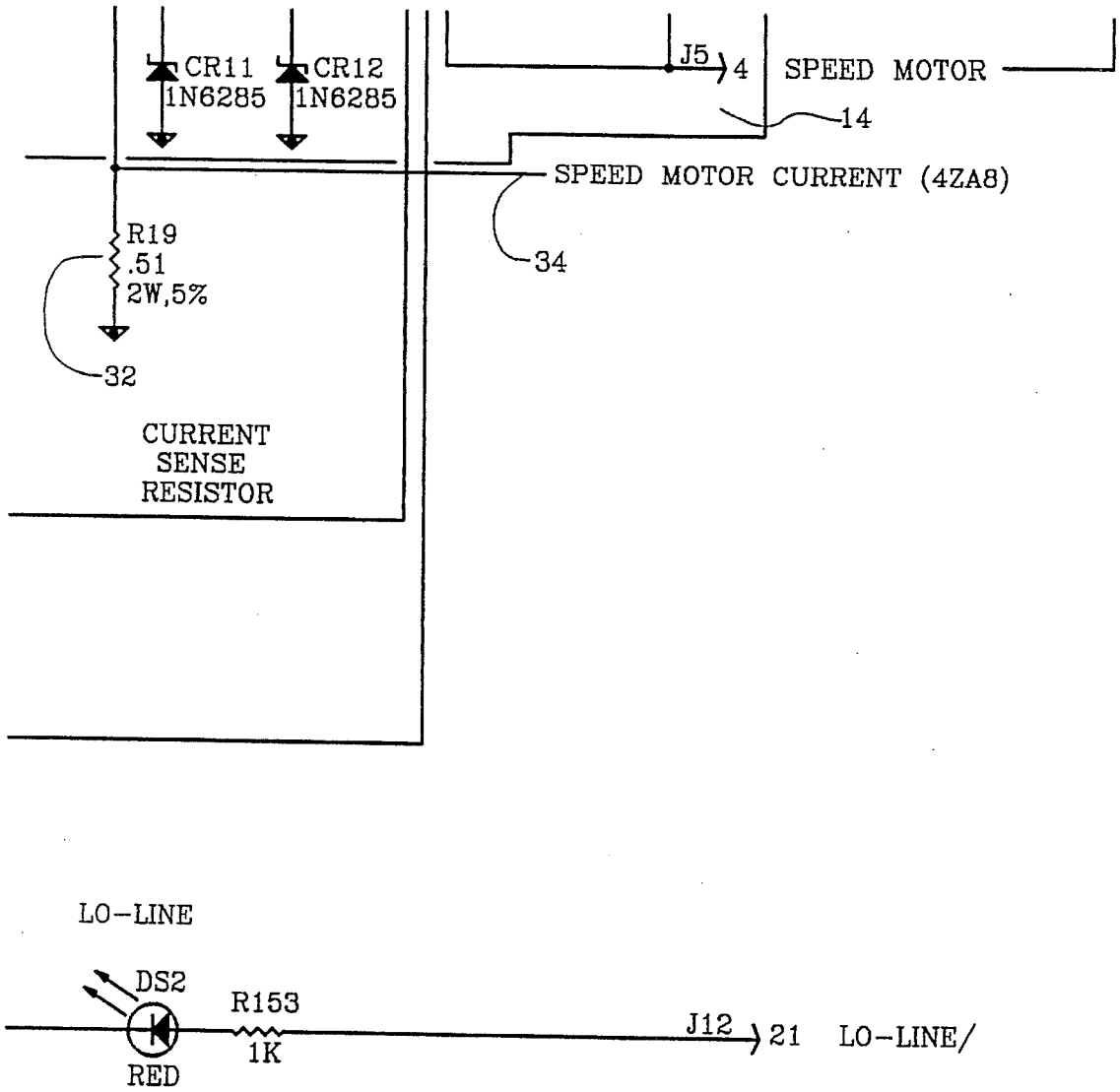
Figure 5I:
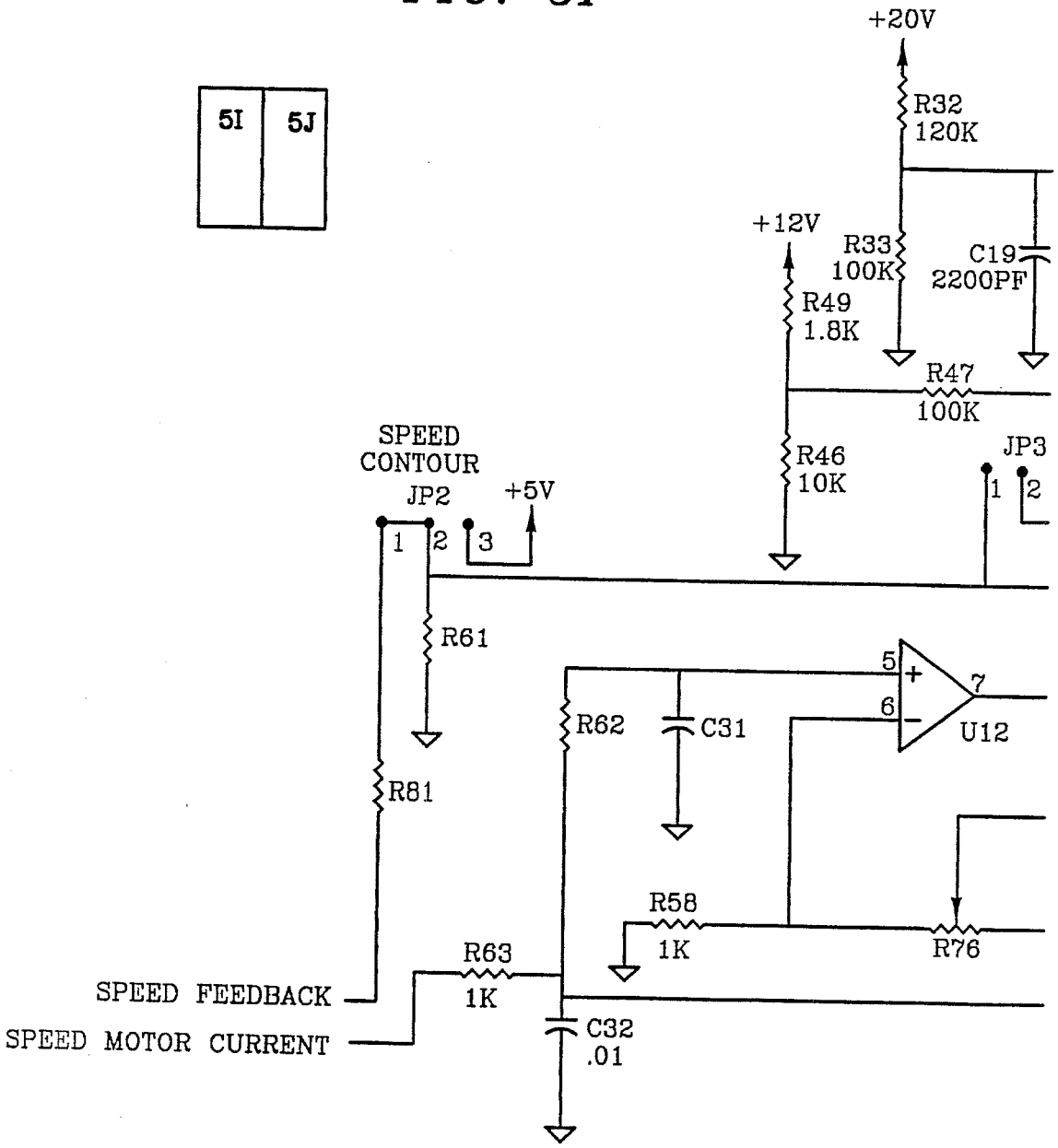
Figure 5J:
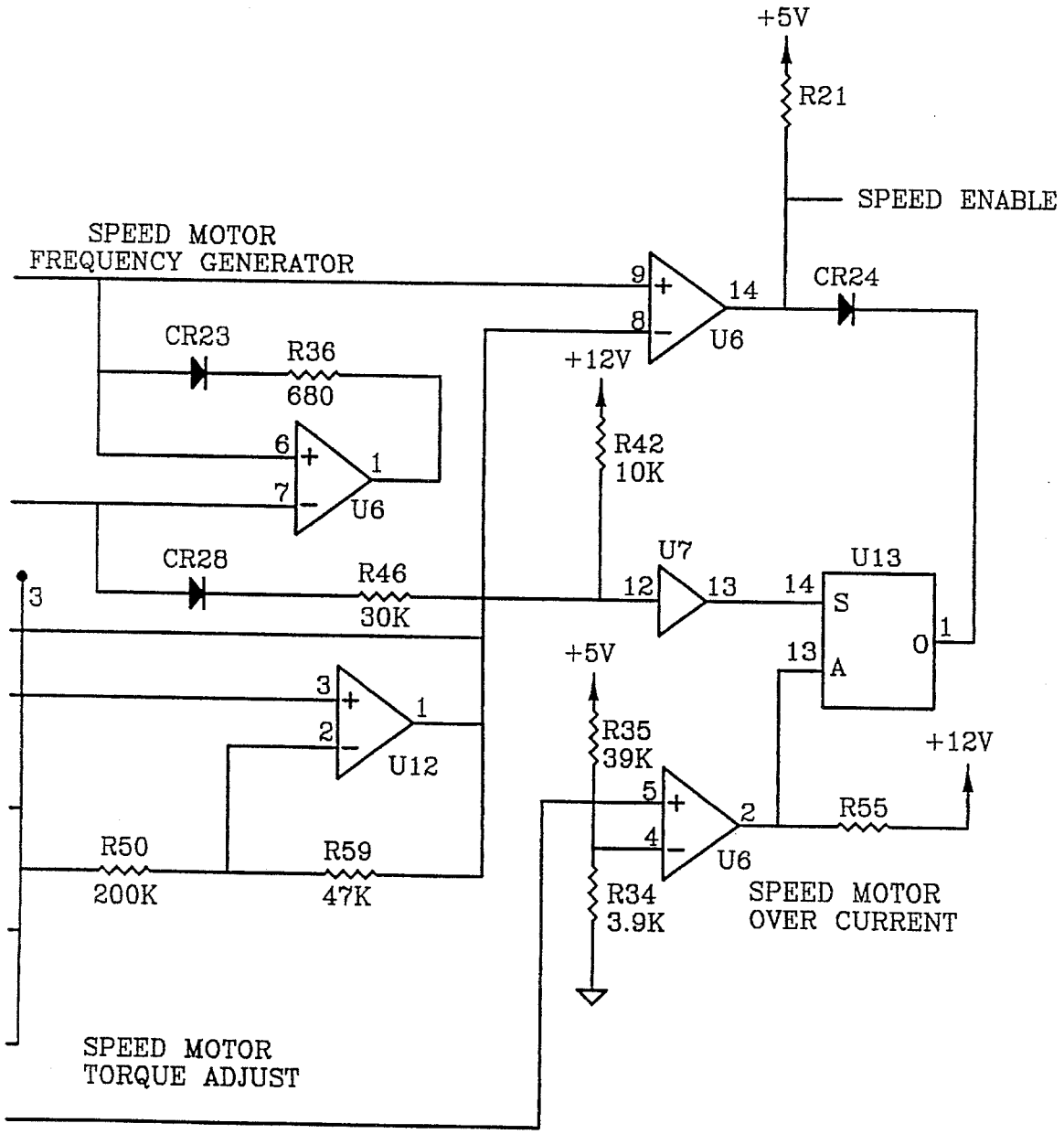
Figure 8:
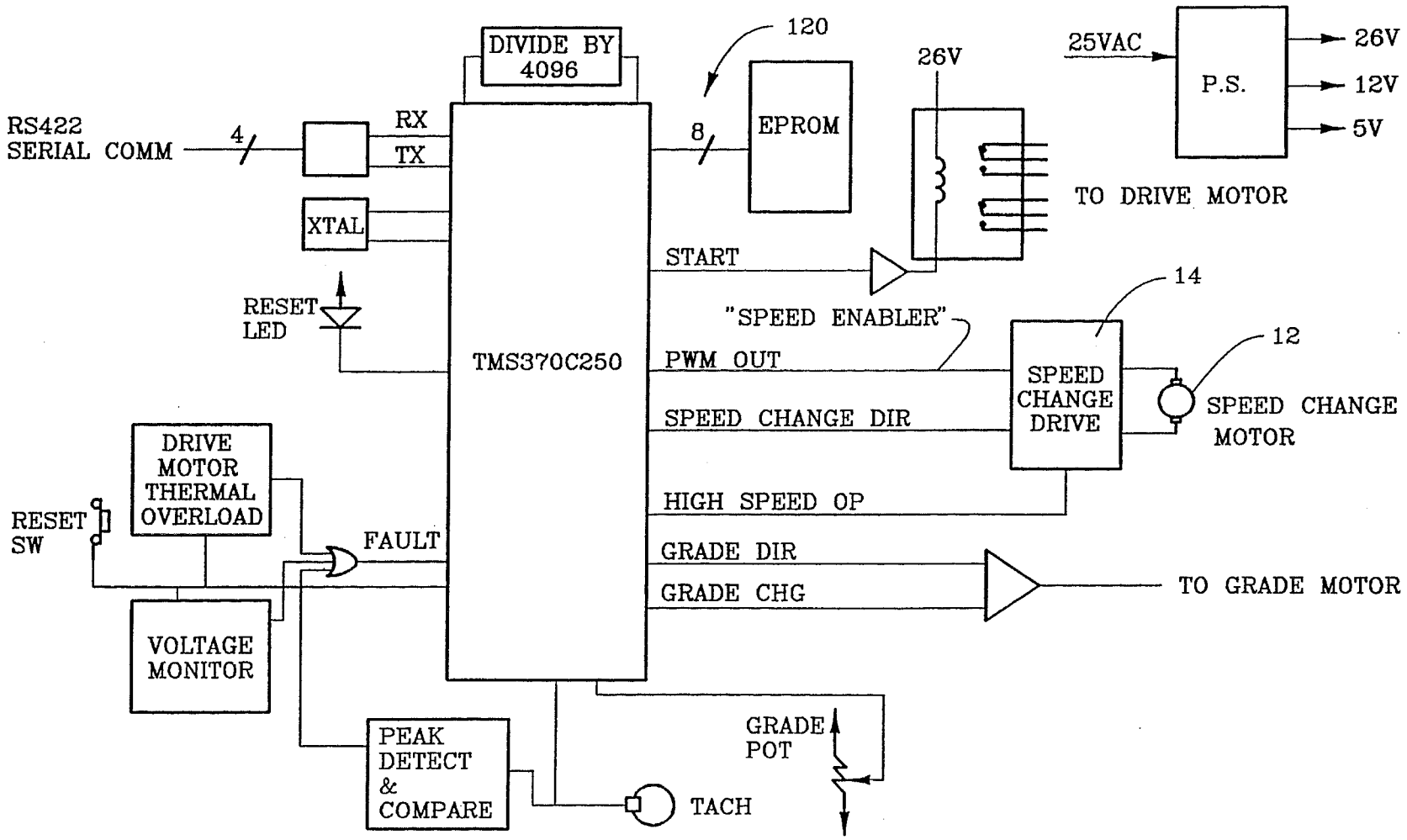
FIG. 8 is a block diagram of the preferred embodiment of the invention.

FIGS. 4 and 8 show a block diagram of two embodiments of the D.C. speed-change controller system. The speed change motor 12 controls the spacing of the conical plate 5*a,b* of the transmission 1 of the treadmill shown in FIG. 1. Transmission 1, as described above, connects a drive motor 2 to a drive roller 11. The spacing of plates 5*a,b* of first pulley 4 are controlled by the rotation of a D.C. speed change motor 12. D.C. speed change motor 12 is in turn controlled by the speed change motor driver 14. The D.C. speed change motor 12 must be of a sufficient size and strength to move conical plates 5*a,b* together or apart to change the internal configurations of the transmission 1 as is well understood in the art.

Figure 11A:
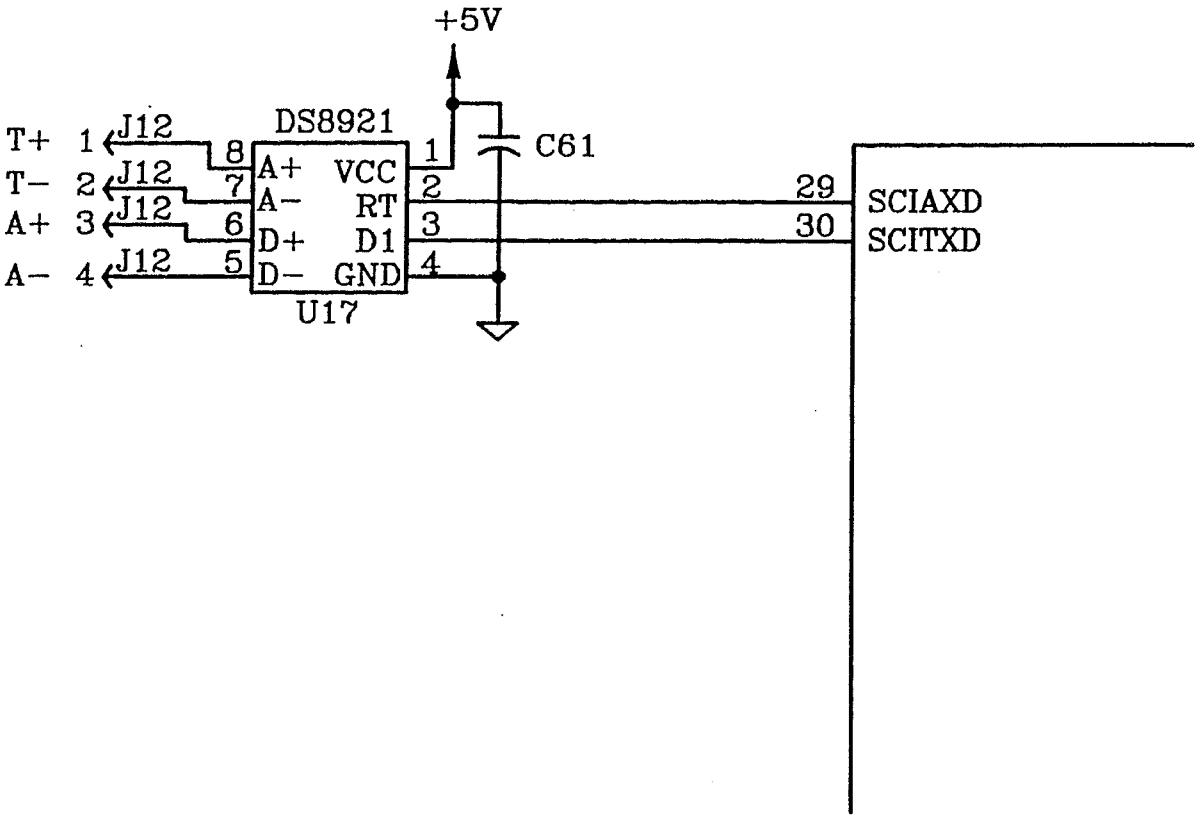
FIGS. 11A through 11I are schematic diagrams of parts of the invention of FIG. 8.
Figure 11B:
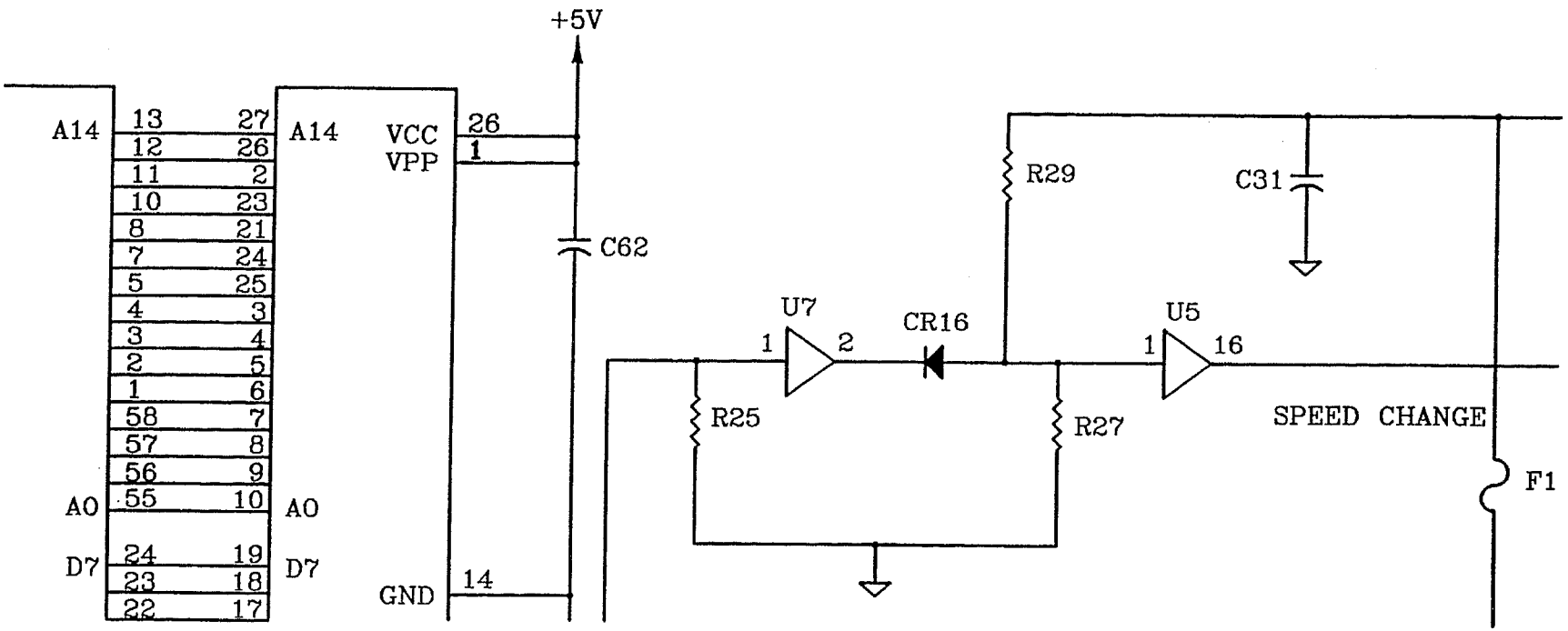
Figure 11C:
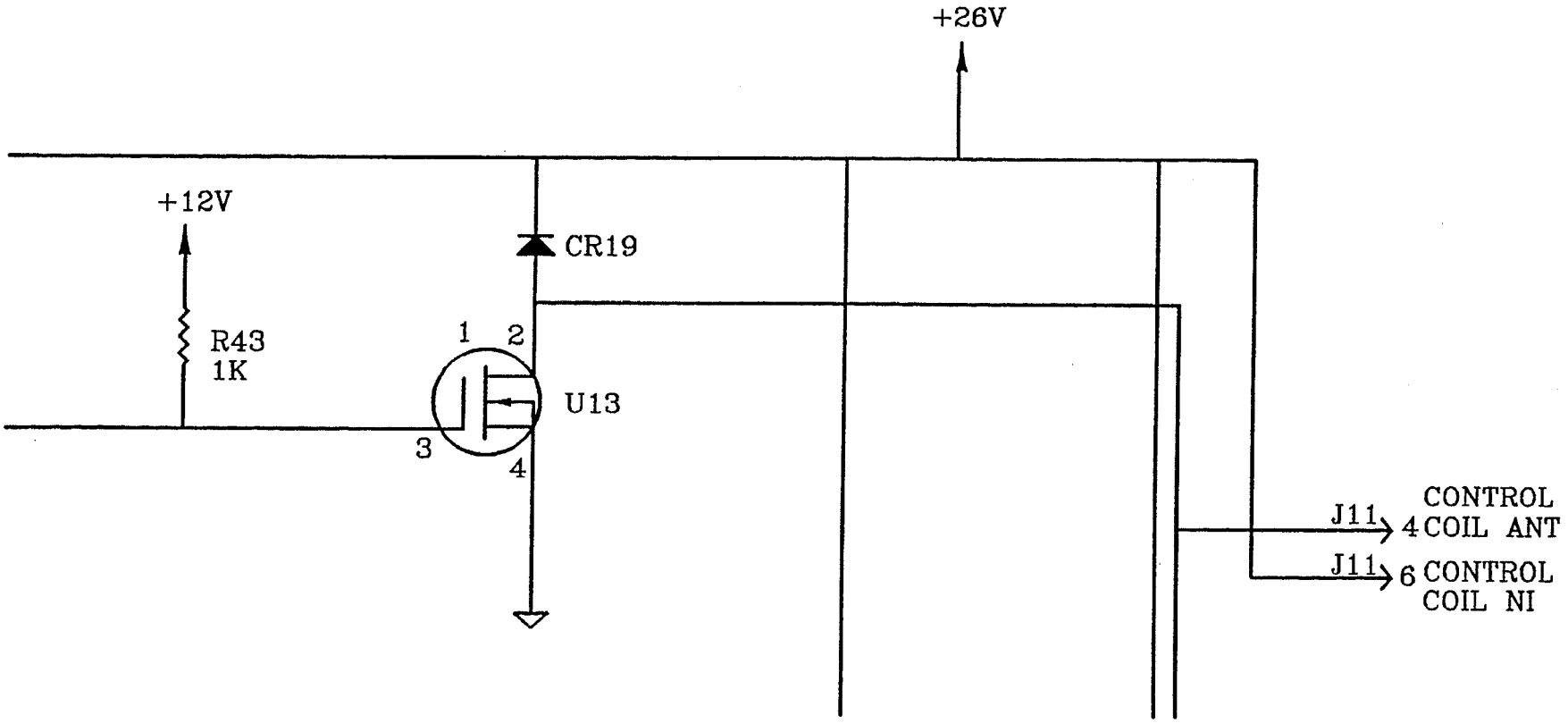
Figure 11D:
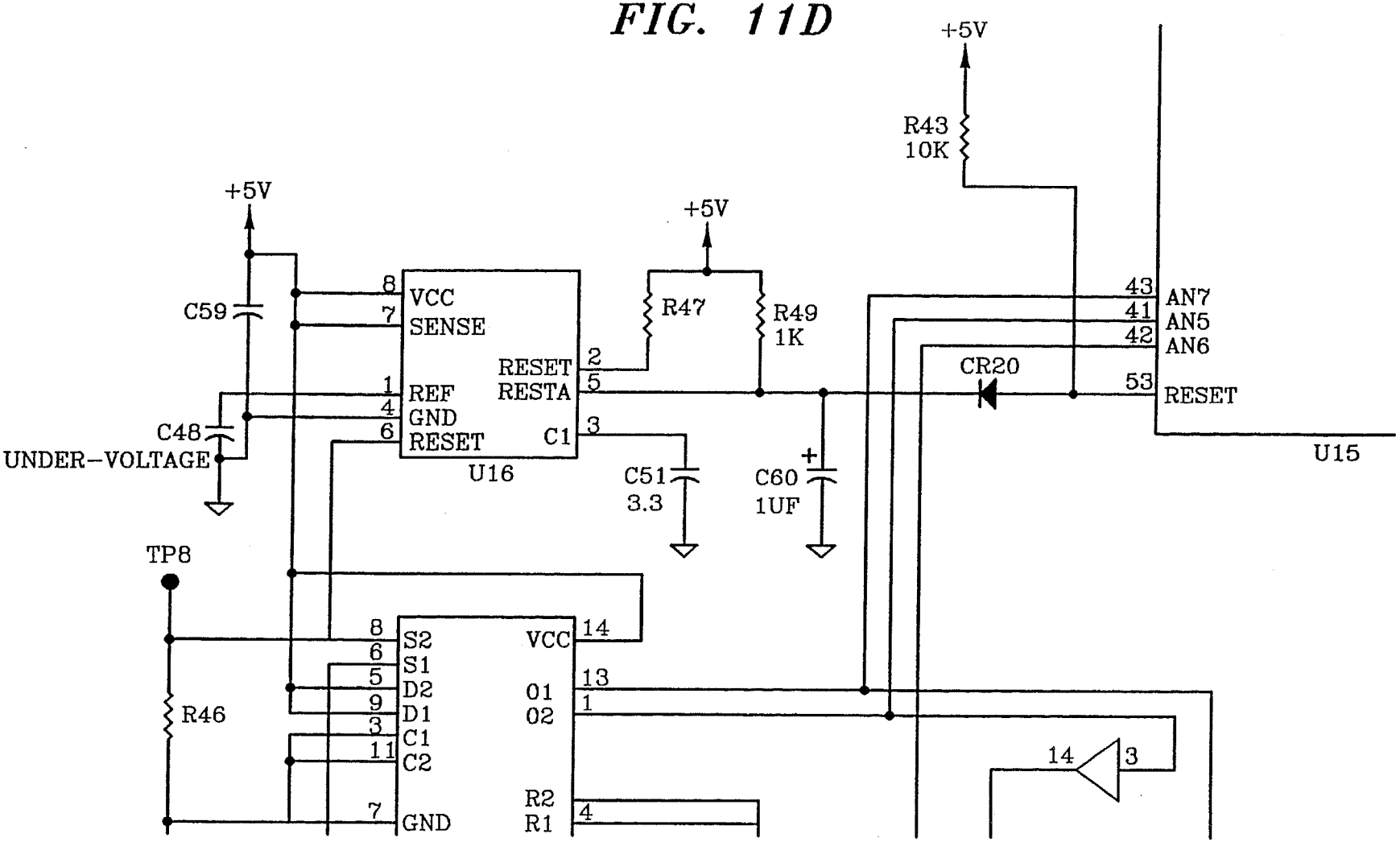
Figure 11E:
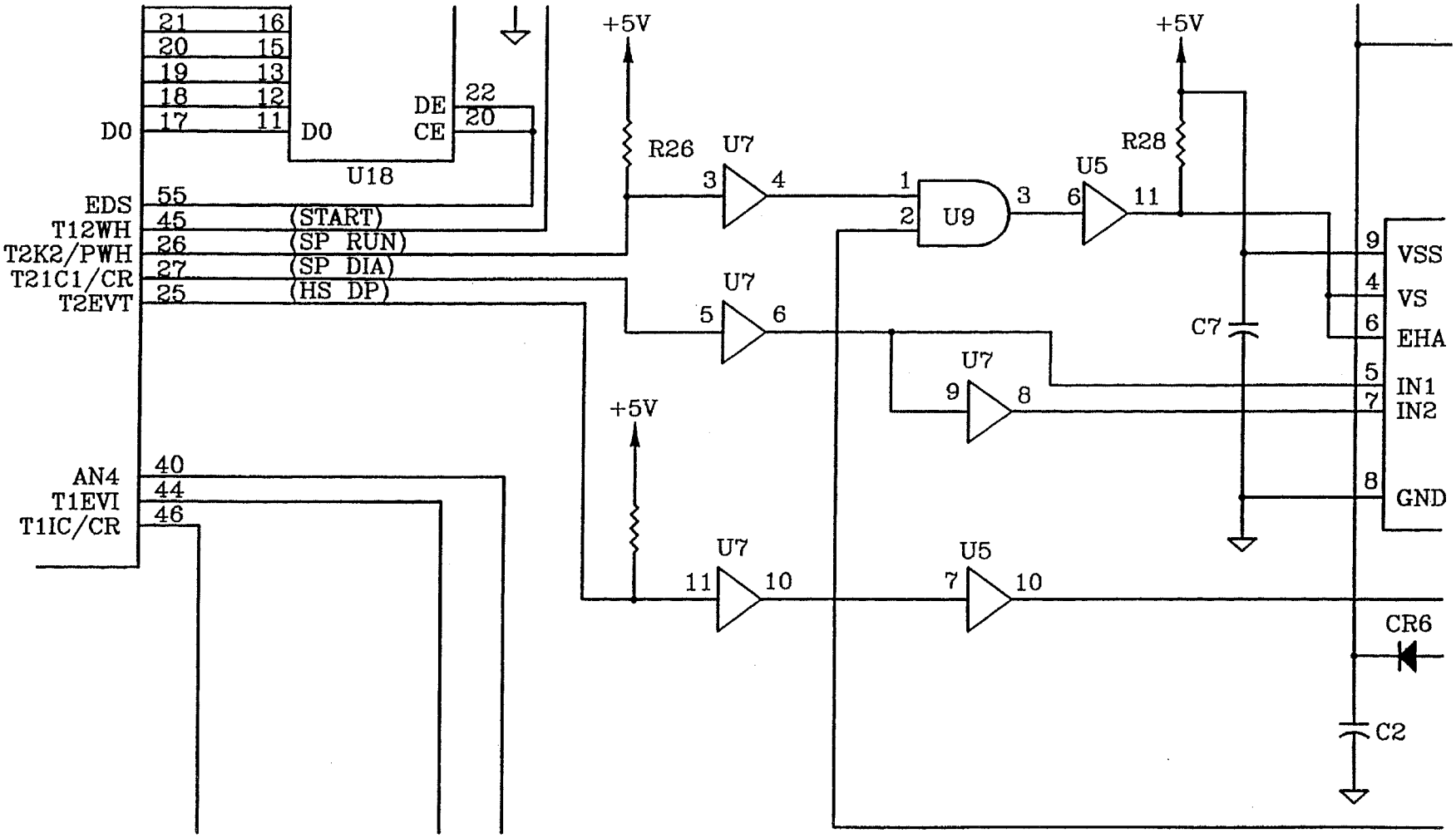
Figure 11F:
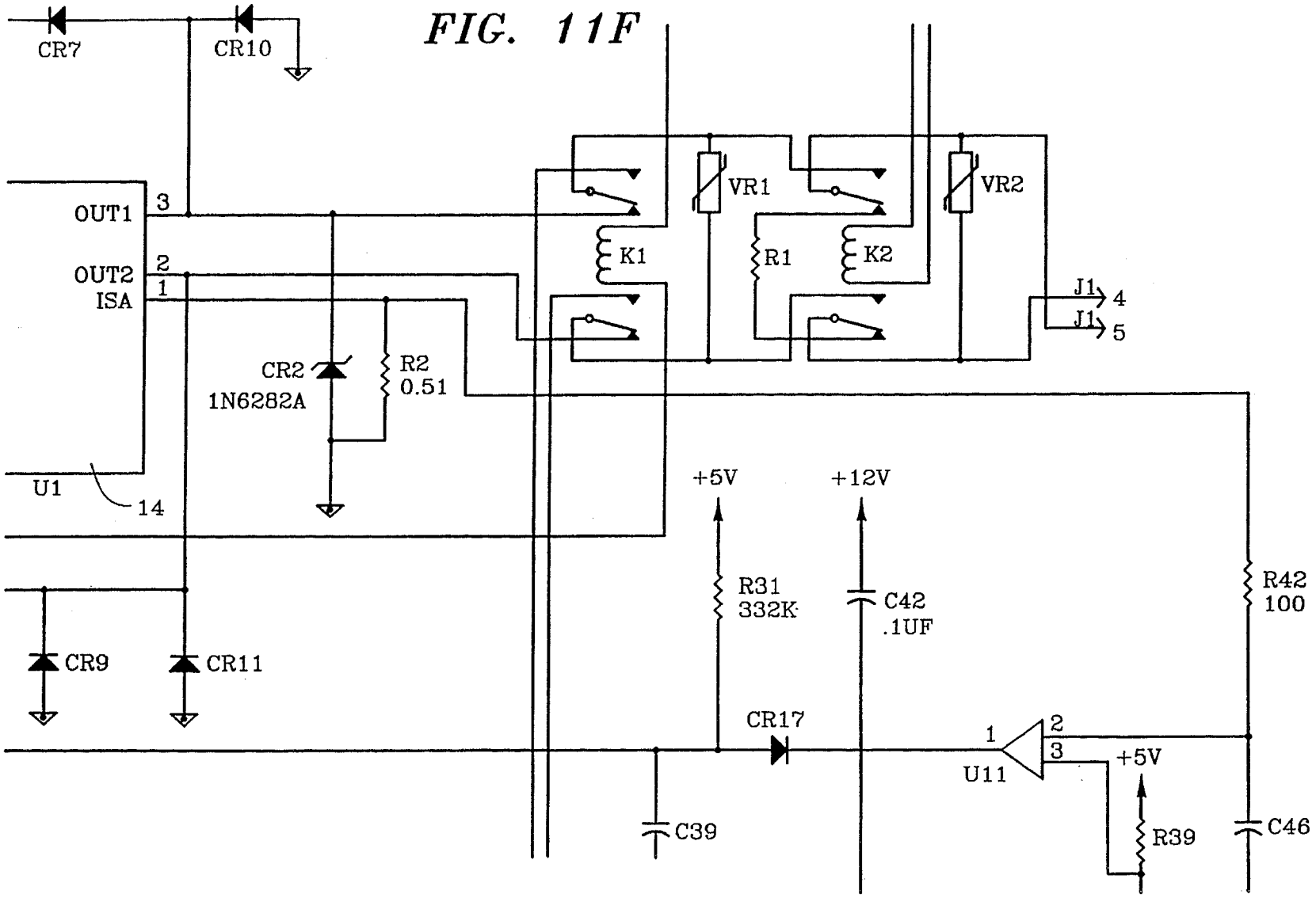
Figure 11G:
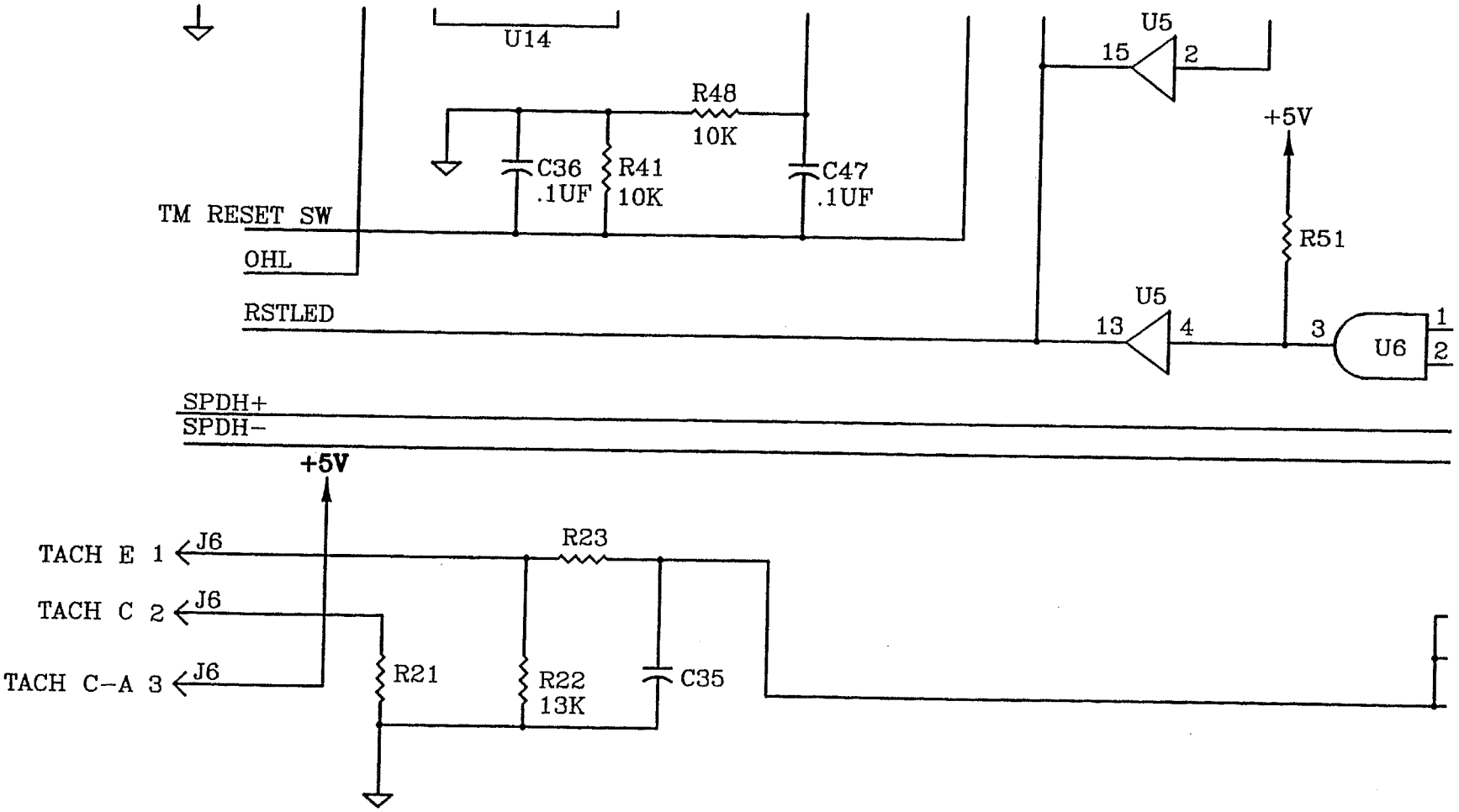
Figure 11H:
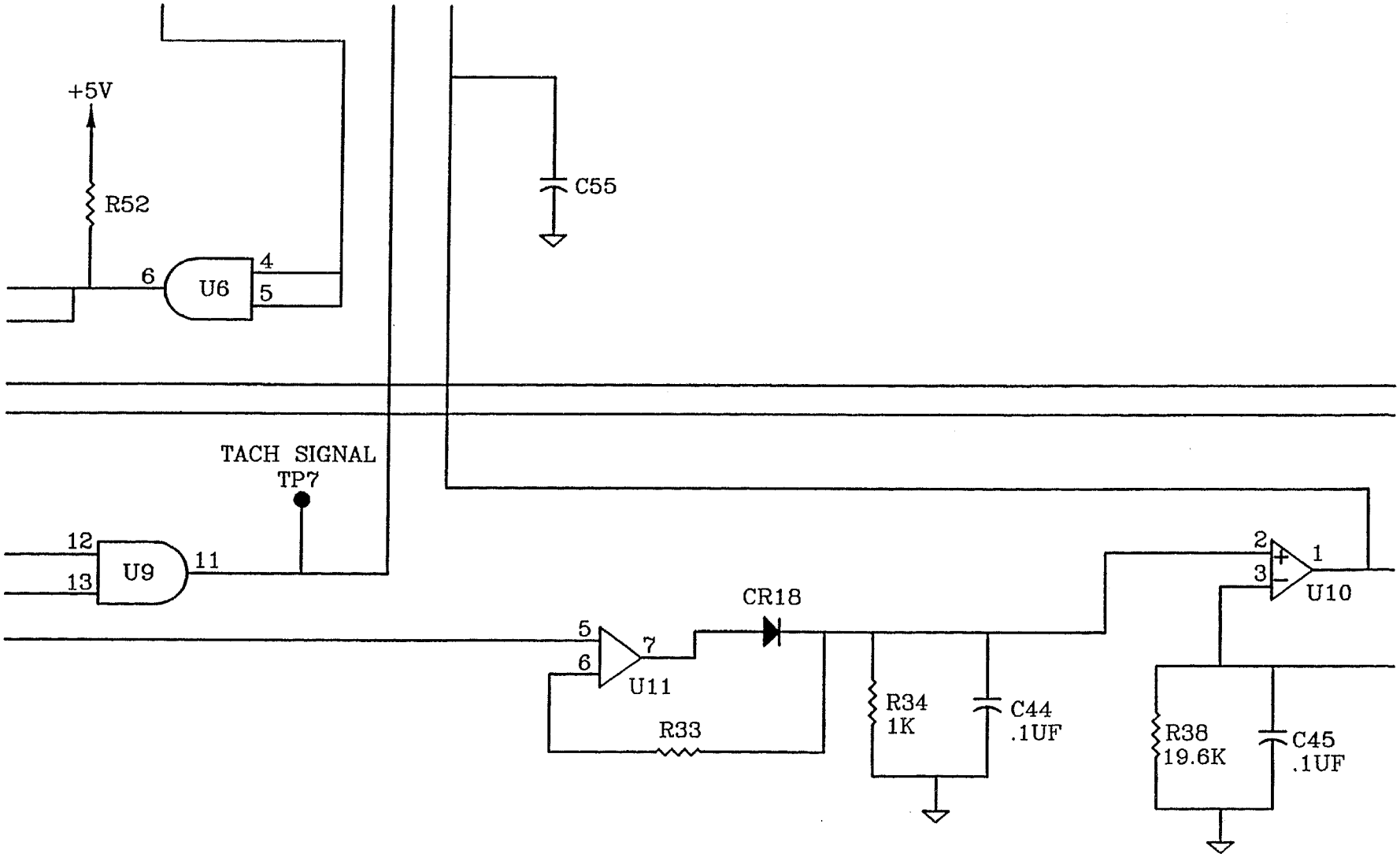
Figure 11I:
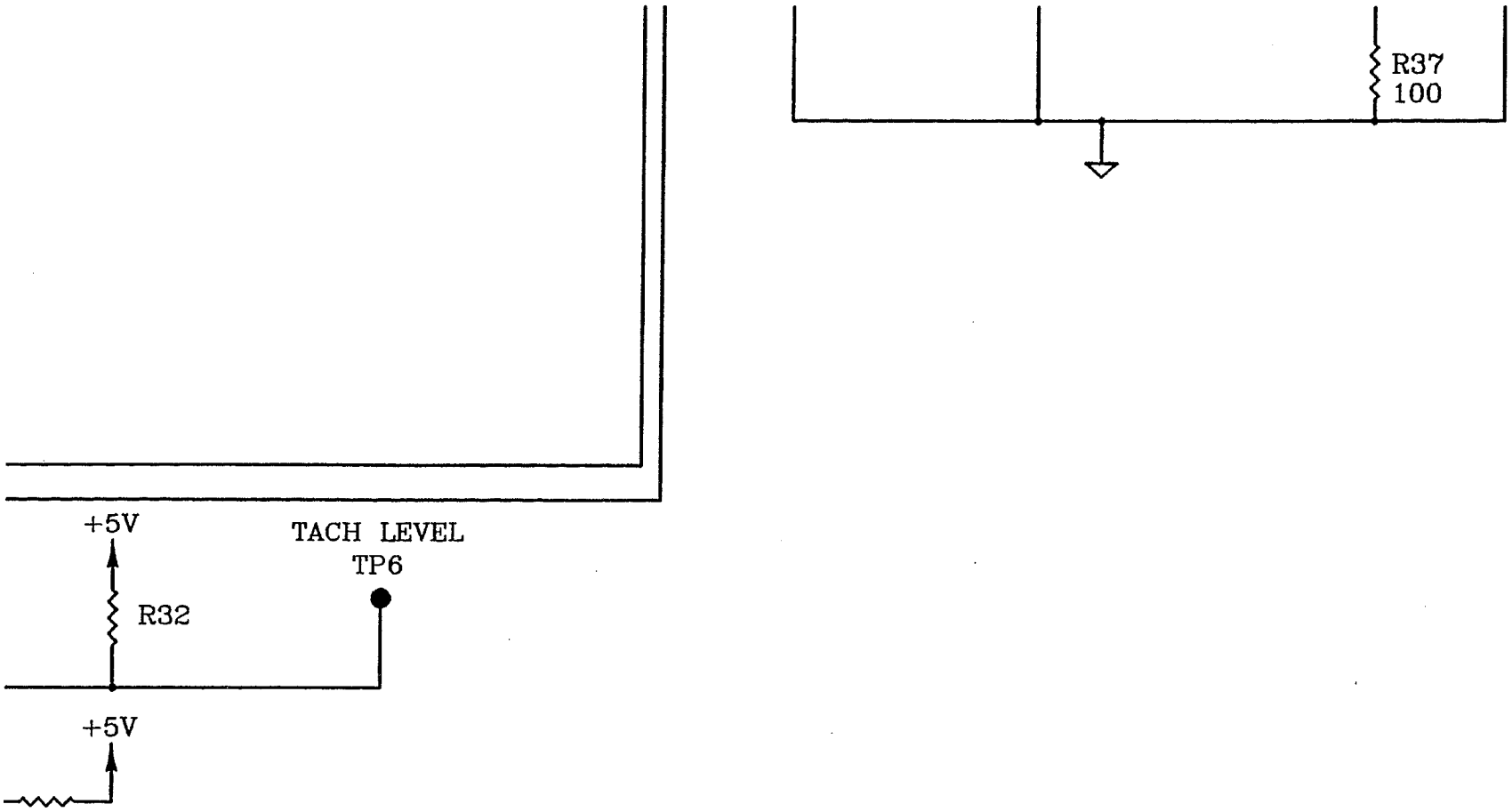
Figure 12A:
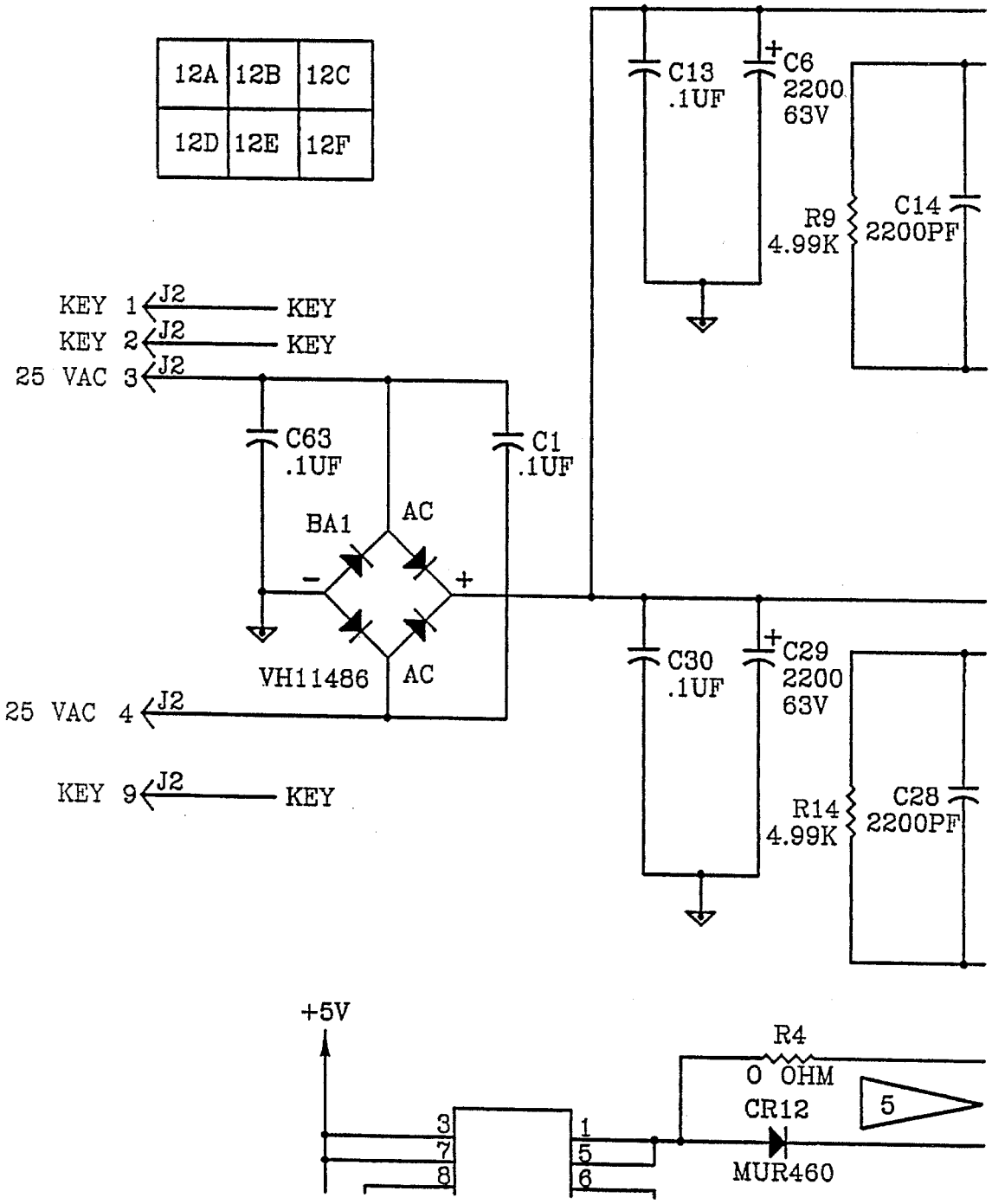
FIGS. 12A through 12F are schematic diagrams of parts of the invention of FIG. 8.
Figure 12B:
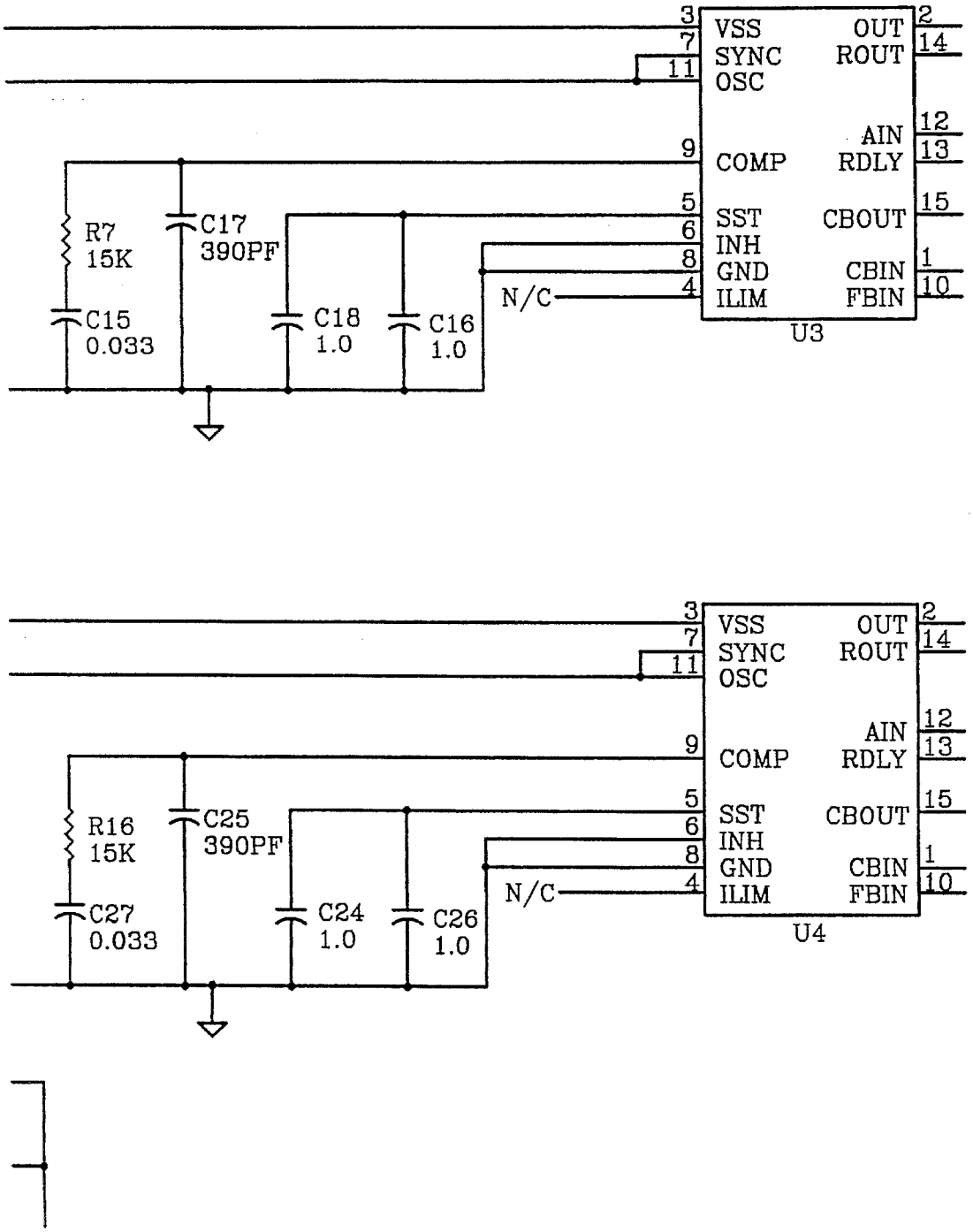
Figure 12C:
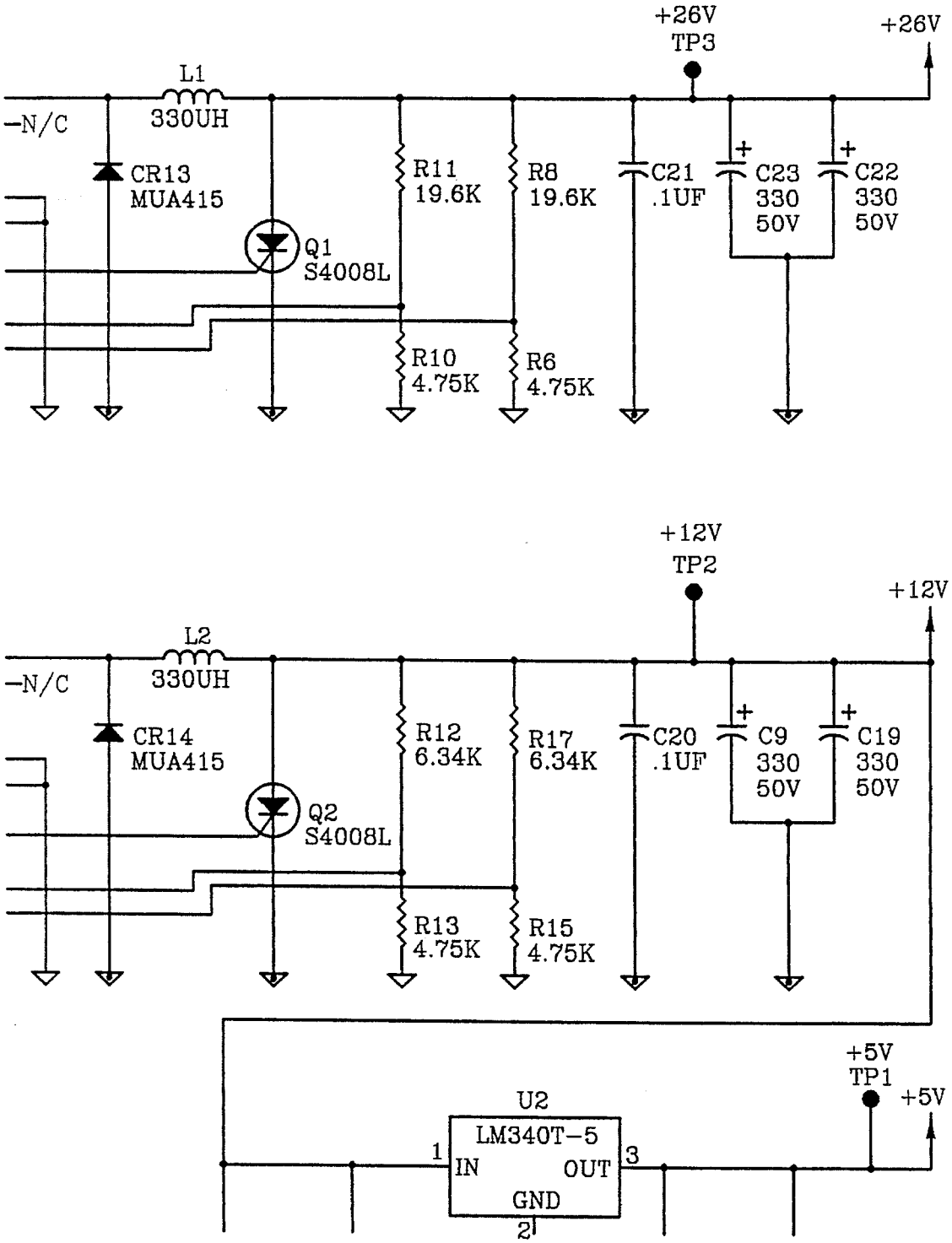
Figure 12D:
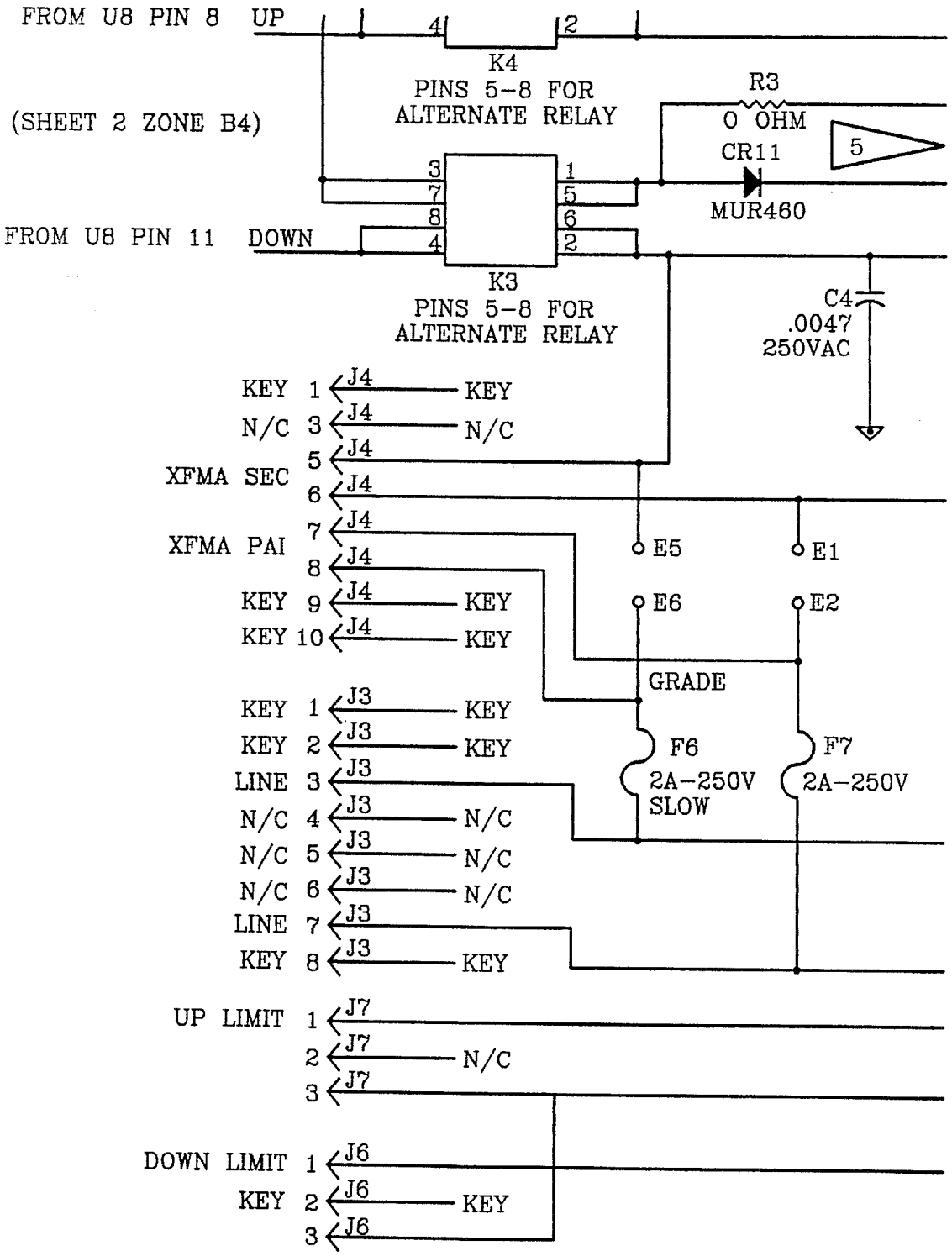
Figure 12E:
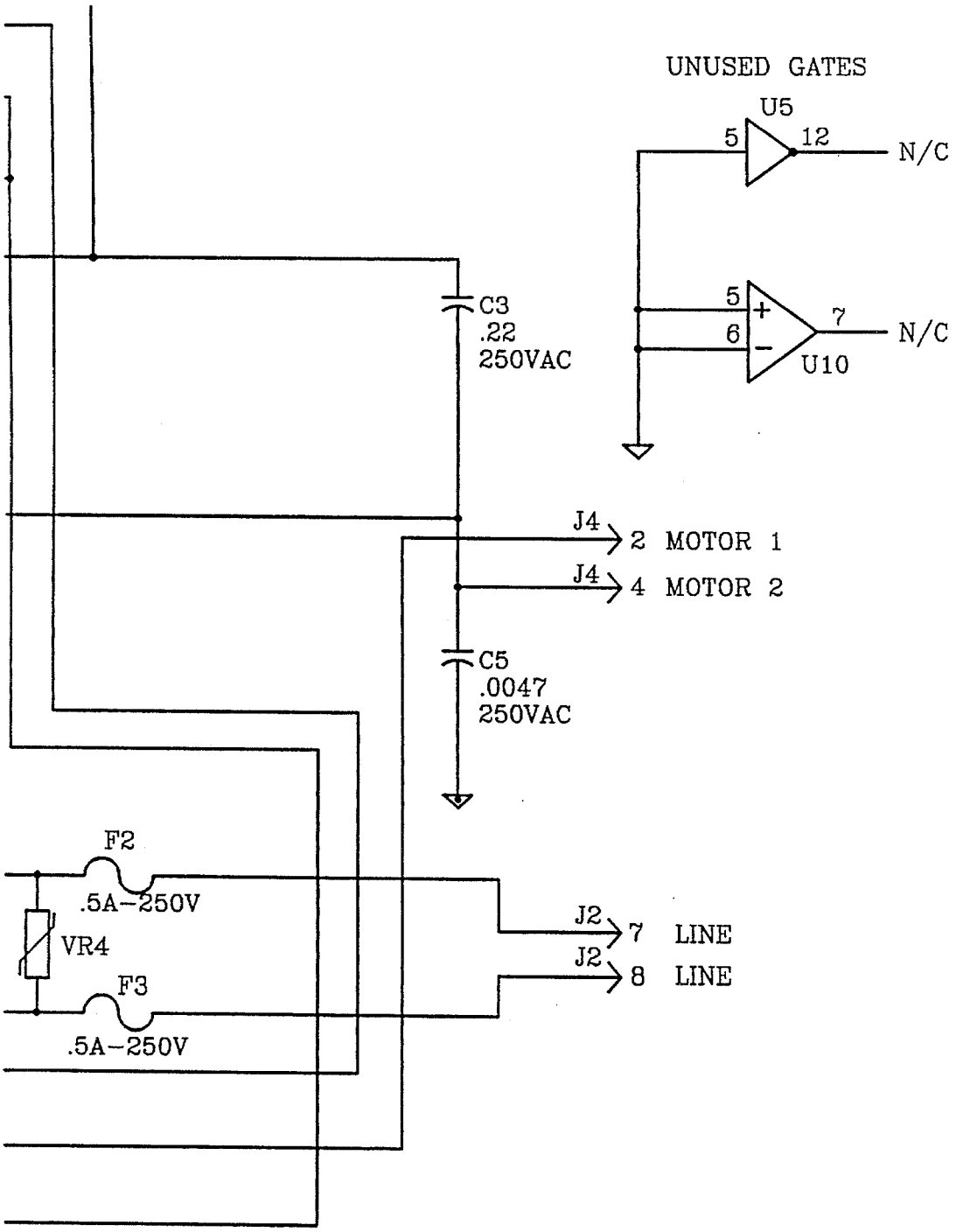
Figure 12F:
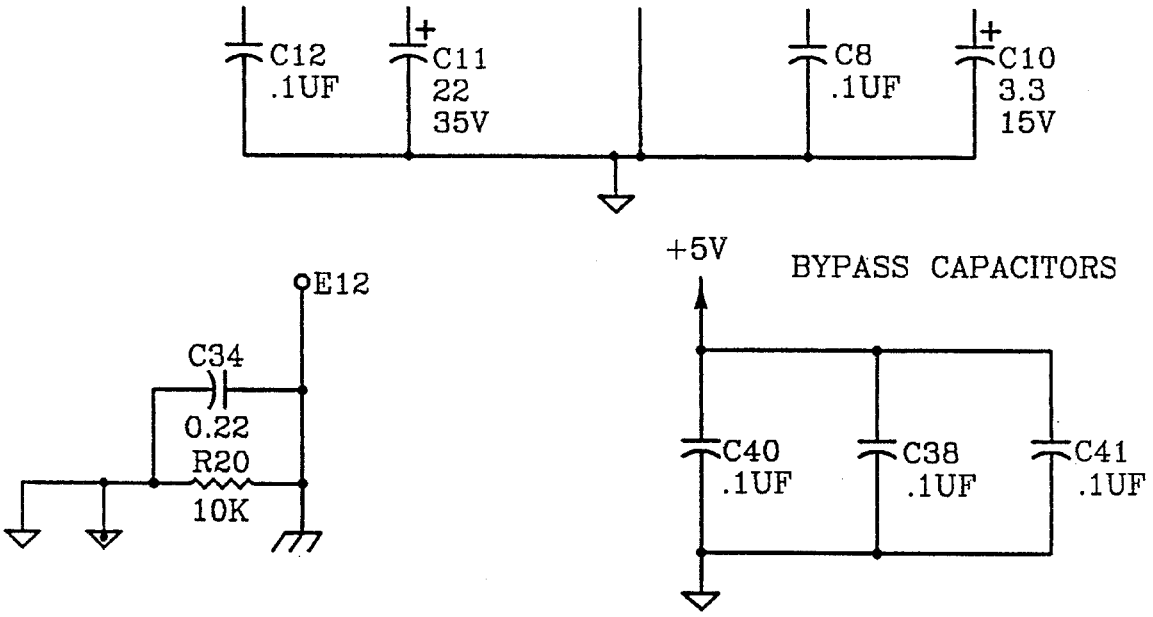
Figure 13A:
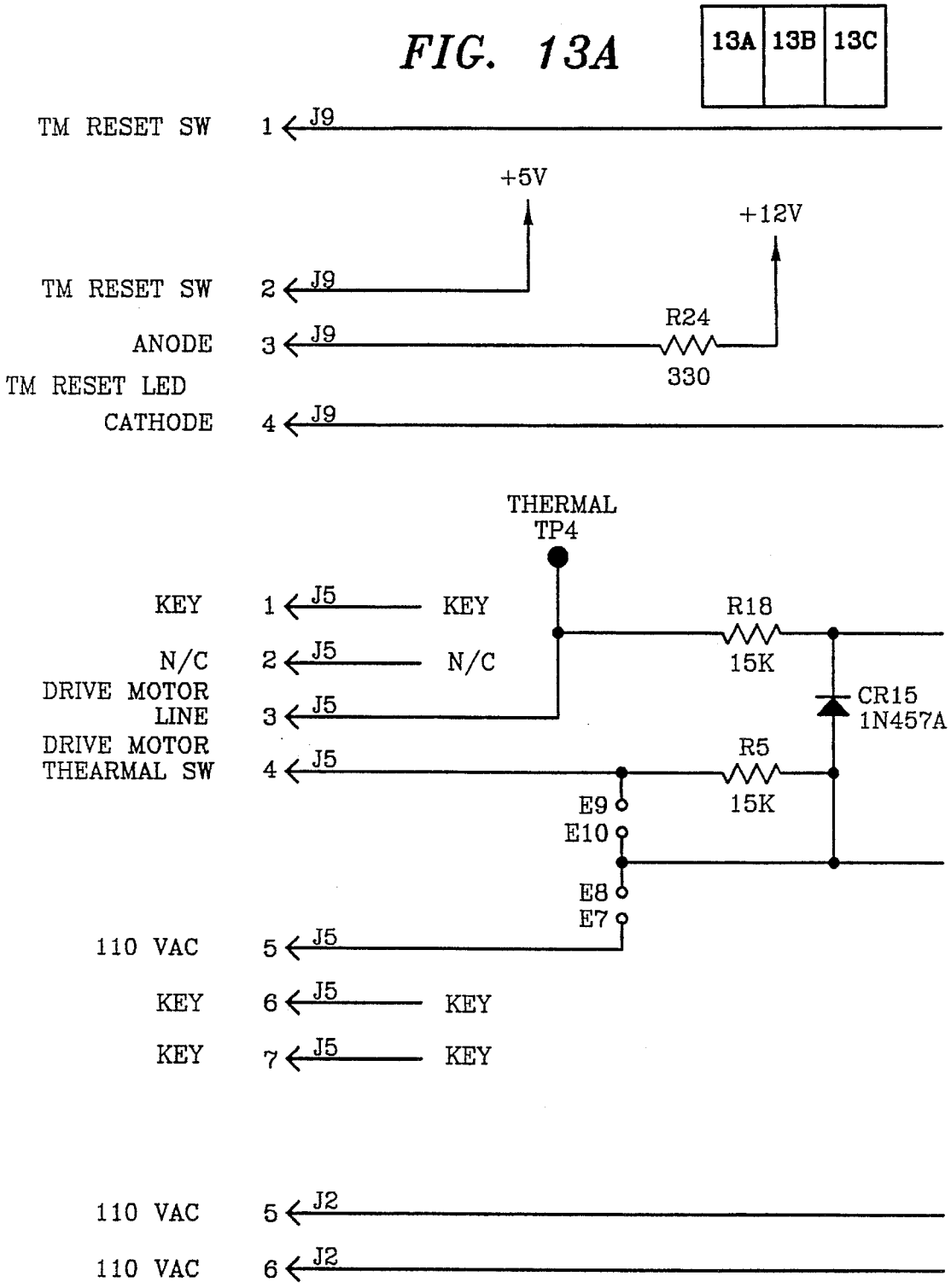
FIGS. 13A through 13C are schematic diagrams of part of the invention of FIG. 8.
Figure 13B:
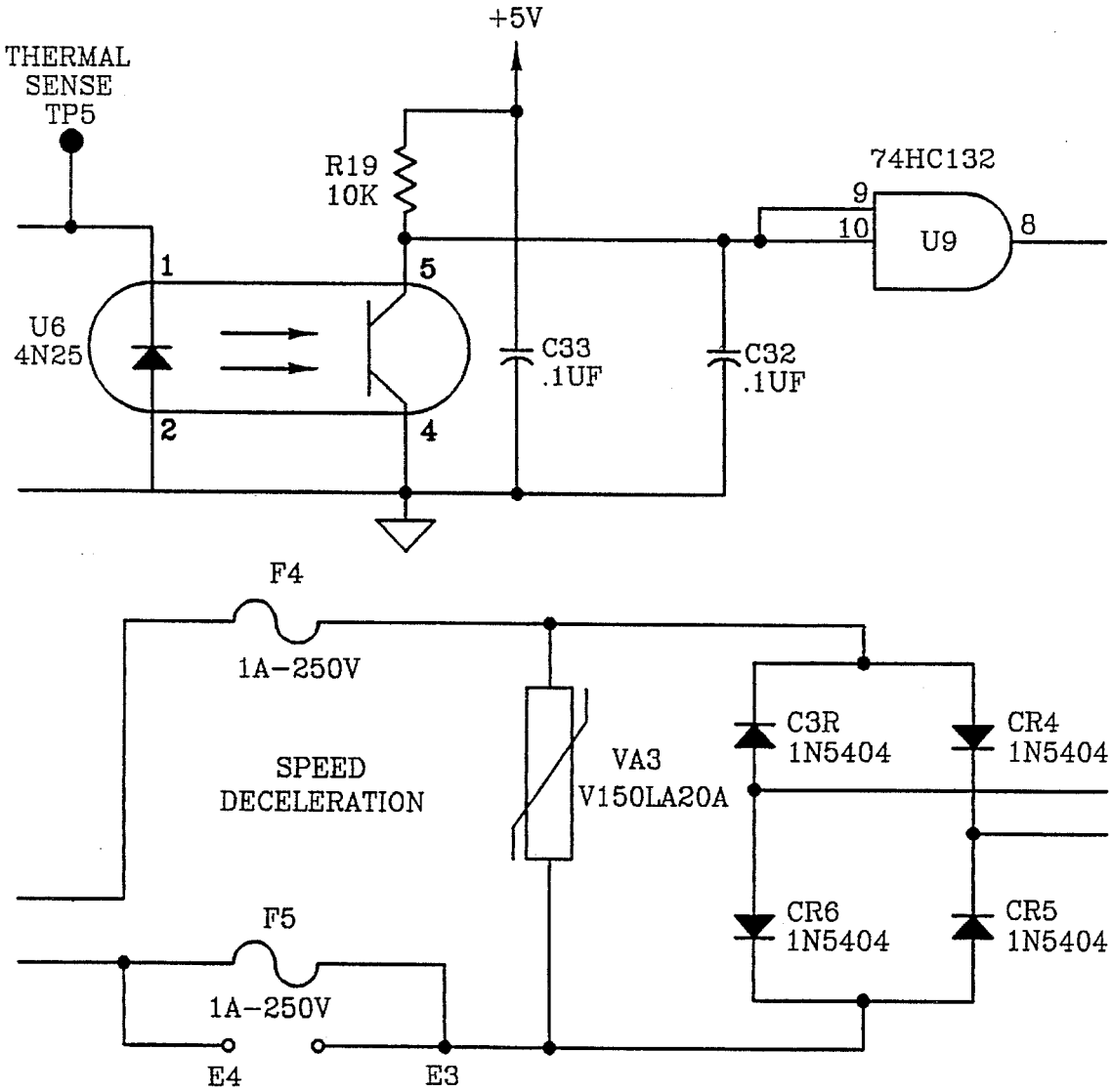
Figure 13C:
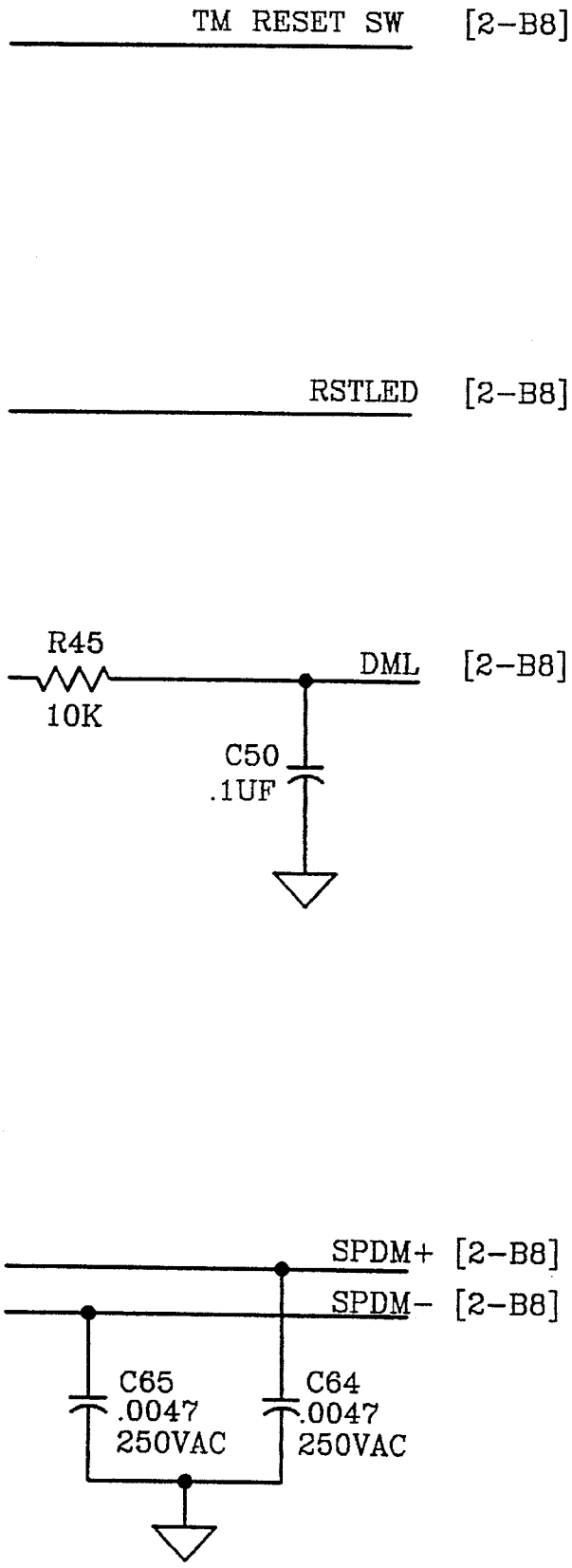

The speed change motor driver 14 is preferably of the "H-bridge" type such as is common in the art. Speed change motor driver 14, when enabled by a control system 20 or 120, sends a voltage to speed change motor 12 causing speed change motor 12 to rotate. The preferred embodiment of speed change motor driver 14 is a H-bridge driver shown in FIG. 5 labelled U3 and in FIG. 11*b* labeled V1. U3 either sends +28 V out on U3-3 to be returned on U3-2 to cause speed change motor 12 to rotate in one direction or it sends +28 V out U3-2 to be returned on U3-3 to cause speed change motor 12 to rotate in the other direction. The direction of rotation of speed change motor 12 causes the treadmill belt to either increase or decrease in speed. The similar situation occures on V1.

In the invention, the control system 20 or 120 "enables" the speed change motor driver 14 cyclically by a series of pulses sent along a "Speed Enable" line connecting the control system 20 and the speed change motor driver 14. The pulses sent along the "Speed Enable" line have a duty cycle determined by the control system 20 as described hereafter. The pulses sent to speed change motor driver 14 along the "Speed Enable" line cause speed change motor driver 14 to be enabled while the logical "high" portion of the pulses are presented at speed change motor driver 14. As a result, the pulses sent to speed change motor driver 14 cause corresponding pulses to be sent to speed change motor 12. These corresponding pulses sent to speed change motor 12 are +28 V pulses in the preferred embodiment of the D.C. speed-change motor controller system.

The duty cycle of the +28 V pulse determines the rate of rotation of speed change motor 12. In essence, the speed change motor 12 "filters" the +28 V pulses to produce an "average" D.C. voltage presented at speed change motor 12 which determines the speed of rotation of the motor. The greater the duty cycle, the greater the "average" voltage at speed change motor 12 and the greater its speed of rotation.

As the duty cycle of the "Speed Enable" signal decreases, which will happen as the treadmill belt speeds up or as the load on speed change motor 12 decreases as will be described hereafter, the "average" voltage supplied to the speed change motor 12 by speed change motor driver 14 decreases. A lower "average" voltage provided to the speed change motor 12 reduces the rate of rotation of speed change motor 12.

Conversely, as the duty cycle of the "Speed Enable" signal increases, which will happen as the treadmill belt slows down or as the load on speed change motor 12 increases, the "average" voltage supplied to the speed change motor 12 increases. A higher "average" voltage provided to the speed change motor 12 increases the rate of rotation of speed change motor 12.

In the embodiment of FIG. 4, a "Speed Increase" line 16 and a "Speed Decrease" line 18 are attached to speed change motor driver 14. Both lines 16 and 18 are connected to a user interface console (not shown) so that a user may activate a switch on the console indicating either a desire to increase to decrease the speed of the treadmill belt. The presence of a "high" voltage on either lines 16 or 18, along with a "high" on the "Speed Enable" line causes speed change motor driver 14 to send +28 V pulses to D.C. speed change motor 12. As will be explained hereafter, the voltage on either of the "Speed Enable" lines will be a series of square wave pulses of varying duty cycles. The duty cycle of the voltage pulses sent to D.C. speed change motor 12 by speed change motor driver 14 corresponds to the duty cycle of voltage pulses sent to speed change motor driver 14 from the control system 20 or 120 along the "Speed Enable" line.

Whether the +28 V pulses are sent out from U3 to speed change motor 12 to increase or decrease its speed depends on the voltage presented on "Speed Increase" or "Speed Decrease" lines 16, 18 respectively in response to a user command at the console. A logical "high" voltage sent along "Speed Increase" line 16 to the speed change motor driver 14 causes the speed of the treadmill belt to increase. Conversely, a logical "high" voltage sent along "Speed Decrease" line 18 to speed change motor driver 14 causes the speed of the treadmill belt to decrease. When no speed change is desired, a logical "low" voltage is indicated on both lines 16 and 18.

In both embodiments, U3 and V1 is a L298 "H-bridge" driver which is a +5 V logic device. Because U3 is a +5 V logic device and because the console, in the preferred embodiment of the D.C. speed-change motor controller system, sends "Speed Increase" and "Speed Decrease" commands at +23 V, these +23 V signals are level shifted at inverters U7 and U6, shown in FIG. 5A, to the appropriate +5 V level for U3. Resistors R40 and R44 with U7 invert the "Speed Increase" and "Speed Decrease" commands and shifts the logic levels to 0 V and +12 V. U6 then inverts these inverted signals so that the output of U6 at U6-10 and U6-11 logically corresponds to the inputs at U7-5 and U7-3 respectively, but now are +5 V logical signals. U6 is an open-collector device, so that U6-10 and U6-11 are open collectors. R20 and R22 pull the outputs U6-10 and U6-11 to a "high" of +5 V. A "high" at U6-6, which results from a "low" at U7-3, causes U6-11 to drive "low" dropping the 5 volts across R22. This produces a "low" output signal to be presented at U3 indicating that the "Speed Increase" line 16 has not been activated.

Likewise, a "low" at U6-6 causes a "high" at U6-11. Because the output at U6-11 is "high", no current flows through R22 so that a "high" signal is presented to U3 indicating that the "Speed Increase" line has been activated. In this case, if the "Speed Enable" line is also active, U3 will send a series of +28 V pulses to speed motor 12 causing it to rotate so that the transmission configuration will change to increase the speed of the treadmill belt.

A similar situation is presented with the "Speed Decrease" line 18 and U7 and U6 in conjunction with the input to U7-5 and the output of U6 at U6-10 with R20 holding U6-10 "high".

No output is allowed from U3 to speed change motor 12 when "Speed Enable" is a logical "low". Therefore, when either "Speed Increase" or "Speed Decrease" lines 16,18 are logically "high" and "Speed Enable" is "high", the output from U3 to speed change motor 12 is a series of +28 V pulses. Regardless of whether "Speed Increase" or "Speed Decrease" lines 16, 18 are logically "high", if "Speed Enable" is "low", no output is sent from speed change motor driver 14 to speed change motor 12. Internal logic in U3 inhibits any output from U3 to speed change motor 12 when both lines 16,18 are logically "high". Also, if both "Speed Increase" or "Speed Decrease" lines 16, 18 are logically "low", regardless of whether "Speed Enable" is "low" or "high", no output is sent from speed change motor driver 14 to speed change motor 12.

The modulation or the variation of the duty cycle of the +28 V pulses is the function performed by pulse width modulator 40. The variation of the pulse width allows the rotational velocity of speed change motor 12 to be properly controlled.

The pulse width modulator 40 determines the duty cycle of the voltage pulse to be sent to speed change motor driver 14 in response to both the load incurred by speed change motor 12 and the current speed of the treadmill belt which is dependent on the current configuration of the transmission 1. Pulse width modulator 40 takes a frequency of constant duty cycle and modulates it according to whether the duty cycle should be increased or decreased in response to both the load incurred by speed change motor 12 and the current speed of the treadmill belt.

A frequency generator 38 is connected to pulse width modulator 40. Frequency generator 38 provides a signal of a fixed frequency to pulse width modulator 40 which will be modulated to provide the voltage pulses sent to speed change motor driver 14. The preferred embodiment of frequency generator 38 is shown in FIG. 5. Frequency generator 38 provides a ramp signal to pulse width modulator 40 having a frequency of about 6 kHz. The ramp signal is created by allowing a capacitor to comparatively slowly charge exponentially through a resistor of comparatively high resistance until a preset voltage is reached. When the preset voltage is reached, the capacitor is rapidly discharged through a resistor of comparatively low resistance whereafter the capacitor is allowed to slowly exponentially charge through the resistor of high resistance again. This slow charging of the capacitor followed by its rapid discharge is sequentially repeated to produce a frequency of about 6 kHz.

In the embodiment of FIG. 4, the RC circuit with the comparatively large resistance exponentially charges to approximately +10 volts in approximately 160 μs. The rapid discharge of the-RC circuit with the comparatively low resistance drops the voltage to ∓volts in approximately 2 μs. Thereafter, the RC circuit with the comparatively large resistance is again exponentially charged back to about 10 volts in the approximately 160 μs time followed by the discharge of the RC circuit to about 3 volts in 2 μs. The resulting cycle has a period of about 162 μs which results in frequency of about 6 kHz. The 6 kHz signal output of frequency generator 38 is shown in FIG. 6.

In the preferred embodiment of frequency generator 38, shown in FIG. 5, inputs U8-6 and U8-7 will always have a voltage present less than +12 V. When the output U6-1 is "high", +12 V, both diode CR23 and CR28 are reversed-biased since the voltages at U6-6 and U6-7 are always less than +12 V. At this time, U6-7 is approximately +10 V. Capacitor C19 charges exponentially through resistor R32 and R33 until U6-6 is at the same voltage as U6-7. When that voltage is reached, U6-1 goes "low" causing the voltage at U6-7 to change to approximately ∓V. This causes capacitor C19 to discharge through CR23 and R36 until the voltage at U6-6 equals the voltage at U6-7. At this time, U6-1 goes "high" and the cycle is repeated.

R32 and R33 charge C19 in approximately 160 μs while R36 discharges C19 in approximately 2 μs. The result is a waveform at U6-6, shown in FIG. 6, which exponentially increases from ∓V to +10 V in approximately 160 μs and then falls back to ∓V in 2 μs. This results in a waveform signal at U6-6 with a frequency of about 6 kHz. The voltage at U6-6 is the output of frequency generator 38.

The "average" voltage applied to speed change motor 12 from speed change motor driver 14 is varied by using pulse width modulation, supplied by pulse width modulator 40, on the output signal of frequency generator 38. Because the frequency of the modulated signal is about 6 kHz, the frequency of the pulse width modulated voltage pulses sent to speed change motor 12 by speed change motor driver 14 will also be about 6 kHz. The output signal from frequency generator 38 is presented to pulse width modulator 40 at U8-9.

Pulse width modulator 40 creates a "representative" voltage which is representative of both the current speed of the treadmill and the load placed on the D.C. speed change motor 12. The determination of the "representative" voltage will be described hereafter. The "representative" voltage is shown in FIG. 7A superimposed on the ramp signal output from the frequency generator 38. Pulse width modulator 40 compares this "representative" voltage to the voltage of the signal from the frequency generator 38. As long as the "representative" voltage is smaller than the voltage from frequency generator 38, a logical "high" is generated and presented to a line labeled "Speed Enable". The "Speed Enable" line connects the control system 20 with the speed change motor driver 14. This "Speed Enable" signal is shown in FIG. 7B aligned in time in with the "representative" signal and the output of frequency generator 38, in FIG. 7A. However, if the "representative" voltage goes higher than the voltage from the signal from frequency generator 38, a logical "low" "Speed Enable" signal is generated.

As can be seen by reference to FIGS. 7A and 7B, if the voltage of the "representative" signal is below the voltage of the output of the frequency generator 38, the "Speed Enable" signal will always be "high" resulting in a 100% duty cycle. However, as the "representative" signal voltage increases, it will spend a larger and larger percentage of each cycle of the frequency generator signal at a voltage above the voltage of the frequency generator signal. This will produce a "Speed Enable" signal with a smaller and smaller duty cycle.

In the embodiment of FIG. 4, the output from frequency generator 38 always varies from ∓V to +10 V in a cyclical manner and is presented to pulse width modulator 40 at input U8-9. The "representative" signal is created within pulse width modulator 40 by comparing the "Speed Feedback" signal from the tachometer frequency to voltage converter 22 to the output of torque requirement module 31 at comparator U12. The "Speed Feedback" signal is presented to comparator U12 at input U12-3 while the output of torque requirement module 31 is presented to comparator U12 at input U12-2 through resistor R60. Both the "Speed Feedback" signal and the output of torque requirement module 31 will be described in detail hereafter.

As stated above, when the treadmill belt operates at a slower speed, the rate of change of the treadmill belt speed for a constant rate of change of the transmission configurations is lower thereby requiring the speed change motor 12 to rotate more rapidly to provide a constant rate of speed change for the treadmill belt while it is operating at this slow speed. Conversely, when the treadmill belt operates at a higher speed, the rate of change of the treadmill belt speed for a constant rate of change of the transmission configurations is higher thereby requiring the speed change motor 12 to rotate more slowly to provide a constant rate of speed change for the treadmill belt while it is operating at this high speed.

In both embodiments, the speed of the treadmill belt is determined by means of a optical tachometer (not shown) placed on the output shaft 9 of the transmission 1. The optical tachometer, as is common for such tachometers, preferably produces a square wave output with a nearly 50% duty cycle-with a frequency proportional to the speed of rotation of the output shaft 9. In a typical optical tachometer, the output of the optical tachometer is a square wave having a "low" of 0 volts and a "high" of +12 volts. As the speed of the treadmill increases or decreases, the frequency of the square wave output of the optical tachometer increases or decreases, respectively. The output of the optical tachometer is provided to the tachometer frequency to voltage converter 22 in the embodiment of FIG. 4 and the microprocessor in the embodiment of FIG. 8.

The tachometer frequency to voltage converter 22 comprises, in series, a frequency doubler 24, a frequency to voltage filter 26 and a scale and gain module 28. The square wave output from the optical tachometer is provided to the input of the frequency doubler 24. As the name implies, frequency doubler 24 doubles the frequency of the square wave output of the optical tachometer in order to more easily subsequently filter the signal at the frequency to voltage filter 26. This higher frequency allows frequency to voltage filter 26 to be a smaller, faster filter than would be required if the original frequency were used. In the preferred embodiment, the frequency doubler 14 circuitry shown in dotted outline in FIG. 5 provides a negative-going pulse from a steady state logical "high" voltage having a duration of approximately 300 μs on each rising or falling edge of the square wave signal from the optical tachometer. Because each cycle of square wave has both a rising and a falling edge, and because the square wave from the optical tachometer has a roughly 50% duty cycle, the signal output from the frequency doubler 24 will have a frequency of twice that of the optical tachometer. The output of frequency doubler 14 is a signal whose average D.C. voltage is inversely proportional to the treadmill speed.

In the embodiment of FIG. 4, the output of the frequency doubler 24 is a signal ordinarily at +12 volts which goes to 0 volts and remains there for the 300 μs duration upon the detection of either the rising or falling edge of the square wave output from the optical tachometer. The output signal from the optical tachometer is presented to the frequency doubler 24 at J7-1. Resistor R124, signal diode CR58, capacitor C64 and comparator U22 combine to invert the optical tachometer signal and provide sharp rise and fall times for the signal. This is done by first filtering out high-frequency noise from the signal by passing the signal through an RC circuit comprising resistor R124 and capacitor C64. The RC filtered signal is presented to comparator U22 at input U22-8. This signal is compared to the voltage at input U22-9 which is approximately ⅔ the peak tachometer output voltage. R105, CR53, R104 and C56 combine to "hold" the peak tachometer output voltage at input U19-3. U19 buffers this voltage and passes it out at output U19-1. This buffered voltage is passed through resistors R102 and R103 so that the voltage presented at U22-9 is ⅔ the voltage output from U19-1. Zener diode CR52 ensures that the reference voltage at U22-9 never drops below +2 V. When the voltage at U22-9 is higher than the voltage at U22-8, the output at U22-14 will be a logical "high". When the voltage at U22-8 goes higher than the voltage at U22-9, the output at U22-14 goes to a logical "low". This inverts the square wave signal input from the optical tachometer at J7.

The output of comparator U22-14 is an inverted signal of the same frequency as the optical tachometer frequency but with a sharp rise and fall time. The output of comparator U22-14 is coupled through a differentiator comprising capacitor C70 and resistor R143 to input U22-6. This differentiator detects the rising edge of the signal output at U22-14. When the output of U22-14 is a rising edge, a +12 V signal is presented by the differentiator at U22-6. The unwanted negative spike created by this differentiator on the trailing edge is removed by diode CR56.

Input U22-7 is held at +6 V by the resistor network of R140 and R141 tied to +12 V. When the voltage at U22-6 is higher than the voltage at U22-7, the output at U22-1 will be a logical "low". This "low" remains until C70 is discharged below the +6 V bias of U22-7 by discharging C70 through R143. The time that is required to discharge C70 from the +12 V to +6 V is about 300 μs.

The output of comparator U22-14 is also coupled to U22-5 through a differentiator comprising capacitor C69 and resistor R142 to U22-5. This differentiator detects the falling edge of the signal output at U22-14. When the output of U22-14 is a falling edge, a 0 volt signal is presented at U22-5. The unwanted spike created by this differentiator on the rising edge of the signal from U22-14 is removed by diode CR55.

Input U22-4 is also held at +6 V by the resistor network R140 and R141 tied to +12 V. When the input at U22-5 is at 0 volts, because input U22-4 is at +6 V, the output of the comparator U22-2 goes "low". This "low" remains until C69 is charged above the +6 V bias of U22-4 by the RC network of C69 and R142. The time required to charge C69 from 0 V to +6 V is also about 300 μs.

Because U22 is an open-collector device, it cannot drive "high". Therefore, the outputs of U22-1 and U22-2 are pulled "high" by resistors R149 and R150 which are tied to +12 V. The resulting output of comparators U22-1 and U22-2 are tied together to produce a series of negative-going 300 μs pulses with a frequency of twice that of the optical tachometer signal.

The output of frequency doubler 24 is passed to frequency to voltage filter 26. In the preferred embodiment shown in FIGS. 5A and 5J, the output of frequency doubler 24 is presented to frequency to voltage filter 26 at TP9.

The frequency to voltage filter 26 is a filter which "smoothes out" the square wave signal output from frequency doubler 24 to produce a continuous D.C. voltage which is inversely proportional to the treadmill belt speed. In the preferred embodiment of the D.C. speed-change motor controller system, the frequency voltage filter 26 is a two pole filter as is common for such purposes.

The preferred embodiment of frequency to voltage filter 26 is shown in dotted outline in FIG. 5. Frequency to voltage filter 26 is preferably a two pole filter comprised of R91, C52, R90, and C51. The output of this two pole filter is presented to op-amp U18 at input U18-3. Op-amp U18 is a unity-gain buffer which is necessary due to the high impedance of the two pole filter. The output of the unity-gain filter U18 is at output U18-1. This output is a D.C. voltage which is inversely proportional to the treadmill belt speed.

The output voltage from the frequency voltage to filter 26, in the preferred embodiment, is determined according to the following formula:

$$\text{frequency voltage to filter output voltage} = 12 \text{ volts} - 0.5 \text{ (speed of treadmill belt in MPH) volts} \quad (6)$$

For example, when the treadmill is operating at 6 MPH, the output voltage from the frequency voltage to filter 26 would be: 12–0.5 (6)=12–3=9 V. The output from frequency voltage to filter 26 is passed to the scale and gain module 28.

The scale and gain module 28 adjusts the voltage signal from frequency to voltage filter 26 to correspond to the performance type of the treadmill. For example, at 6 MPH, a 0.6 to 6 MPH type treadmill is operating at its maximum speed so that its transmission is at its highest speed setting. However, at the same 6 MPH speed on a 1.2 to 12 MPH type treadmill, the treadmill is operating at about ½ its top speed so that its transmission configuration is only at about half its highest speed setting. Scale and gain module 28 allows the output signal from the tachometer frequency to voltage converter 22 to be representative of the current speed of the treadmill relative to the performance type of the treadmill.

In the case of the 0.6 to 6 MPH type treadmill, the voltage output from the frequency voltage to filter 26 according to equation (6) above would have a voltage range from +12 V to +9 V as the treadmill moves from the belt stopped position to the maximum speed of 6 MPH. By contrast, in the 1.2 to 12 MPH type treadmill, the voltage swing would be from +12 V to +6 V as the treadmill goes from the belt stopped position to the top speed of 12 MPH. The scale and gain module 28 scales the output voltage from frequency voltage to filter 26 so that the voltage representing the maximum speed for any type treadmill will be a voltage of +10 V. Of course, the voltage from frequency voltage to filter 26 at the belt stop position will always be +12 V regardless of the type of treadmill.

In the embodiment of FIG. 4, the output of frequency to voltage filter 26 is presented to scale and gain module 28 at the variable resistor R117 which is tied to +12 V. R117 is manually adjusted so that when the treadmill belt is operating at its maximum speed, the voltage presented to resistor R89 is +10 V. When the treadmill belt is stopped, the voltage at U18-1 is a +12 V "high" so the voltage presented to resistor R89 is +12 volts. Because of the feedback loop from U18-7 to U18-6, U18 in scale and gain module 28 inverts the signal output from the frequency to voltage filter 26 at U18-1 and gives it a gain so that the output at U18-7 is a signal which is directly proportional to the speed of the treadmill belt and varies from approximately +5 V to +10 V as the treadmill goes from 0 MPH to its maximum rate of speed. The signal output from U18-7 is the output of scale and gain module 28, This output signal is labeled "Speed Feedback" and is presented to the pulse width modulator 40.

As the voltage from the output of the tachometer frequency to voltage convertor 22 increases, indicating that the treadmill is operating at a higher speed, the voltage of the "representative" signal increases thereby decreasing the duty cycle of the "Speed Enable" signal. Because the duty cycle of the "Speed Enable" signal is decreased, the "average" voltage presented to speed change motor 12 will decrease resulting in a lower rate of rotation of speed change motor 12. This causes a slower change in the speed change of the treadmill belt due to the change in configuration of the transmission 1 caused by the rotation of speed change motor 12 than if the speed change motor 12 were turning more rapidly.

Conversely, if the voltage output from the tachometer frequency to voltage converter 22 decreases, the voltage of the "representative" signal will also decrease causing a corresponding increase in the duty cycle of the "Speed Enable" signal. An increase in the duty cycle of the "Speed Enable" signal will cause the "average" voltage presented to speed change motor 12 thereby causing it to turn faster. The more rapid turning of speed change motor 12 causes the transmission 1 to change its internal configurations faster so that the rate of speed change of the treadmill belt increases. Of course, the lower voltage output from the tachometer frequency and voltage convertor 22 is indicative of the fact that the treadmill belt is moving at a slower speed.

As stated, the control system 20 responds to both the speed of the treadmill through the operation of the tachometer frequency to voltage converter 22 and also to the current drawn by speed change motor 12 as the load on speed change motor 12 varies. An ideal D.C. motor draws current in proportion to its load and has a rotational velocity (RPM) proportional to the voltage applied to it. This ideal D.C. motor neglects the affect of energy losses primarily through resistance in the motor windings. This resistance can be represented by modeling the ideal motor as a motor winding in series with a resistor to more accurately describe the "real-life" motor. Thus, by an application of Ohm's Law, when a voltage is applied across the resistance in the "real-life" motor, a portion of the voltage is "dropped" across the resistor; the magnitude of the voltage drop depending on the current passing through the resistor.

The current drawn by the motor, which is the current passing through the resistor, depends upon the load placed on the motor so that as the load on the motor increases, the current drawn by the motor increases. As the current drawn by the motor increases, the voltage drop through the motor as a result of the current passing through the resistance of the windings increases.

If a fixed voltage is provided to the motor, as the voltage drop across the windings increases, the voltage supplied to the operation of the motor decreases. As the voltage provided to the operation of the motor decreases, the speed of rotation of the motor decreases. Therefore, to maintain a constant rotational velocity of the motor as the motor load increases, the voltage applied to the motor must be increased so that the "usable" voltage, that is the applied voltage minus the voltage dropped across the winding resistance, remains constant. To achieve this in the invention, the current drawn by the D.C. speed change motor 12 is sensed and the duty cycle of the voltage pulses delivered to the speed change motor 12 from the speed change motor driver 14 is increased or decreased depending on the increase or decrease in load on the speed change motor 12.

In the invention of FIG. 4, the current drawn by speed change motor 12 is sensed by the load sensor 30. Load sensor 30 includes a torque requirement module 31 and a current sensing resistor 32 of low resistance. Current sensing resistor 32 is connected in series with the line which carries the current from the speed change motor 12 to ground. H-bridge speed change motor driver 14, U3, sends current to speed change motor 12 on U3-3 and returned to U3 on U3-2 or sends current to speed change motor 12 on U3-2 and returned on U3-3 depending on the direction of rotation of speed change motor 12. In either case, all current returned from speed change motor 12 is then sent out of U3-1 through current sensing resistor 32, R19, to ground.

All the current passing through speed change motor 12 passes through this current sensing resistor 32 thereby causing a voltage drop across the resistor determined by Ohm's Law. As the current drawn by speed change motor 12 increases, the amount of current passing through the current sensing resistor 32 increases. As the current increases the voltage drop across resistor 32 increases.

A line 34 labeled "Speed Motor Current", is connected to the current carrying line between resistor 32 and speed change motor 12. The voltage relative to ground, sensed at line 34 increases in direct proportion to the current passed through resistor 32 which is the current passed through the speed change motor 12. Line 34 is connected to the pulse width modulator 40. In this way, the current passing through speed change motor 12 is sensed and the information about the current passed to the pulse width modulator 40.

In the embodiment shown in FIG. 5, the current passing through speed change motor 12 passes through current sensing resistor 32 labeled R19. Line 34, in the preferred embodiment is labeled "Speed Motor Current" and has a voltage on it proportional to the current passing through the current sensing resistor R19. "Speed Motor Current" line 34 is connected to torque requirement module 31 shown on FIG. 5.

Torque requirement module 31 includes an op-amp U12. The voltage at "Speed Motor Current" line 34 is presented at input U12-5 through an RC circuit consisting of resistors R62 and R63 and capacitors C31 and C32. The other input, U12-6, is biased by a feedback network from the output U12-7 through variable resistor R75 and resistor R58 to ground. As R75 is adjusted, the gain of op-amp U12 varies so the output of U12-7 varies.

Once R75 has been adjusted, the voltage at U12-7 increases as required in direct proportion to the current passed through speed-change motor 12. The output of U12-7 is a signal whose voltage is directly proportional to the current passed through the speed change motor 12. The output of U12-7 is passed to pulse width modulator 40 at resistor R60. This output signal will be used to adjust the duty cycle of the voltage pulses that are passed to the motor driver controller 14. As the voltage at U12-7 increases, the duty cycle of the voltage pulses sent to the speed change motor driver 14 increase, thereby increasing the "average" voltage presented to speed change motor 12.

The output U12-1 of comparator U12 is connected to input U12-2 and the output of torque requirement module 31 at U12-7 through a resistor network consisting of resistors R59 and R60. Thus, assuming the voltage at U12-7 is constant, which means that the load on speed change motor 12 is a constant, as the speed of the treadmill belt increases, the voltage from "Speed Feedback" at U12-3 increases as described above. As a result, the voltage at U12-1 increases to bring the voltage at U12-2 up to the voltage at U12-3. Because the voltage at U12-1 increases, the voltage at U8-8 increases. For the same reason, if the voltage at U12-3 decreases, indicating that the speed of the treadmill belt is decreasing, the voltage at U12-1 and consequently U8-8 decreases. When the voltage presented at U8-8 increases, the amount of time the "representative" signal from U8-8 is lower than the voltage output from frequency generator 38 at U8-9 decreases, causing the duty cycle of the "Speed Enable" signal at U8-14 to decrease. This will result in a lower "average" voltage presented to speed change motor 12. A lower "average" voltage will cause speed change motor 12 to rotate at a comparatively lower rate.

However, as the current passing through speed change motor 12 increases, indicating an increase in the load on speed change motor 12, the voltage at "Speed Motor Current" line 34, and consequently U12-7, increases. If the voltage at U12-3 is constant, indicating a constant speed for the treadmill belt, as the voltage at U12-7 increases, the voltage at U12-1 will decrease to keep the voltage at U12-2 constant, that is, equal to U12-3. As the voltage at U12-1 decreases, the voltage at U8-8 will decrease. Realistically, a varying "Speed Motor Current" will cause the treadmill belt speed to vary, but superposition allows this type of analysis.

As the voltage of the "representative" signal at U8-8 decreases, the "representative" signal at U8-8 will spend more and more time below the voltage of the signal output from frequency generator 38 at U8-9. As a result, the duty cycle of the "Speed Enable" signal output at U8-14 will increase. This will result in a higher "average" voltage presented to speed change motor 12. This will cause speed change motor 12 to rotate at a faster speed.

Figure 9:
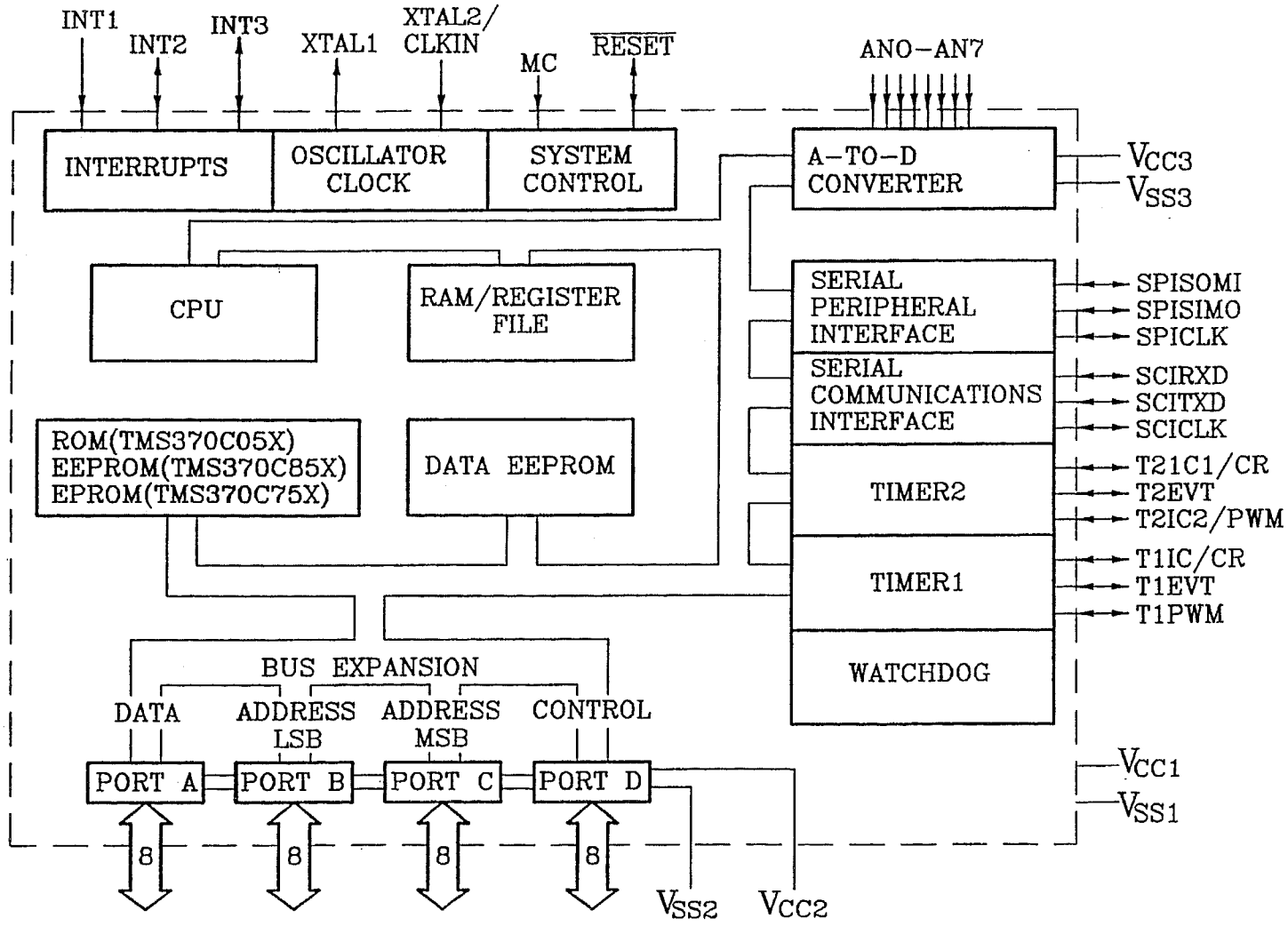
FIG. 9 is a block diagram of the functional blocks the microprocessor used in the invention of FIG. 8.
Figure 10:
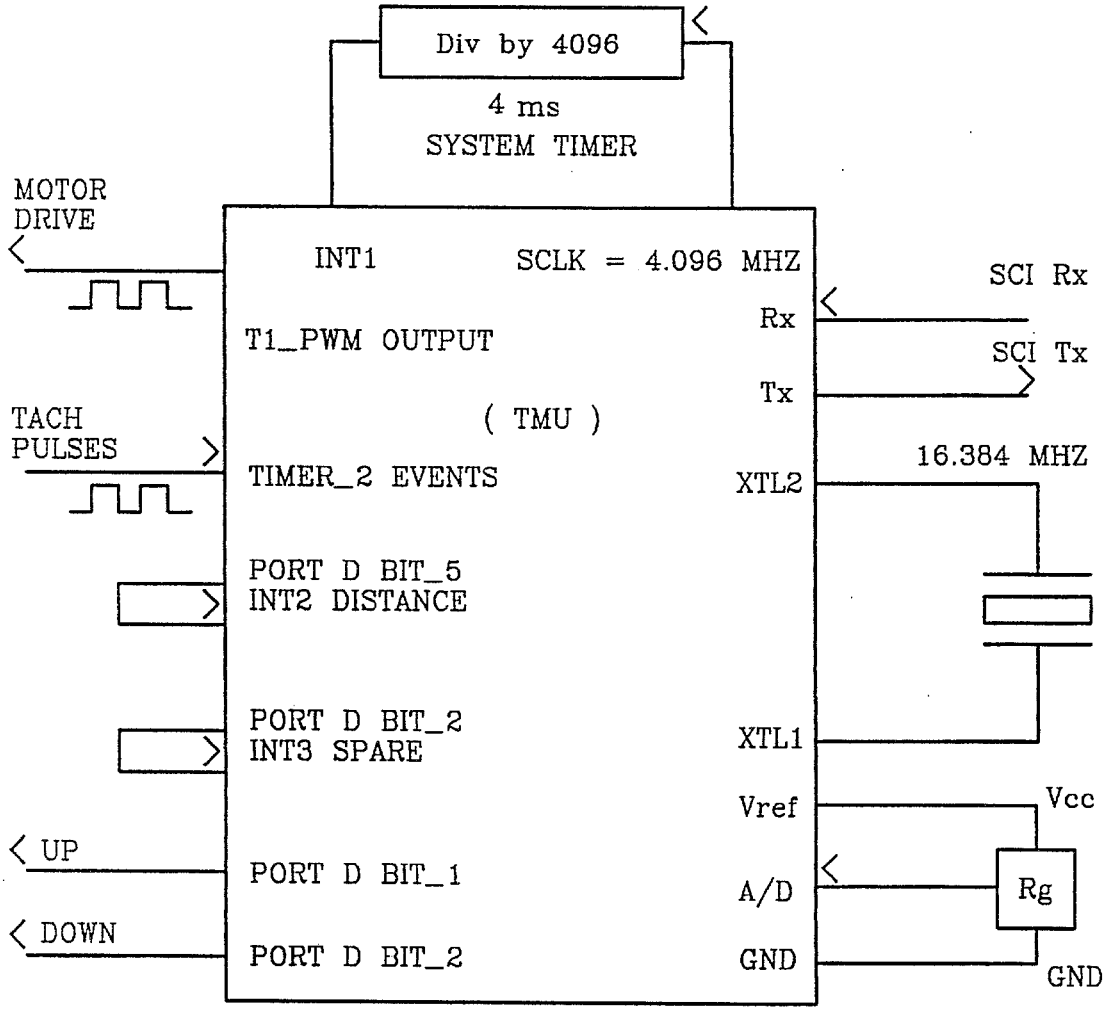
FIG. 10 is another block diagram of the microprocessor used in the invention of FIG. 8.

The preferred embodiment of the D.C. speed-change motor controller system, shown in FIG. 8, includes a microprocessor. This microprocessor is preferably a Model TMS370C250 micro-controller which will hereafter be referred to as the treadmill micro-controller (TMU). FIGS. 9 and 10 are block diagrams of the TMU and the output connections to the TMU. The TMU is connected to a display, which may include a display micro-controller (DPU), through the SCI channel.

In the preferred embodiment shown in FIG. 8, the microprocessor (TMU) controls the speed change of speed change motor 12. The basic speed control system contains a Micro-Controller based PWM drive (Timer 1) with digital tach feedback (Timer 2). The micro-controller uses one of its PWM channels to adjust the average DC level into a DC speed change motor and counts tach pulses from an optical interrupter tach.

Figure 17:
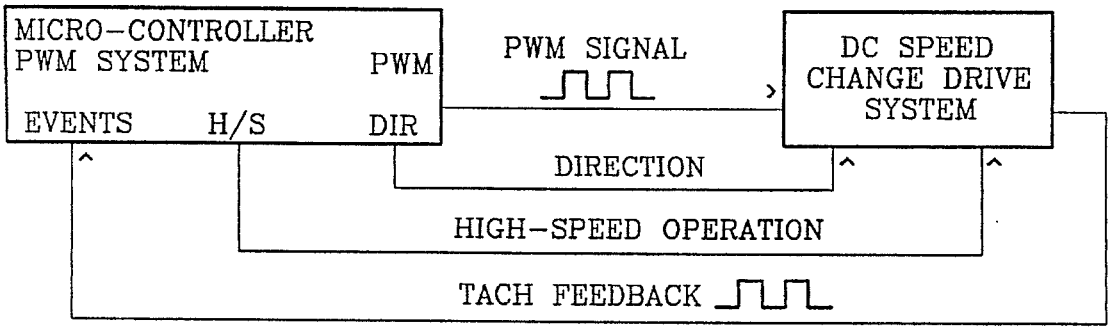
FIG. 17 is a block diagram of the micro-controller system of the invention of FIG. 8.

An additional high-speed deceleration control feature allows for a rapid deceleration to occur if a stop belt is indicated. The micro-controller asserts a high-speed deceleration control signal to an external speed change relay which applies 100 VDC directly to the speed change motor. While the transmission is decelerating, the micro-controller monitors the tach, and once the belt reaches a slow speed, the relay is turned off, and the drive motor is then stopped. This system is shown in FIG. 17.

The microprocessor TMU uses a control loop to control the speed change of the D.C. speed change motor 12. The control loop is accomplished by driving the DC speed change system with as high a pulse width as possible (duty cycle= large) until the actual speed (tach feedback) is within a capture range of the target speed. Once the capture range is attained, the pulse width is progressively reduced. Once the actual speed is within a coasting range of the target speed, the duty cycle is reduced to zero, and the DC speed change motor stops. Once the speed change system stops, a dead band is established. If the actual speed drops below or increases above the target speed by +/– a dead band, a new direction is set and the PWM signal is asserted ON until a new coasting range is found. After the target speed is reached, the software determines how close it was to reaching the target speed. If the accuracy was not within range, a PWM calibration constant is adjusted up or down accordingly and thus keeps the PWM control-loop stable and calibrated. This feature is called "smart cal".

It should also be noted that since the AC transmissions is non-linear in nature, the micro-controller must compensate by contouring the PWM control signal as a function of tach speed. This is accomplished by conducting a set of speed checks and by applying a contouring equation. By doing this, speed vs. time becomes linearized.

Figure 18:
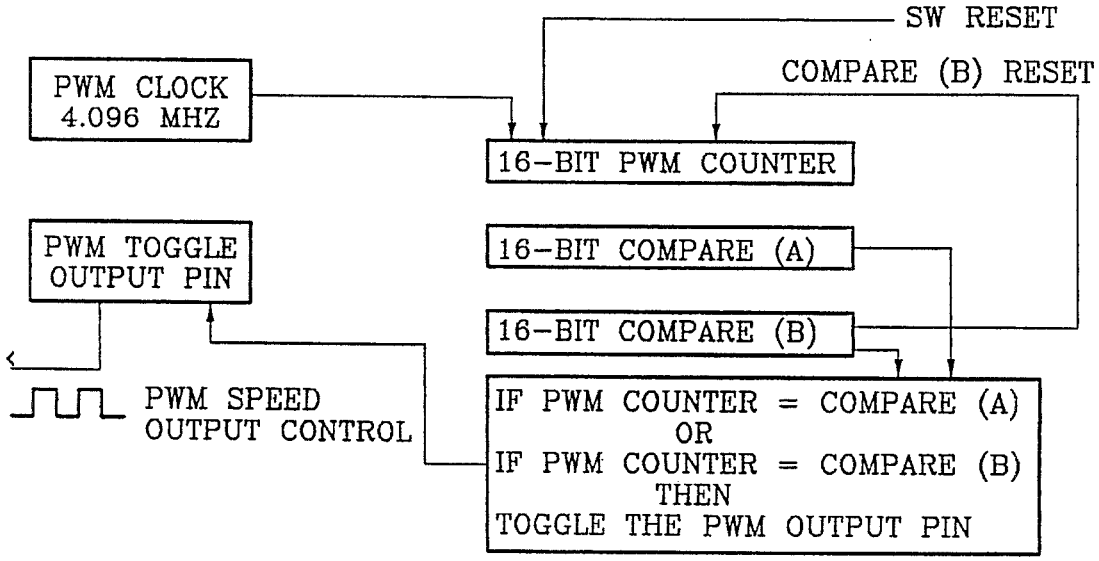
FIG. 18 is a block diagram of the Timer 1 configuration of FIG. 8.

Timer 1 assist in the control of the treadmill speed change. Timer 1, shown in detail in FIG. 18, is configured as a 16-bit dual compare PWM controller. In this mode, the system clock (4.096 MHZ) is fed into a 16-bit embedded counter.

The 16-bit counter output data is tied to two 16-bit internal digital comparators (compare (A) and compare (B), respectively). The output signals from compare (A) and (B) are connected to PWM toggle logic. An output from compare (B) is connected to counter reset. On power-up initialization, comparator (B) is loaded with a fixed constant which represents the PWM frequency. This value never changes during normal operation and is set for a free-running frequency, in the preferred embodiment, of 6,000 KHZ at power-up initialization. The equation for the fixed constant of Compare (B) is determined as follows:

$$PWM \text{ Frequency} = \text{Clock Frequency/Compare } (B)$$

$$\begin{aligned} \text{Compare } (B) &= \text{Clock Frequency/6,000} \\ &= 4{,}096{,}000/6{,}000 = 682 \end{aligned}$$

Compare (A) controls the pulse width of the PWM speed change signal. Comparator (A) gets software reloaded every 240 mS with a 16-bit PWM control word during normal speed change operation. This word can assume any value ranging from zero up to the value contained in compare register (B). The following equation shows this relationship: PWM Pulse Width (%)=[Compare (A)/Compare (B)]× 100%.

Figure 19:
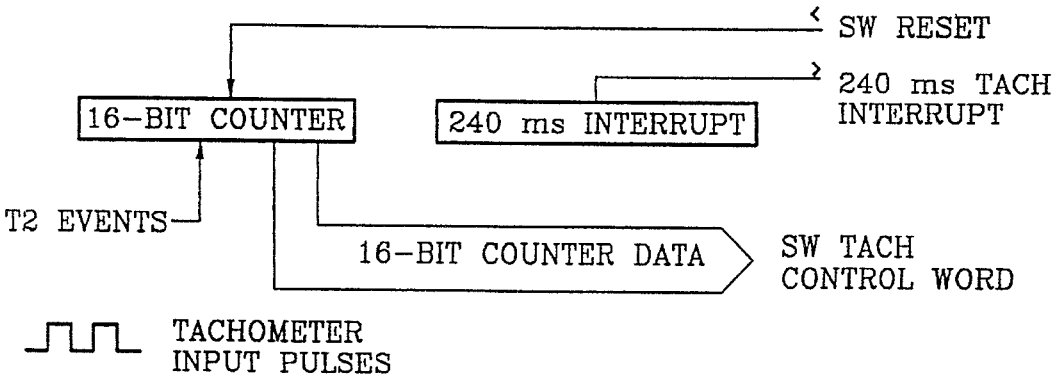
FIG. 19 is a block diagram of the Timer 2 configuration of FIG. 8.

Timer 2 Configuration (Tach Function) is shown in FIG. 19 and is configured as a 16-Bit fixed rate timer. Tach pulses are fed into a 16-Bit tach counter via the timer 2 event pin(T2EVT, FIG. 9) and are counted every positive edge transition. A 240 mS fixed rate timer interrupt is generated so that the software can read the tach counter and resolve treadmill speed every 240 mS. The software reads the tach control word from Timer 2 and converts it into actual speed. The following equation shows this relationship: Actual Speed=0.00474×Tach Control Word Value. The number 0.00474 represents the tach conversion constant.

The operation of the software will now be described. Three methods of tasking are employed in the TMU. The first type is defined as real-time tasking. All real-time tasks are synchronized and directed by the 1 mS interrupt procedure. The second type is defined as interrupt driven tasking. All interrupt driven tasks are serviced according to their absolute priority level. The third type is defined as background tasking. All background tasks are serviced in the main-loop, are not time critical and receive equal priority.

The interrupt controller contained in TMS370C250 is a two-level maskable interrupt handler. The two levels of priority are high (level . . . 1) and low (level . . . 2) respectively. Most sources can be programmed to operate in either the high or low priority modes, and within each fixed level, relative priorities exist. Therefore, absolute priorities can and have been defined. The 1 mS timer interrupt procedure is used to service time clock functions as well as to service real-time system tasks and other software invocable interrupts. Because of these requirements, INT1 (the 1 mS system timer) is assigned the highest absolute interrupt priority.

The table shown in FIG. 14 illustrates the configuration for each interrupt source used by the TMU. All interrupts not shown in this table are unused and, therefore, are not enabled during normal operation.

The following is a description of the Real-Time Driven Tasks. One-of the Real-Time Tasks is to calculate the total running time. One of the responsibilities of the 1 mS interrupt is to keep track of total treadmill running time in hours. In the preferred embodiment, after one hour, the 1 mS interrupt increments a 16-bit NVRAM total running time register by one. The DPU can request this information at any time to display maintenance information.

Another Real-Time Task is the distance calculation. If a Start Belt command is received by the TMU, a distance calculation task is serviced by the 1 mS interrupt every 1 second until the Stop Belt command is received, and the belt comes to a complete stop. The 1 mS system timer services the distance calculation task by invoking a lower priority external interrupt.

This is accomplished by having the 1 mS interrupt routine pulse an output port Which is connected to INT2. The following expressions represent the 32-bit Current Distance and the 16-bit Total Distance calculations respectively:

$$\text{Current Distance} = \text{Speed of operation} \times \text{Time}$$
$$\text{where speed} = 1.2 \text{ to } 12 \text{ mph}$$
$$\text{Total Distance} = \text{Sum of Current Distance.}$$

If the TMU receives a Clear Distance command, then the Current Distance register is cleared to zero, and the Total Distance remains unchanged. The Total Distance result is stored in EEPROM and is updated every one mile. A 16-bit mile counter is used to determine when to update the Total Distance result.

At any time during normal operation, the DPU can request either Current Distance or Total Distance from the TMU. This information is sent back to the DPU via the RS422 serial communication link.

The following will be a description of the interrupt driven tasks. The first of these interrupt driven tasks is the grade select. If a Grade Request command is received by the TMU, the appropriate Up/Down signal is asserted through an output port (Port D, FIG. 10), and the grade A/D converter (FIG. 9) is enabled and started. Once a conversion finishes, an interrupt with a relatively low priority is automatically invoked. Once inside this interrupt, the current grade is compared to the target grade and if they are not within a "coast factor" of one another, a new A/D conversion process is started. This process continues until the current grade is within a coast factor of the target grade.

Another interrupt driven task is the serial communications receiver (Serial Communications Interface (SCI), FIG. 9). After a byte is received by the TMU, an interrupt with a slightly moderate priority is generated. In this interrupt service routine, a byte is read from the receive input register (FIG. 15) and written into a temporary storage location. Once a new byte is read, the byte is checked for errors and its status is set.

Yet another interrupt driven task is the serial communication transmitter. In order to send a frame to the DPU, a byte is placed into the transmit output register (FIG. 16) and shifted out until the transmit register goes empty. At this point, an interrupt with a moderate priority is invoked. This interrupt service routine informs the TMU that it can send a new byte to the transmit output register.

The following will be a description of the background tasks. All background tasks are performed in the main-loop and do not require real-time or interrupt driven attention. Even though background tasks do not require interrupts or timing synchronization, other types of tasks (real-time and interrupt tasks) are used indirectly to provide input or output for some background tasks.

One Of the background tasks is communications control, that is, communication between the TMU and the host, in this case the DPU, via a RS 422 Serial Communications Link. In the preferred embodiment, this includes packet receiving, decoding and sending.

The TMS370C250 contains four general purpose I/O ports that can be configured for external memory access. As shown in FIG. 9, Port A on the TMU is configured as a dedicated 8-bit data path. Ports B and C are configured as a 16-bit address path. Port D is programmed for External Data Strobe, Read/Write, Clock Out, Opcode Fetch and Grade Up/Down signals as well as other port control signals.

The SCI channel (FIG. 9) is configured to operate as an interrupt driven asynchronous serial communications channel. In the preferred embodiment, the baud rate is 9600 bps, and the channel is configured for one start bit, eight data bits, even parity and one stop bit. Packets are sent or received one byte at a time through the SCI channel with an Acknowledge byte response after each received byte.

As mentioned, the preferred embodiment of the D.C. speed-change motor controller system includes software which controls the grade elevation motor of the treadmill. The following is a description of the A/D Configuration and Operation (Grade Sense). The embedded analog to digital converter (FIGS. 8, 9 and 10) is configured to operate as an interrupt driven voltage measuring device. This A/D converter has the ability to select up to eight independent input sources and input references.

In order to process an A/D conversion, an input source is first selected, and in the TMU, only two inputs are considered as valid sources. These sources are the A/D self-test and the grade sensing inputs.

After a source is selected, a reference voltage is programmed. A plus five volt source is available for all A/D input references. Once both the source and the reference have been selected, a Sample Start process begins. This process samples the A/D input port for exactly 1 uS in order to stabilize the input impedance. After the input impedance is stabilized, a Convert Start process is initiated, and program control is relinquished to other system tasks until the conversion is complete.

Each A/D conversion takes 164 system clock cycles (exactly 40,039 uS) to complete. After the A/D conversion is complete, an interrupt is generated, and the A/D data conversion register is read. Once read, a new conversion can be started. The maximum number of conversions that the TMU can perform in one second is 21,800 assuming no other system tasks are running during this time.

Another background task is system and fault status checking. This information is Communicated to the host through the DPU.

There are several error checking tasks. The first of these is the Speed Error Checking Task. The Speed Error Checking task is a background-task that checks the motor control system for possible control-loop faults. Once the current speed is determined to be equal to the target speed (i.e. no ramping is occurring), the tach Speed is compared with the current speed. If the difference is greater than +/–0.25 mph, then an error status message is sent to the host (DPU).

The Grade Error Checking task is a background task that checks the grade control system for possible faults.

The Motor Overload Error Checking Task is a background task that checks for possible motor overload conditions.

The following is a description of the Other Current Status Checking Tasks. In addition to speed, grade, power supply and motor overload fault conditions, speed ramping and grade ramping conditions will also be reported to the DPU in the Current Status response command. The TMU uses an external timer for a general purpose system timer. The system clock is fed into an external divide by 4096 counter, where the output of this counter is connected to a high priority interrupt input on the TMU. The TMU is programmed to generate an interrupt on the rising edge of the external 1 mS timer pulse. The system timer is used primarily for calculating distance and total running time. This system timer is also used for all other general purpose timer functions required by the TMU.

Figure 20:
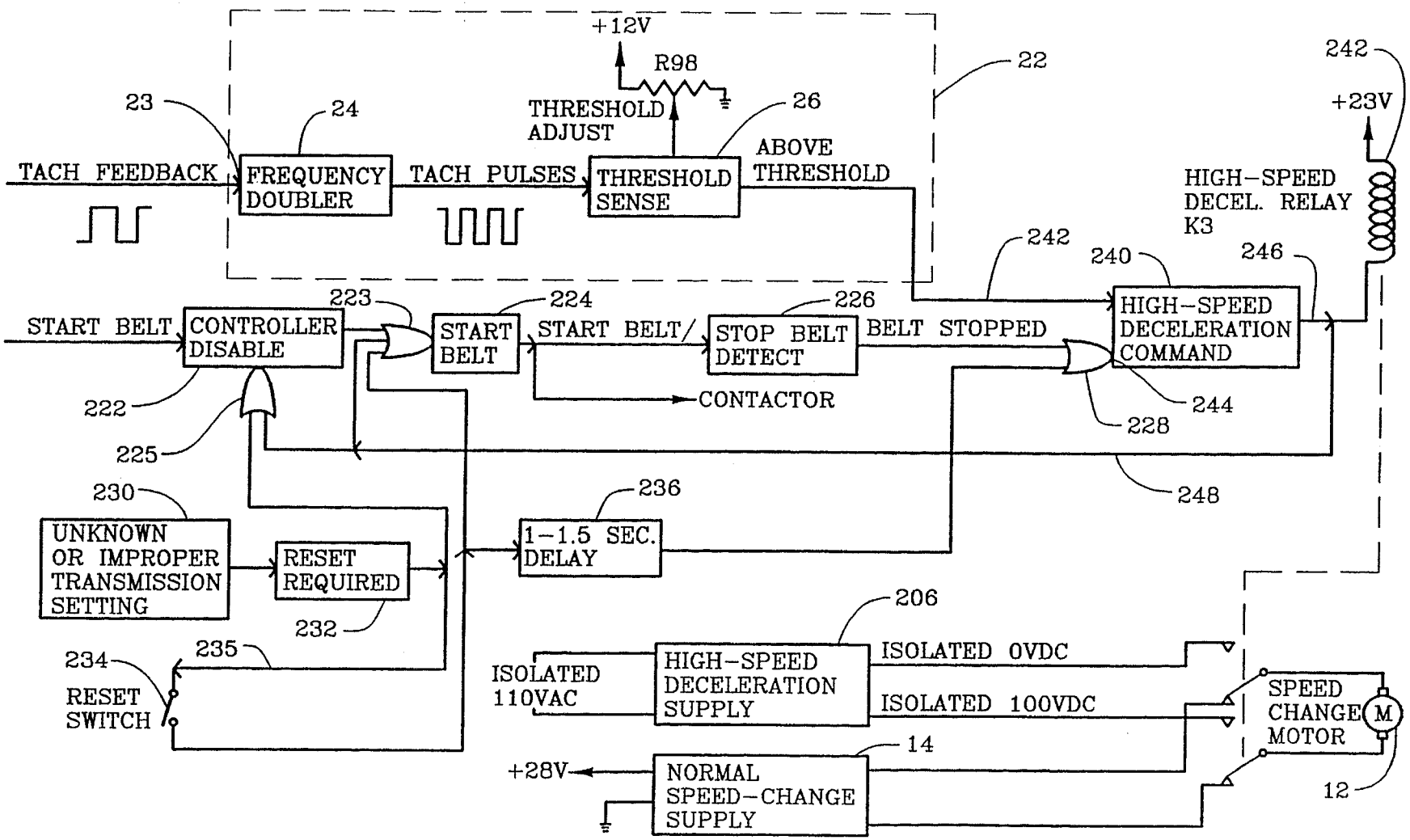
FIG. 20 is a block diagram of one embodiment of the high-speed deceleration system of the invention.

The high speed deceleration system is shown in FIG. 20. In FIG. 20, an optical tachometer (not shown).which is attached to the output shaft 9 of the transmission. The output signal from the optical tachometer is presented to the input of the tachometer frequency to voltage converter 22 at input 213. The output of an optical tachometer is a square wave varying from 0 volts to 12 volts with the square wave having about a 50% duty cycle. The frequency of the square wave is directly proportional to the speed of rotation of the output shaft of the transmission. The output of the optical tachometer presented at input 213 is passed to frequency doubler 24 which has a normal output voltage of 12 volts. This is the same frequency doubler of the invention of FIG. 4.

The output from frequency doubler 24 is passed to threshold sense 26 which is the same as in the invention of FIG. 4. Threshold sense 26 filters the output of frequency doubler 24 to "smooth it out" to produce a D.C. voltage which is inversely proportional to the frequency of the signal-output from frequency doubler 24. The higher the frequency output for frequency doubler 24, the lower voltage produced after filtering. Since the signal output from frequency doubler 24 is proportional to the speed of rotation of the output shaft of the transmission, which is proportional to the speed of the treadmill belt, the voltage determined after filtering the signal output from frequency doubler 24 is inversely proportional to the speed of the treadmill belt. This filtered voltage is compared to a threshold level set by threshold adjust 28. If the filtered voltage is below the threshold voltage, a logical "high" signal is output from threshold sense 26 and passed from the tachometer frequency to voltage converter 22 to high speed deceleration command module 240. Otherwise, a logical "low" is passed from the tachometer frequency to voltage converter 22 to high Speed deceleration command module 240.

High speed deceleration command module 240 is fed information concerning the speed of the treadmill belt from tachometer frequency to voltage converter 22 and information regarding whether the belt has been enabled to operate from stop belt detect 226. If the belt has been enabled to run and if the belt is running at a speed above the desired threshold, the high speed deceleration command module 240 directs relay 242 to switch from the comparatively low voltage normally supplied to the D.C. speed change motor 12 from the D.C. speed change motor driver 14 to the high voltage supplied by high speed deceleration voltage supply 206. In the preferred embodiment of the invention, the "low" voltage is +28 volts while the "high" voltage is 100 volts. Because D.C. speed change motor 12 is a D.C. motor, its rate of rotation is dependent on the voltage supplied to it. By sending 100 volts to speed change motor 12 from the high speed deceleration voltage supply 206, speed change motor 12 rotates at a much more rapid rate than at it would when supplied with 28 volts from the D.C. speed change motor driver 14. This causes speed change motor 12 to rapidly change the configuration Of the transmission to cause the transmission to cause the belt of the treadmill to rapidly slow down. Once the treadmill belt has slowed to a speed below the preset threshold speed, the high speed deceleration is no longer enabled through the tachometer frequency to voltage converter 22. The treadmill belt is then stopped by the shutting off of the drive motor 2.

When the start belt switch (not shown) is pushed by the user, a logical "low" is sent from the start belt switch to controller disable 222. When controller disable 222 is activated, as will be explained hereafter, it disables the user's ability to further give directions to the start belt module 224 to start the belt. However, when controller disable 222 is not activated, the "low" signal from the start belt switch is passed through the controller disable 222 to the start belt module 224 through "OR" gate 223.

Start belt module 224, upon reception of a "low" signal from controller disable 222 directs the treadmill drive motor 2 to begin to run. Since the treadmill drive motor 2 is attached to the transmission 1, and the transmission in turn is connected to the treadmill belt 6, as the treadmill drive motor 2 begins to run, the treadmill belt 6 begins to run at the speed determined by the current configuration of the transmission. As long as start belt module 224 receives a "low" at its input from "OR" gate 223, it will continue to direct the treadmill drive motor 2 to run so that the treadmill belt 6 continues to move. However, when start belt module 224 receives a logical "high" voltage at its input from controller disable 222, start belt module 224 directs the drive motor 2 to cease operation which in turn causes the treadmill belt 6 to cease to move.

In addition to sending a control signal to the drive motor 2 in response to a "low" signal at its input, the start belt module 224 sends a signal to the stop belt detect module 226. The signal sent from start belt module 224 to stop belt detect module 226 is a "low" when the treadmill drive motor 2 is to stop operating by turning off the treadmill drive motor. Stop belt detect module 226 passes a "low" signal from its input to its output and converts a 23 volt "high" signal at its input to a 12 volt "high" signal at its output. The output of stop belt detect 226 is passed to an "OR" logical gate 228 at the-input of high speed deceleration command module 240. Upon a "high" signal being passed from the stop belt detect module 226 to "OR" gate 228, high speed deceleration command module 240 "recognizes" that a possible high speed deceleration is desired in order to stop the belt before subsequent use by the user. When such a "high" signal is presented at "OR" gate 228, the high speed deceleration command 240 looks at the input from tachometer frequency to voltage converter 22 to see whether it is "high" or "low". If the signal at input 242 is "high" and the input at input 244 from "OR" module 228 is also "high", this indicates that the treadmill belt 6 speed is above the threshold speed and it is desired that the belt be rapidly decelerated. In this case, high speed deceleration command module 240 will send a "high" signal at its output 246 to relay 242 as described above.

The "high" signal output from high speed deceleration command module 240 in response to a deceleration command is also presented along line 248 to "OR" modules 223 and 225. The affect of this "high" signal from output 246 on "OR" module 225 is that a "high" signal is passed to controller disable 222 so that the user is no longer able to direct that the belt be started.

The affect of the "high" signal on "OR" module 223 is that start belt module 224 directs the treadmill drive motor 2 to cease operation.

It is also desirable to cause a high speed deceleration when the following conditions occur:

1. The return of power to the treadmill after the treadmill line cord is unplugged and then replugged into the wall, the power circuit breaker is cycled, or there is a momentary power interruption from the power utility.
2. A "Emergency-Off" switch has been activated.
3. Occurrence of a drive motor overload condition.
4. A high speed deceleration stops the treadmill at a speed above the slow speed threshold because the high speed deceleration system was unable to decelerate the speed of the treadmill belt 6 within a preset time period.

When any of the previous conditions occurs, as detected by deceleration condition module 230, a signal is sent from deceleration condition module 230 to reset required module 232. Reset required module 232 sends a "high" signal along line 233 to "OR" module 225 which disables controller disable 222 so that the user will not be able to restart the treadmill belt 6 until a reset switch 234 has been reset. When reset switch 234, which is normally open, is closed in response to a reset required condition, the "high" signal output from reset required module 232 is passed along line 235 through reset switch 234 to "OR" module 223 which directs start belt module 224 to cause the drive motor 2 to begin to run.

Also when reset switch 234 is closed when a "high" signal is sent from reset required module 232, the "high" signal is sent to delay 236 which delays the "high" signal for a time period which allows relay 242 to shift to a position to allow the 100 volts from high speed deceleration supply 206 to be applied to-speed change motor 12. This delay also allows the treadmill belt 6 to get up to speed. After this delay, which is typically about 1½ seconds, a "high" signal is passed from delay 236 to "OR" gate 228. This "high" presented at "OR" gate 228, directs high speed deceleration command module 240 to see whether the speed of the treadmill is above the threshold speed as indicated by the signal output from tachometer frequency to voltage converter 22 along line 242. If the treadmill belt 6 is running at a speed above the threshold speed, the high speed deceleration command module 240 sends a "high" at its output 246 to relay 242 which causes the 100 volt D.C. signal to pass from the high speed deceleration supply 206 to the speed change motor 12 to cause a rapid deceleration of the treadmill belt 6 speed.

If the treadmill is functioning properly, the treadmill belt 6 should be able to decelerate from its maximum speed to the threshold speed in a few seconds upon the application of the 100 volt D.C. signal from the high speed deceleration supply 206 to the speed change-motor 12. However, if for some reason the treadmill is unable to decelerate to a speed below the threshold speed within a preset time, a "high speed deceleration timeout system" 250 stops the treadmill belt 6 and causes the deceleration condition module 230 to indicate that a reset is required by reset required module 232.

Three Appendixes are attached hereto. Appendix I contains the source code used in the preferred embodiment of the D.C. speed-change motor control system shown in FIG. 8. Appendix II contains a description of the embodiment of FIG. 8 and is incorporated by reference into the specification. Appendix III contains a description of the high-speed deceleration feature of the invention and is incorporated herein by reference into the specification.

The invention has been described in connection with a specific embodiment. It is understood that the description contained herein is given for example only and not for the purpose of limitation. Changes and modifications may be made to the description contained herein and still be within the scope of the claimed invention. Further, it is recognized that obvious changes and modifications will occur to those skilled in the art.

We claim:

1. A method for rapidly decelerating a treadmill belt in a treadmill having a constant speed drive motor with a rotating member, a treadmill belt, a transmission for connecting the rotating member to the treadmill belt causing the treadmill belt to move in response to rotation of the rotating member, a D.C. speed change motor for varying the internal configurations of the transmission to vary the speed of the treadmill belt when the rotating member is rotating at a generally constant speed, the D.C. speed change motor, in normal operation, responding to voltage applied within a specified range of voltages, the method comprising the steps of:

producing a rapid deceleration control signal indicating that the treadmill belt should be decelerated;

producing a D.C. deceleration voltage of a voltage larger than the specified range of voltages normally applied to the D.C. speed change motor;

applying the D.C. deceleration voltage to the D.C. speed change motor in response to said rapid deceleration control signal, thereby causing the D.C. speed change motor to rapidly vary the internal configurations of the transmission;

whereby, the speed of the treadmill belt is rapidly decelerated.

2. The method of claim 1 wherein said step of producing a rapid deceleration control signal indicating that the treadmill belt should be decelerated includes the step of determining that the power to the treadmill has been interrupted and then restored.

3. The method of claim 1 wherein said step of producing a rapid deceleration control signal indicating that the treadmill belt should be decelerated includes the step of determining whether the treadmill user has indicated that the user would like to immediately stop the treadmill belt.

4. The method of claim 1 wherein said step of producing a rapid deceleration control signal indicating that the treadmill belt should be decelerated includes the step of sensing the occurrence of a drive motor overload condition.

5. The method of claim 1 wherein said step of producing a rapid deceleration control signal indicating that the treadmill belt should be decelerated includes the steps of:

timing the time that a voltage larger than the specified range of voltages normally applied to the D,C, speed change motor has been applied to the D.C. speed change motor;

determining that the time that a voltage larger than the specified range of voltages normally applied to the D,C, speed change motor has been applied to the D,C, speed change motor exceeds a preset time period.

6. The method of claim 1 further comprising the step of:

sensing the speed of the treadmill belt;

turning off the drive motor once the sensed speed of the treadmill belt drops below a predetermined speed.

7. The method of claim 6 wherein said step of producing a rapid deceleration control signal includes the step of determining that the speed of the treadmill belt exceeds a predetermined speed.

8. The method of claim 6 wherein said step of producing a rapid deceleration control signal indicating that the treadmill belt should be decelerated includes the step of determining that the power to the treadmill has been interrupted and then restored.

9. The method of claim 6 wherein said step of producing a rapid deceleration control signal indicating that the treadmill belt should be decelerated includes the step of determining whether the treadmill user has indicated that the user would like to immediately stop the treadmill belt.

10. The method of claim 6 wherein said step of producing a rapid deceleration control signal indicating that the treadmill belt should be decelerated includes the step of sensing the occurrence of a drive motor overload condition.

11. The method of claim 6 wherein said step of producing a rapid deceleration control signal indicating that the treadmill belt should be decelerated includes the steps of:

timing the time that a voltage larger than the specified range of voltages normally applied to the D.C. speed change motor has been applied to the D.C. speed change motor;

determining that the time that a voltage larger than the specified range of voltages normally applied to the D.C. speed change motor has been applied to the D.C. speed change motor exceeds a preset time period.

12. A method for causing the rapid deceleration of a treadmill belt in a treadmill having an A.C. drive motor with a rotating member, a treadmill belt, a transmission for connecting the rotating member to the treadmill belt so that rotation of the rotating member causes the treadmill belt to move and a D.C. speed change motor for varying the internal configurations of the transmission to vary the speed of the treadmill belt when the rotating member is rotating at a generally constant speed, the D.C. speed change motor, in normal operation, responding to voltage applied within a specified range of voltages, comprising the steps of:

sensing the speed of the treadmill belt;

producing a rapid deceleration control signal indicating that the treadmill belt should be decelerated;

producing a D.C. deceleration voltage of a voltage larger than the specified range of voltages normally applied to the D.C. speed change motor;

applying the D.C. deceleration voltage to the D.C. speed change motor in response to a determination that the speed of the treadmill belt is above a threshold speed and in response to said rapid deceleration control signal, thereby causing the D.C. speed change motor to rapidly vary the internal configurations of the transmission;

whereby, the speed of the treadmill belt is rapidly decelerated.

13. The method of claim 12 wherein said step of producing a rapid deceleration control signal indicating that the treadmill belt should be decelerated includes the step of determining that the power to the treadmill has been interrupted and then restored.

14. The method of claim 12 wherein said step of producing a rapid deceleration control signal indicating that the treadmill belt should be decelerated includes the step of determining whether the treadmill user has indicated that the user would like to immediately stop the treadmill belt.

15. The method of claim 12 wherein said step of producing a rapid deceleration control signal indicating that the treadmill belt should be decelerated includes the step of sensing the occurrence of a drive motor overload condition.

16. The method of claim 12 wherein said step of producing a rapid deceleration control signal indicating that the treadmill belt should be decelerated includes the steps of:

timing the time that a voltage larger than the specified range of voltages normally applied to the D.C. speed change motor has been applied to the D.C. speed change motor;

determining that the time that a voltage larger than the specified range of voltages normally applied to the D.C. speed change motor has been applied to the D.C. speed change motor exceeds a preset time period.

17. The method of claim 12 further comprising the step of turning off the drive motor once the sensed speed of the treadmill belt drops below a predetermined speed.

18. A method for causing the rapid deceleration of a treadmill belt in a treadmill having an A.C. drive motor with a rotating member, a treadmill belt, a transmission for connecting the rotating member to the treadmill belt so that rotation of the rotating member causes the treadmill belt to move and a D.C. speed change motor for varying the internal configurations of the transmission to vary the speed of the treadmill belt when the rotating member is rotating at a generally constant speed, the D.C. speed change motor, in normal operation, responding to voltage applied within a specified range of voltages, comprising the steps of:

producing a rapid deceleration control signal indicating that the treadmill belt should be decelerated;

sensing the speed of the treadmill belt;

producing a voltage proportional to the sensed speed of the treadmill belt;

producing a threshold voltage level representative of a predetermined threshold speed of the treadmill belt;

comparing the voltage representative of the speed of the treadmill belt to said threshold voltage level;

producing a speed determination signal if the voltage representative of the sensed speed of the treadmill belt is above said threshold voltage, said speed determination signal indicating that the speed of the treadmill belt is above said threshold speed;

producing a D.C. deceleration voltage of a voltage larger than the specified range of voltages normally applied to the D.C. speed change motor;

applying said D.C. deceleration voltage to the D.C. speed change motor in response to the presence of both said speed determination signal and said rapid deceleration control signal, thereby causing the D.C. speed charge motor to rapidly vary the internal configurations of the transmission;

whereby, the speed of the treadmill belt is rapidly decelerated.

19. The method of claim 18 wherein said step of producing a rapid deceleration control signal indicating that the treadmill belt should be decelerated includes the step of determining that the power to the treadmill has been interrupted and then restored.

20. The method of claim 18 wherein said step of producing a rapid deceleration control signal indicating that the treadmill belt should be decelerated includes the step of determining whether the treadmill user has indicated that the user would like to immediately stop the treadmill belt.

21. The method of claim 18 wherein said step of producing a rapid deceleration control signal indicating that the treadmill belt should be decelerated includes the step of sensing the occurrence of a drive motor overload condition.

22. The method of claim 18 wherein said step of producing a rapid deceleration control signal indicating that the treadmill belt should be decelerated includes the steps of:

timing the time that a voltage larger than the specified range of voltages normally applied to the D.C. speed change motor has been applied to the D.C. speed change motor;

determining that the time that a voltage larger than the specified range of voltages normally applied to the D.C. speed change motor has been applied to the D.C. speed change motor exceeds a preset time period.

23. A method for rapidly decelerating and stopping a treadmill belt in a treadmill having an A.C. drive motor with a rotating member, a treadmill belt, a transmission for connecting the rotating member to the treadmill belt causing the treadmill belt to move in response to rotation of the rotating member, a D.C. speed change motor for varying the internal configurations of the transmission to vary the speed of the treadmill belt when the rotating member is rotating at a generally constant speed, the D.C. speed change motor, in normal operation, responding to voltage applied within a specified range of voltages, and a rapid deceleration control signal indicating that the treadmill belt should be decelerated, comprising the steps of:

producing a D.C. deceleration voltage of a voltage larger than the specified range of voltages normally applied to the D.C. speed change motor;

applying the D.C. deceleration voltage to the D.C. speed change motor in response to the rapid deceleration control signal, thereby causing the D.C. speed change motor to rapidly vary the internal configurations of the transmission;

applying electrical power to the A.C. drive motor until the speed of the treadmill belt is below a threshold speed;

terminating the application of electrical power to the A.C. drive motor after the speed of the treadmill belt has been slowed below the threshold speed;

whereby, the speed of the treadmill belt is rapidly decelerated to the threshold speed whereafter the movement of the treadmill belt is terminated.

24. The combination of a device for rapidly decelerating a treadmill belt and a treadmill having a constant speed drive motor with a rotating member, a treadmill belt, a transmission for connecting the rotating member to the treadmill belt causing the treadmill belt to move in response to rotation of the rotating member, a D.C. speed change motor for varying the internal configurations of the transmission to vary the speed of the treadmill belt when the rotating member is rotating at a generally constant speed, the D.C. speed change motor, in normal operation, responding to voltage applied within a predetermined range of voltages, the device comprising:

a rapid deceleration control signal producing member to indicate that said treadmill belt should be decelerated;

a D.C. deceleration voltage producing member for producing a voltage larger than said predetermined range of voltages normally applied to said D.C. speed change motor;

a D.C. deceleration voltage application member for applying said D.C. deceleration voltage to said D.C. speed change motor in response to said rapid deceleration control signal, thereby causing said D.C. speed change motor to rapidly vary said internal configurations of the transmission;

whereby, the speed of said treadmill belt is rapidly decelerated.

25. The combination of a device for rapidly decelerating a treadmill belt and a treadmill having a constant speed drive motor with a rotating member, a treadmill belt, a transmission for connecting the rotating member to the treadmill belt causing the treadmill belt to move in response to rotation of the rotating member, a D.C. speed change motor for varying the internal configurations of the transmission to vary the speed of the treadmill belt when the rotating member is rotating at a generally constant speed, the D.C. speed change motor, in normal operation, responding to voltage applied within a predetermined range of voltages, the device comprising:

a micro-controller for producing a rapid deceleration control signal indicating that said treadmill belt should be decelerated;

a high speed deceleration voltage supply member for producing a D.C. deceleration voltage which is a voltage larger than said predetermined range of voltages normally applied to said D.C. speed change motor;

a relay member for applying said D.C. deceleration voltage to said D.C. speed change motor in response to said rapid deceleration control signal, thereby causing said D.C. speed change motor to rapidly vary said internal configurations of the transmission;

whereby, the speed of said treadmill belt is rapidly decelerated.

26. The device of claim 25 further comprising a determining member for determining that the power to said treadmill has been interrupted and then restored.

27. The device of claim 25 further comprising a determining member for determining whether the treadmill user has indicated that the user would like to immediately stop said treadmill belt.

28. The device of claim 25 further comprising a sensing member for sensing the occurrence of a drive motor overload condition.

29. The device of claim 25 further comprising: a timer for timing the time that said voltage larger than predetermined range of voltages normally applied to said D.C. speed change motor has been applied to said D.C. speed change motor by said high speed deceleration voltage supply means; and, a determining member for determining that said timer has timed a time that exceeds a preset time period.

30. The device of claim 25 further comprising:

a sensing member for sensing the speed of said treadmill belt;

a shut off member for turning off said drive motor once the sensed speed of said treadmill belt drops below a predetermined speed.

31. The device of claim 30 wherein said sensing member includes an optical tachometer attached to said transmission.

32. The device of claim 31 wherein said sensing member further includes a tachometer frequency to voltage converter having an input for receiving signals from said optical tachometer, said tachometer frequency to voltage converter receiving signals from said optical tachometer.

33. The device of claim 32 wherein said tachometer frequency to voltage converter includes:

a frequency doubler;

a filter connected to said frequency doubler for filtering the output of said frequency doubler to produce a D.C. filtered voltage which is inversely proportional to the frequency of the signal output from said frequency doubler;

whereby the filtered voltage produced by said filter is inversely proportional to the speed of said treadmill belt;

a threshold voltage level producing member for producing a threshold voltage level representative of a predetermined threshold speed of said treadmill belt;

a comparison member for comparing the filtered voltage produced by said filter to the threshold voltage level and for producing a speed determination signal if the filtered voltage is below the threshold voltage, said speed determination signal connected to said relay member, said speed determination signal indicating that the speed of said treadmill belt is above a threshold speed.

34. The device of claim 30 wherein said device further comprises a member for applying said D.C. deceleration voltage to said D.C. speed change motor including a software high speed deceleration command module connected to said sensing member and to said rapid deceleration control signal, said command module producing a control signal if said treadmill belt is running at a speed above the desired threshold and said rapid deceleration control signal indicates that a rapid deceleration is desired;

wherein said relay member is connected to said command module and is enabled in response to said control signal and connects said high speed deceleration voltage supply member to said D.C. speed change motor.

35. The device of claim 30 wherein said device includes a determining member for determining that the sensed speed of said treadmill belt exceeds a predetermined speed.

36. The device of claim 30 wherein said device further comprises a determining member for determining that the power to said treadmill has been interrupted and then restored.

37. The device of claim 30 wherein said device further comprises a determining member for determining whether the treadmill user has indicated that the user would like to immediately stop said treadmill belt.

38. The device of claim 30 wherein said device further comprises a sensing member for sensing the occurrence of an overload condition of said drive motor.

39. The device of claim 30 wherein said device further comprises:

a timer for timing the time that said voltage larger than said predetermined range of voltages which is normally applied to said D.C. speed change motor has been applied to said D.C. speed change motor by said high speed deceleration voltage supply member; and determining member for determining that said timer has timed a time that exceeds a preset time period.

40. The combination of a device for rapidly decelerating a treadmill belt and a treadmill having a constant speed drive motor with a rotating member, a treadmill belt, a transmission for connecting the rotating member to the treadmill belt causing the treadmill belt to move in response to rotation of the rotating member, a D.C. speed change motor for varying the internal configurations of the transmission to vary the speed of the treadmill belt when the rotating member is rotating at a generally constant speed, the D.C. speed change motor, in normal operation, responding to voltage applied within a predetermined range of voltages, the device comprising:

a) high speed deceleration voltage supply member for producing a D.C. deceleration voltage of a voltage larger than said predetermined range of voltages normally applied to said D.C. speed change motor;

b) a first determining member for determining that the power to said treadmill has been interrupted and then restored;

c) a second determining member for determining whether the treadmill user has indicated that the user would like to immediately stop said treadmill belt;

d) a first sensing member for determining that the occurrence of an overload condition of said drive motor;

e) a timer for timing the time that a voltage larger than the specified range of voltages normally applied to the D.C. speed change motor has been applied to the D.C. speed change motor by said high speed deceleration voltage supply means;

f) a third determining member for determining that said timer has timed a time that exceeds a preset time period;

g) a micro-controller for producing a rapid deceleration control signal indicating that the treadmill belt should be decelerated in response to:

1) said first determining member;

2) said second determining member;

3) said first member; or 4) said timer;

h) relay member for applying said D.C. deceleration voltage to said D.C. speed change motor in response to said rapid deceleration control signal, thereby causing said D.C. speed change motor to rapidly vary said internal configurations of the transmission;

i) a second sensing member for sensing the speed of said treadmill belt;

j) a shut off member for turning off said drive motor once the sensed speed of said treadmill belt drops below a predetermined speed;

whereby, the speed of said treadmill belt is rapidly decelerated.

* * * * *